US008217607B2

(12) United States Patent
Inoue et al.

(10) Patent No.: US 8,217,607 B2
(45) Date of Patent: Jul. 10, 2012

(54) SAFETY DEVICE FOR POWER WINDOW, OPENING/CLOSING CONTROL METHOD AND PLATE-GLASS PROCESSING METHOD

(75) Inventors: Satoshi Inoue, Kanagawa (JP); Masayuki Kato, Kanagawa (JP); Kazushi Hirose, Kanagawa (JP); Yoshihiro Fujimura, Osaka (JP); Minoru Tanaka, Osaka (JP); Takao Koba, Osaka (JP); Hiroki Nishida, Osaka (JP); Takashi Inoue, Osaka (JP)

(73) Assignees: Shiroki Kogyo Co., Ltd., Kanagawa (JP); Tachibana Eletech Co., Ltd., Osaka (JP)

( * ) Notice: Subject to any disclaimer, the term of this patent is extended or adjusted under 35 U.S.C. 154(b) by 837 days.

(21) Appl. No.: 12/279,635

(22) PCT Filed: Oct. 12, 2006

(86) PCT No.: PCT/JP2006/320380

§ 371 (c)(1),
(2), (4) Date: Jan. 16, 2009

(87) PCT Pub. No.: WO2007/094098

PCT Pub. Date: Aug. 23, 2007

(65) Prior Publication Data

US 2009/0295556 A1 Dec. 3, 2009

(30) Foreign Application Priority Data

Feb. 17, 2006 (JP) ..... 2006-040651

(51) Int. Cl.
*E05F 15/16* (2006.01)

(52) U.S. Cl. ..... 318/434; 318/563; 318/566; 318/469

(58) Field of Classification Search ..... 318/563, 318/565, 566, 671, 264–266, 272, 282, 286, 318/434, 466–470

See application file for complete search history.

(56) References Cited

U.S. PATENT DOCUMENTS

| | | | | |
|---|---|---|---|---|
| 5,543,692 | A * | 8/1996 | Howie et al. | 318/282 |
| 6,573,677 | B2 * | 6/2003 | Gerbetz | 318/445 |
| 6,870,339 | B2 * | 3/2005 | Kessler et al. | 318/468 |
| 7,132,813 | B2 * | 11/2006 | Gregori et al. | 318/466 |
| 2009/0206784 | A1 * | 8/2009 | Inoue et al. | 318/434 |

FOREIGN PATENT DOCUMENTS

| | | |
|---|---|---|
| JP | 7-317430 | 12/1995 |
| JP | 10-110574 | 4/1998 |
| JP | 11-159246 | 6/1999 |
| JP | 2000-87646 | 3/2000 |
| JP | 2002-46468 | 2/2002 |
| JP | 2002-160147 | 6/2002 |
| JP | 2005-314949 | 11/2005 |

* cited by examiner

*Primary Examiner* — Bentsu Ro

(74) *Attorney, Agent, or Firm* — Finnegan, Henderson, Farabow, Garrett & Dunner, L.L.P.

(57) ABSTRACT

An opening/closing control method for a window regulator, which is a method of performing opening/closing control with a pinching prevention function while determining a detection signal from a sensor based on a threshold value. The method includes setting the threshold value as a value offset from a reference value for control, and updating the reference value in correspondence to a value of the detection signal from the sensor in an initial stage of control, and each time when the value of the detection signal from the sensor continuously changes in a certain time within a range where the value of the detection signal from the sensor does not exceed the threshold value, the reference value is modified by a value corresponding to such a changed value.

9 Claims, 49 Drawing Sheets

Fig. 48

| CHECK POINT | P1 | P2 | P3 | P4 | P5 |
|---|---|---|---|---|---|
| SIGNAL INTENSITY | 1.0 | 1.0 | 1.1 | 1.4 | 2.1 |

[V]

0.1

0.4

1.0

(a)

| CHECK POINT | P7 | P8 | P9 | P10 |
|---|---|---|---|---|
| SIGNAL INTENSITY | 1.0 | 1.0 | 3.0 | 5.0 |

[V]

2.0

4.0

(b)

(a)

(b)

(a)

(b)

SAFETY DEVICE FOR POWER WINDOW, OPENING/CLOSING CONTROL METHOD AND PLATE-GLASS PROCESSING METHOD

TECHNICAL FIELD

The present invention relates to a safety device for a power window, and particularly relates to a safety device for a power window that detects contact of a human body by using capacitance between a window glass and a window frame to avoid pinching, the power window raising and lowering a window glass between a closing position of the window frame and an opening position thereof.

Moreover, the invention relates to an opening/closing control method, and particularly relates to an opening/closing control method, in which a window glass is reciprocated between the closing position of the window frame and the opening position thereof while avoiding pinching of a human body based on a detection signal using capacitance.

Moreover, the invention relates to a plate-glass processing method, and particularly relates to a method of processing an edge portion of plate glass using a chamfering wheel.

BACKGROUND ART

In a power window that raises or lowers a window glass of a vehicle by drive force of a raising/lowering motor, when the window glass is gradually closed by continuously setting an operational switch to be on in a closing direction, a foreign substance may be pinched between the window glass and a window frame.

A safety device is proposed, in which a detection device is provided for detecting a fact that the foreign substance is pinched between the window glass and the window frame, and when the device detects pinching, it reversely drive a motor to lower the window glass irrespective of a state of the operational switch. As such a pinching detection device in the safety device, a device is proposed, in which a capacitance sensor is provided at an upper edge of a window glass for detecting change in capacitance, and when a value of capacitance (voltage) decreases to a predetermined threshold value or less, it is determined that a human body partially contacts to the upper edge of the window glass, and accordingly the window glass is lowered (for example, refer to patent document 1).

However, capacitance between an electrode on the upper edge of the window glass and the window frame varies during raising operation of the window glass. Therefore, in a previous device in which a certain value of capacitance at which a window glass being raised is reversed is set as a fixed threshold value, false determination on pinching of a foreign substance (false lowering operation of a window glass) may occur. Moreover, capacitance varies during raising operation of the window glass, in addition, varies depending on a use situation (such as weather or aged deterioration). However, variation due to such a use situation is not considered in the past, which may cause false determination (false operation) as well. Furthermore, such capacitance has a property that it abruptly changes (increases) when the window glass reaches a region near a full closing position (top dead center). To avoid false determination that such abrupt change in capacitance is caused by pinching of a foreign substance, control was performed in the past, in which a particular sensor was provided at a window frame side, and when the sensor detected approach of the window glass, output of a capacitance sensor was neglected.

In the safety device that detects pinching by using capacitance, a capacitor electrode at a window glass side is continuously formed along an edge of a window glass that may form a gap with respect to a window frame during operation of a power window. When the gap to the window frame is formed at an upside and laterally two sides of the window glass, the capacitor electrode is continuously formed over the three sides (for example, refer to patent document 2).

In the above power window, during the raising operation of the window glass, the gap to the window frame is closed early at the lateral sides compared with at the upside. When the gap at each lateral side is closed, capacitance between the window glass and the window frame increases, therefore change in capacitance that may subsequently occur due to pinching becomes inconspicuous, leading to difficulty in detection of pinching.

In a method of determining presence of pinching through comparison between a capacitance value and a threshold value, even if capacitance exceeds the threshold value due to a cause other than pinching of a human body, pinching avoidance may be performed. This may induce, for example, the false operation that the window glass is reversed directly before the window frame is fully closed.

In the case that pinching is determined to occur from a fact that a detection signal value exceeds a threshold value, and the window glass is thus reversed, while sensitivity of pinching detection is improved with decrease in margin of the threshold value to a value of a detection signal of a sensor, false operation occurs more easily due to an external condition such as weather or air temperature, or fluctuation of sensor performance or the like.

Operation modes of the power window include an automatic mode where the window glass is reciprocated between an opening position of a window frame and a closing position thereof while avoiding pinching of a human body, and a manual mode where the window glass is reciprocated between the opening position of a window frame and the closing position thereof according to switch operation of a user. In the automatic mode, the window glass is raised or lowered by one-touch operation of a switch, and in the manual mode, the window glass is raised or lowered only while a switch is on (for example, refer to patent document 3).

In the case that a vehicle has a plurality of power windows, wherein a central operation switch is provided at a driver seat side, so that any of the plurality of power windows can be optionally operated from the driver seat, sufficient care needs to be taken to a condition of a different seat in switch operation.

That is, for example, when a passenger in a different seat rests its elbow on a belt line while a window is fully opened, unexpected raising of a window glass may cause panic of the passenger, in addition, when a body of the passenger rests against a window glass remaining half opened, since a dangerous situation may occur due to unexpected raising or lowering of the window glass, sufficient care needs to be taken.

In the safety device where pinching is detected using capacitance between plate glass and a window frame, an electrode at a plate glass side is deposited onto an edge portion of the plate glass (for example, refer to patent document 2). Plate glass for a door of a vehicle or the like is subjected to abrasion at the edge portion. The abrasion includes C-surface processing or R-surface processing using a diamond wheel (primary processing), and finishing (secondary processing) using a chamfering wheel (for example, refer to patent document 4).

While either of the abrasion and the electrode deposition is processing to the edge portion of the plate glass, kinds of processing are completely different from each other, leading to a problem that they must be performed using different apparatuses and steps from each other.

Patent document 1: JP-A-2002-46468
Patent document 2: JP-A-10-110574
Patent document 3: JP-A-7-317430
Patent document 4: JP-A-2002-160147

DISCLOSURE OF THE INVENTION

According to the awareness of the above issues, an object of the invention is to achieve a safety device for a power window, which considers variation in capacitance during raising of a window glass, and considers variation in capacitance due to a use situation so as to reduce a possibility of false operation. Moreover, an object of the invention is to achieve a safety device for a power window, in which change in capacitance near a top dead center of a window glass can be neglected without requiring a particular sensor.

A safety device for a power window according to the invention is characterized by having a raising/lowering motor that raises or lowers a window glass of a vehicle; an operational switch that provides a normal or reverse rotation instruction to the raising/lowering motor; a pulse generator that generates repetitive pulses depending on amount of rotation of the raising/lowering motor; a window position counter that counts pulses generated by the pulse generator to acquire opening information of the window glass; a detector that uses an electrode provided on an upper edge of the window glass to detect capacitance; a storage unit that stores change in capacitance detected by the detector during raising operation of the window glass while relating the change in capacitance to window position information given by the window position counter; and a controller that sets a reversal threshold value with the stored change in capacitance, which is stored in the storage unit with being related to the window position information, as a reference, and reverses the raising/lowering motor to lower the window glass irrespective of a state of the operational switch in the case that a value of capacitance detected by the detector during raising operation of the window glass exceeds the reversal threshold value for each window position information.

In another aspect of a safety device for a power window according to the invention, in which change in capacitance is neglected after a window glass reaches a top dead center, the safety device for a power window is characterized by having a raising/lowering motor that raises or lowers a window glass of a vehicle; an operational switch that provides a normal or reverse rotation instruction to the raising/lowering motor; a pulse generator that generates repetitive pulses depending on amount of rotation of the raising/lowering motor; a window position counter that counts pulses generated by the pulse generator to acquire opening information of the window glass; a detector that detects capacitance between an electrode provided on an upper edge of the window glass and a window frame; and a controller that continues raising operation of the window glass disregarding change in capacitance detected by the detector after the window position counter detects that the window glass reaches a particular position near a top dead center during raising of the window glass, and in other cases, reverses the raising/lowering motor to lower the window glass irrespective of a state of the operational switch when capacitance detected by the detector during the raising operation of the window glass exceeds a reversal threshold value.

In the safety device for a power window, using a fact that the window position information is acquired by the window position counter, after the window position counter detects that the window glass reaches the particular position near the top dead center during the raising of the window glass, the controller can perform control disregarding change in capacitance detected by the detector. That is, a sensor that is required in the past can be omitted.

The change in capacitance, which relates to the window opening information, can be stored into the storage unit by the controller at least during manufacturing a vehicle. Alternatively, it can be stored periodically or when a change switch is operated.

According to the invention, a safety device for a power window can be obtained, which considers variation in capacitance during raising of a window glass, and variation due to a use situation of capacitance so as to be low in possibility of false operation. Moreover, a safety device for a power window can be obtained, which can continue closing operation of a window glass disregarding change in capacitance near a top dead center of the window glass without requiring a particular sensor.

Furthermore, a problem of the invention is to achieve a safety device for a power window, which is excellent in pinching detection sensitivity over all stages of movement of a window glass.

To solve the problem, the invention includes a safety device for a power window characterized in that the detection means has detection means that individually detects capacitance between a window glass and a window frame for each of sides of the window glass, and the controller has determination means that individually determines presence of pinching based on individual detection signals from the detection means, and control means that controls a window regulator based on a determination result of the determination means.

The detection means preferably has independent capacitor electrodes corresponding to the respective sides of the window glass in the light of appropriately performing pinching detection. The independent capacitor electrodes are preferably provided at a window glass side in the light of connecting capacitor electrodes at a window frame side through sides of the window frame.

The determination means preferably determines presence of pinching in a position area of the window glass being set for each of the individual detection signals in the light of appropriately determining presence of pinching.

According to the invention, the detector has detection means that individually detects capacitance between a window glass and a window frame for each of sides of the window glass, and the controller has determination means that individually determines presence of pinching based on individual detection signals from the detection means, and control means that controls a window regulator based on a determination result of the determination means, therefore a safety device for a power window can be achieved, which is excellent in pinching detection sensitivity over all stages of movement of the window glass.

Furthermore, a problem of the invention is to achieve a safety device for a power window, which is suitable for achieving a window regulator that does not cause false reversal of a window glass.

To solve the problem, the invention includes a safety device for a power window characterized in that the detector has first detection means that detects pinching of a human body by using capacitance between a window glass and a window frame, and second detection means that detects pinching of a human body by using physical quantity different from capacitance; and between two areas of an area at a closing position side of the window frame and an area at an opening position side thereof, the areas being given by dividing a moving range of the window glass into the two areas with a position as a boundary, at which abrupt increase in capacitance begins as the window glass moves in a direction of closing the window frame, the controller allows the window regulator to perform pinching avoidance based on a detection result of the first detection means in the area at the opening position side, and allows the window regulator to perform pinching avoidance based on a detection result of the second detection means in the area at the closing position side.

To solve the problem, the invention includes a safety device for a power window characterized in that the detector has first detection means that detects pinching of a human body by using capacitance between a window glass and a window frame, and second detection means that detects pinching of a human body by using physical quantity different from capacitance; and between two areas of an area at a closing position side of the window frame and an area at an opening position side thereof, the areas being given by dividing a moving range of the window glass into the two areas with a position as a boundary, at which abrupt increase in capacitance begins as the window glass moves in a direction of closing the window frame, the controller allows the window regulator to perform pinching avoidance based on at least one of a detection result of the first detection means and a detection result of the second detection means in the area at the opening position side, and allows the window regulator to perform pinching avoidance based on the detection result of the second detection means in the area at the closing position side.

The physical quantity is pulse width of a pulse signal showing rotation of the motor that drives the window glass.

According to the invention, the detector has first detection means that detects pinching of a human body by using capacitance between a window glass and a window frame, and second detection means that detects pinching of a human body by using physical quantity different from capacitance; and between two areas of an area at a closing position side of the window frame and an area at an opening position side thereof, the areas being given by dividing a moving range of the window glass into the two areas with a position as a boundary, at which abrupt increase in capacitance begins as the window glass moves in a direction of closing the window frame, the controller allows the window regulator to perform pinching avoidance based on a detection result of the first detection means in the area at the opening position side, and allows the window regulator to perform pinching avoidance based on a detection result of the second detection means in the area at the closing position side, therefore a safety device for a power window can be achieved, which is suitable for achieving the window regulator that does not cause false reversal of a window glass.

According to the invention, the detector has first detection means that detects pinching of a human body by using capacitance between a window glass and a window frame, and second detection means that detects pinching of a human body by using physical quantity different from capacitance; and between two areas of an area at a closing position side of the window frame and an area at an opening position side thereof, the areas being given by dividing a moving range of the window glass into the two areas with a position as a boundary, at which abrupt increase in capacitance begins as the window glass moves in a direction of closing the window frame, the controller allows the window regulator to perform pinching avoidance based on at least one of a detection result of the first detection means and a detection result of the second detection means in the area at the opening position side, and allows the window regulator to perform pinching avoidance based on a detection result of the second detection means in the area at the closing position side, therefore a safety device for a power window can be achieved, which is suitable for achieving the window regulator that does not cause false reversal of a window glass.

Furthermore, a problem of the invention is to achieve an opening/closing control method with a pinching prevention function, which enables high sensitivity compatible with accuracy.

To solve the problem, the invention includes an opening/closing control method, which is a method of performing opening/closing control with a pinching prevention function while determining a detection signal from a sensor based on a threshold value, characterized in that the threshold value is set as a value offset from a reference value for control, and the reference value is updated in correspondence to a value of the detection signal from the sensor in an initial stage of control, and each time when the value of the detection signal from the sensor continuously changes in a certain time within a range where the value of the detection signal from the sensor does not exceed the threshold value, the reference value is modified by a value corresponding to such a changed value.

The offset is constant. The offset is variable. A second threshold value larger than the threshold value and a third threshold value smaller than the threshold value are used as threshold values for abnormality determination in a detection signal system of the sensor. One of the second and third threshold values is a threshold value for disconnection determination in the detection signal system of the sensor, and the other is a threshold value for short-circuit determination.

According to the invention, the threshold value is set as a value offset from a reference value for control, and the reference value is updated in correspondence to a value of the detection signal from the sensor in an initial stage of control, and each time when the value of the detection signal from the sensor continuously changes in a certain time within a range where the value of the detection signal from the sensor does not exceed the threshold value, the reference value is modified by a value corresponding to such a changed value, therefore an opening/closing control method with a pinching prevention function can be achieved, which enables high sensitivity compatible with accuracy.

Since the offset is constant, a threshold value having a constant margin to the detection signal from the sensor can be obtained. Since the offset is variable, a threshold value having a variable margin to the detection signal from the sensor can be obtained.

Since the second threshold value larger than the threshold value and the third threshold value smaller than the threshold value are used as threshold values for abnormality determination in the detection signal system of the sensor, abnormality in the detection signal system of the sensor can be determined. Since one of the second and third threshold values is the threshold value for disconnection determination in the detection signal system of the sensor, and the other is the threshold value for short-circuit determination, disconnection and short-circuit in the detection signal system of the sensor can be determined respectively.

Furthermore, a problem of the invention is to achieve an opening/closing control method, in which pinching avoidance is not performed in any case other than the case of contact of a human body.

To solve the problem, the invention includes an opening/closing control method characterized in that when a window regulator, which reciprocates a window glass between a closing position of a window frame and an opening position thereof, is allowed to detect contact of a human body by using capacitance between the window glass and the window frame for avoiding pinching, pinching avoidance is made to be valid or invalid depending on whether a rate of change in capacitance detection signal during movement of the window glass is within a range being specified beforehand.

According to the invention, when a window regulator, which reciprocates a window glass between a closing position of a window frame and an opening position thereof, is allowed to detect contact of a human body by using capacitance between the window glass and the window frame for avoiding pinching, pinching avoidance is made to be valid or invalid depending on whether a rate of change in capacitance detection signal during movement of the window glass is within a range being specified beforehand, therefore an opening/closing control method, in which pinching avoidance is not performed in any case other than the case of contact of a human body, can be achieved.

To solve the problem, the invention includes an opening/closing control method characterized in that when a window regulator, which reciprocates a window glass between a closing position of a window frame and an opening position thereof, is allowed to detect contact of a human body by using capacitance between the window glass and the window frame for avoiding pinching, pinching avoidance is made to be valid or invalid depending on whether a rate of change in capacitance detection signal during movement of the window glass, which is in a region near a fully closing position of the window frame, is within a range being specified beforehand.

According to the invention, when a window regulator, which reciprocates a window glass between a closing position of a window frame and an opening position thereof, is allowed to detect contact of a human body by using capacitance between the window glass and the window frame for avoiding pinching, pinching avoidance is made to be valid or invalid depending on whether a rate of change in capacitance detection signal during movement of the window glass, which is in a region near a fully closing position of the window frame, is within a range being specified beforehand, therefore an opening/closing control method, in which pinching avoidance is not performed in any case other than the case of contact of a human body, can be achieved.

Furthermore, a problem of the invention is to achieve an opening/closing control method, which prevents an inconvenient situation caused by careless switch operation.

To solve the problem, the invention includes an opening/closing control method characterized in that when a plurality of window regulators, which reciprocate window glasses in a plurality of windows between a closing position of a window frame and an opening position thereof respectively while avoiding pinching of a human body based on a detection signal using capacitance, are individually controlled, in a condition that the window glasses are stopped, and the detection signal exceeds a threshold value, when switch operation for moving a window glass is performed for at least one window, the window glass in the relevant window is made immovable.

The plurality of windows are windows in a vehicle, and the switch operation is performed at a driver seat.

According to the invention, when a plurality of window regulators, which reciprocate window glasses in a plurality of windows between a closing position of a window frame and an opening position thereof respectively while avoiding pinching of a human body based on a detection signal using capacitance, are individually controlled, in a condition that the window glasses are stopped, and the detection signal exceeds a threshold value, when switch operation for moving a window glass is performed for at least one window, the window glass in the relevant window is made immovable, therefore an opening/closing control method, which prevents an inconvenient situation caused by careless switch operation, can be achieved.

Since the plurality of windows are windows in a vehicle, and the switch operation is performed at a driver seat, an opening/closing control method can be achieved, in which when switch operation is concentratively performed at the driver seat, an inconvenient situation is not caused by careless switch operation.

Furthermore, a problem of the invention is to achieve a plate-glass processing method, in which abrasion of an edge portion and deposition of an electrode are performed in the same apparatus at the same time.

To solve the problem, the invention includes a plate-glass processing method characterized in that when an edge portion of plate glass is processed using a chamfering wheel, a chamfering wheel is used, which can deposit a conductive substance onto the plate glass through a portion to be abrasively contacted during processing.

To solve the problem, the invention includes a plate-glass processing method characterized in that an edge portion of plate glass is processed using a chamfering wheel that can deposit a conductive substance onto the plate glass through a portion to be abrasively contacted during processing, and the conductive substance deposited during processing is fixed to the plate glass by baking.

The chamfering wheel has a composition containing an abrasive, a substrate, and a conductive substance. The chamfering wheel has a hollow portion filled with the conductive substance, and holes communicating from the hollow portion to the portion to be abrasively contacted.

According to the invention, when an edge portion of plate glass is processed using a chamfering wheel, a chamfering wheel is used, which can deposit a conductive substance onto the plate glass through a portion to be abrasively contacted during processing, therefore a plate-glass processing method can be achieved, in which abrasion of the edge portion and deposition of an electrode are performed in the same apparatus at the same time.

According to the invention, an edge portion of plate glass is processed using a chamfering wheel that can deposit a conductive substance onto the plate glass through a portion to be abrasively contacted during processing, and the conductive substance deposited during processing is fixed to the plate glass by baking, therefore a plate-glass processing method can be achieved, in which abrasion of the edge portion and deposition of an electrode are performed in the same apparatus at the same time.

Since the chamfering wheel has a composition containing an abrasive, a substrate, and a conductive substance, the conductive substance is easily deposited onto the plate glass through the portion to be abrasively contacted during processing.

Since the chamfering wheel has a hollow portion filled with the conductive substance, and holes communicating from the hollow portion to the portion to be abrasively contacted, a conductive substance is easily deposited onto the plate glass through the portion to be abrasively contacted during processing.

BRIEF DESCRIPTION OF THE DRAWINGS

[FIG. 48] It shows diagrams showing the part of the measurement result of capacitance respectively.

BEST MODE FOR CARRYING OUT THE INVENTION

Figure 1:
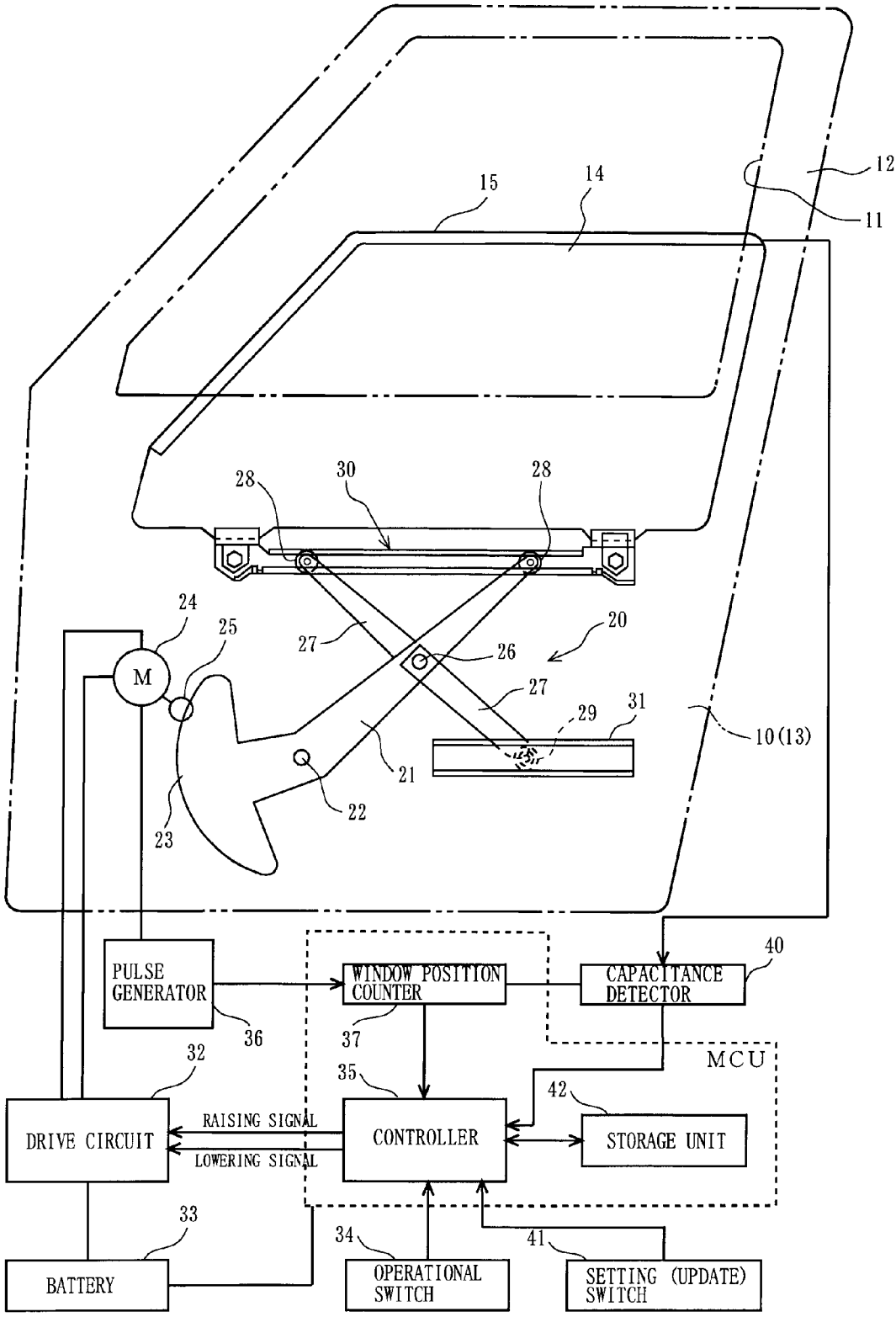
[FIG. 1] It shows a system connection diagram showing an embodiment where a safety device for a power window according to the invention is applied to an X-arm type power window.

FIG. 1 shows an example that the invention is applied to a vehicle door 10 having an X-arm type power window (regulator) 20. The vehicle door 10 has a sash part 12 having a window opening 11 in an upper side, and a panel part 13 in a lower side. The window opening 11 is opened and closed by a window glass 14. On an upper edge of the window glass 14, an electrode 15 including a metal material of aluminum or the like (foil, wire or the like), a conductive coating material or the like is formed by depositing the material.

The X-arm type power window 20 for raising and lowering the window glass 14 is supported in the panel part 13. That is, in the panel part 13, a lift arm 21 of the X-arm type power window 20 is swingably supported by a shaft 22, and the lift arm 21 integrally has a sector gear (driven gear) 23 with the shaft as a center. The sector gear 23 is engaged with a pinion 25 that is rotationally driven by a raising/lowering motor 24.

A middle portion in a longitudinal direction of the lift arm 21 is pivotally connected with a middle portion of an equalizer arm 27 by a shaft 26. A guide piece (roller) 28 is pivotally attached in a rotatable manner to an upper end (tip) of each of the lift arm 21 and the equalizer arm 27. Similarly, a guide piece (roller) 29 is pivotally attached to a lower end of the equalizer arm 27.

Each of the guide pieces 28 for the lift arm 21 and the equalizer arm 27 is movably fitted in a window glass bracket 30 fixed to a lower end of the window glass 14, and the guide piece 29 for the equalizer arm 27 is movably guided in an equalizer arm bracket 31 to be fixed in the panel part 13.

In the X-arm type power window 20, when the pinion 25 is driven positively and negatively via the raising/lowering motor 24, the lift arm 21 swings with the shaft 22 as a center via the sector gear 23, as a result, the window glass bracket 30 (window glass 14) moves up and down while being held in an approximately horizontal manner by the equalizer arm 27, guide pieces 28, 29, and equalizer arm bracket 31. Such up and down motion itself is the same as motion of the typical X-arm type power window 20.

The raising/lowering motor 24 is driven positively and negatively by a drive circuit 32. That is, the drive circuit 32 to be applied with a current from a battery 33 is supplied with a raising signal or a lowering signal via an operational switch 34 and a control unit 35, and drives the raising/lowering motor 24 positively and negatively according to the signal. Moreover, the raising/lowering motor 24 has a pulse generator 36 that generates a pulse in accordance with a rotational angle (frequency) of the motor.

As the pulse generator 36, various types are known. For example, in a pulse generator using a Hall element, a magnet rotor is fixed on a shaft of the raising/lowering motor 24, which is circumferentially magnetized in repetitive order of N and S, and a Hall element disposed adjacently to the magnet rotor generates pulses in accordance with rotation (angle) of the motor rotating shaft. Moreover, two Hall elements are disposed in the raising/lowering motor 24, thereby a rotation direction of the raising/lowering motor 24 can be known, that is, whether the window glass 14 is in raising operation (window closing operation) or in lowering operation (window opening operation) can be known. Such detection means of the rotation direction of the raising/lowering motor 24 is well known. Furthermore, the rotation direction of the raising/lowering motor 24 can be detected from a state of an operational switch 34.

The pulses from the pulse generator 36 are inputted into a window position counter 37. The window position counter 37 counts the pulses from the pulse generator 36 and thus acquires opening information of the window glass 14. The window opening information can be acquired depending on the number of pulses generated by the pulse generator 36 in a period from a full opening state to a full closing state of the window glass 14. In the embodiment, the number of pulses is assumed to be 400.

The electrode 15 on the upper edge of the window glass 14 is connected to a capacitance detector 40. The capacitance detector 40 continuously detects capacitance by using the electrode 15 on the window glass 14, and outputs the capacitance into the controller 35. When a setting (update) switch 41 is on, the controller 35 stores change in capacitance (variable value) during raising operation of the window glass (raising operation from the full opening state to the full closing state) into a storage unit 42 while relating the change in capacitance to window position information given by the window position counter 37. In the example, the degree of opening of the window glass 14 can be detected with a resolution of pulse No. 1 to pulse No. 400 given by the window position counter 37, and the capacitance change (value) is stored for each window opening information (every 1 pulse).

Figure 2:
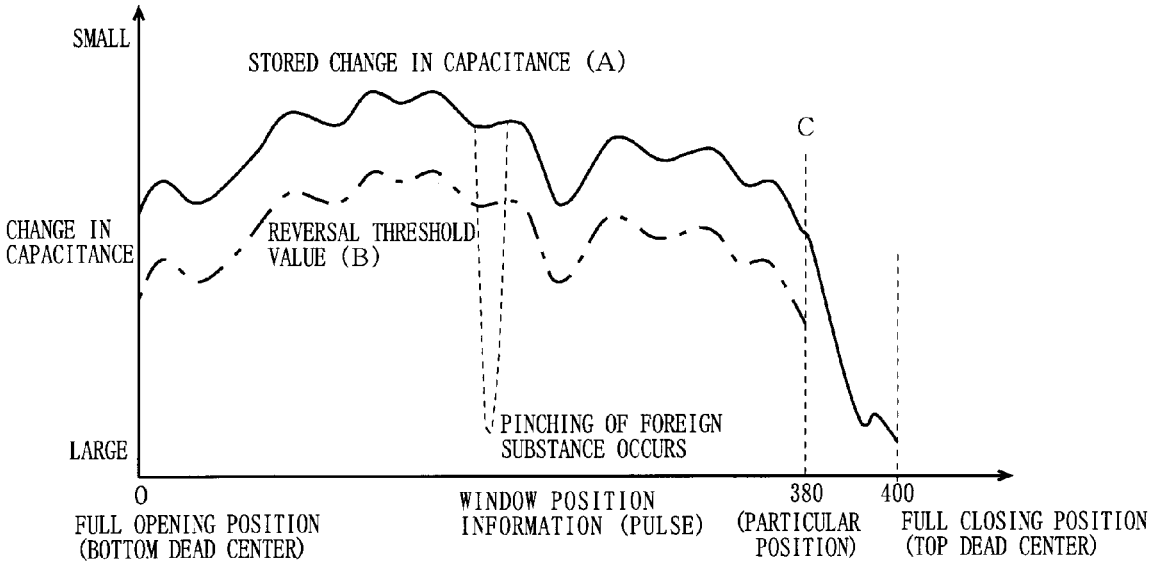
[FIG. 2] It shows a graph diagram showing an example of a relationship between a degree of window opening and change in capacitance.

FIG. 2 shows a specific measurement example of the window position information (1 to 400 pulses) plotted in a horizontal axis, and the change in capacitance plotted in a vertical axis. 0 pulse on the horizontal axis means that the window glass 14 is in the full opening state (bottom dead center), and 400 pulse means that the window glass 14 is in the full closing state (top dead center). Curve A shows change (variation) in capacitance occurring during actual raising and lowering of the window glass 14 detected by the capacitance detector 40, and is stored into the storage unit 42 by the controller 35 when the setting (update) switch 41 is subjected to on operation. Curve B shows a variable reversal threshold value for determining occurrence of pinching of a foreign substance in correspondence to the capacitance change curve A, and is set by the controller 35 depending on each window position information. That is, in the embodiment, the reversal threshold value is not a fixed value (single value), but varies depending on the window opening information.

Basic operation of the safety device of the embodiment is as follows. When the electrode 15 on the upper edge of the window glass 14 is contacted with part of a human body (for example, finger), capacitance detected by the capacitance detector 40 increases. The controller 35 detects such increase in capacitance during raising of the window glass 14, and when a value of the capacitance exceeds the reversal threshold value, the controller reversely lowers the window glass 14 via the drive circuit 32, raising/lowering motor 24, and X-arm type power window 20.

In the embodiment, the reversal threshold value is not a single value, and set for each window opening information based on the capacitance change curve A stored in the capacitance detector 40. That is, the reversal threshold value is set in correspondence to the curve A, which varies depending on actual window closing operation of the window glass 14, as shown by the variable reversal threshold value curve B in FIG. 2, leading to further reduction in false determination (false operation).

The capacitance change curve A is stored into the storage unit 42 at least during manufacturing a vehicle. In addition, the curve can be stored (updated) regularly or at an optional timing. Since the capacitance between the electrode 15 provided on the upper edge of the window glass 14 and the window frame tends to change due to a factor such as change in sliding resistance or deterioration of a glass run, the capacitance is desirably regularly updated.

Figure 3:
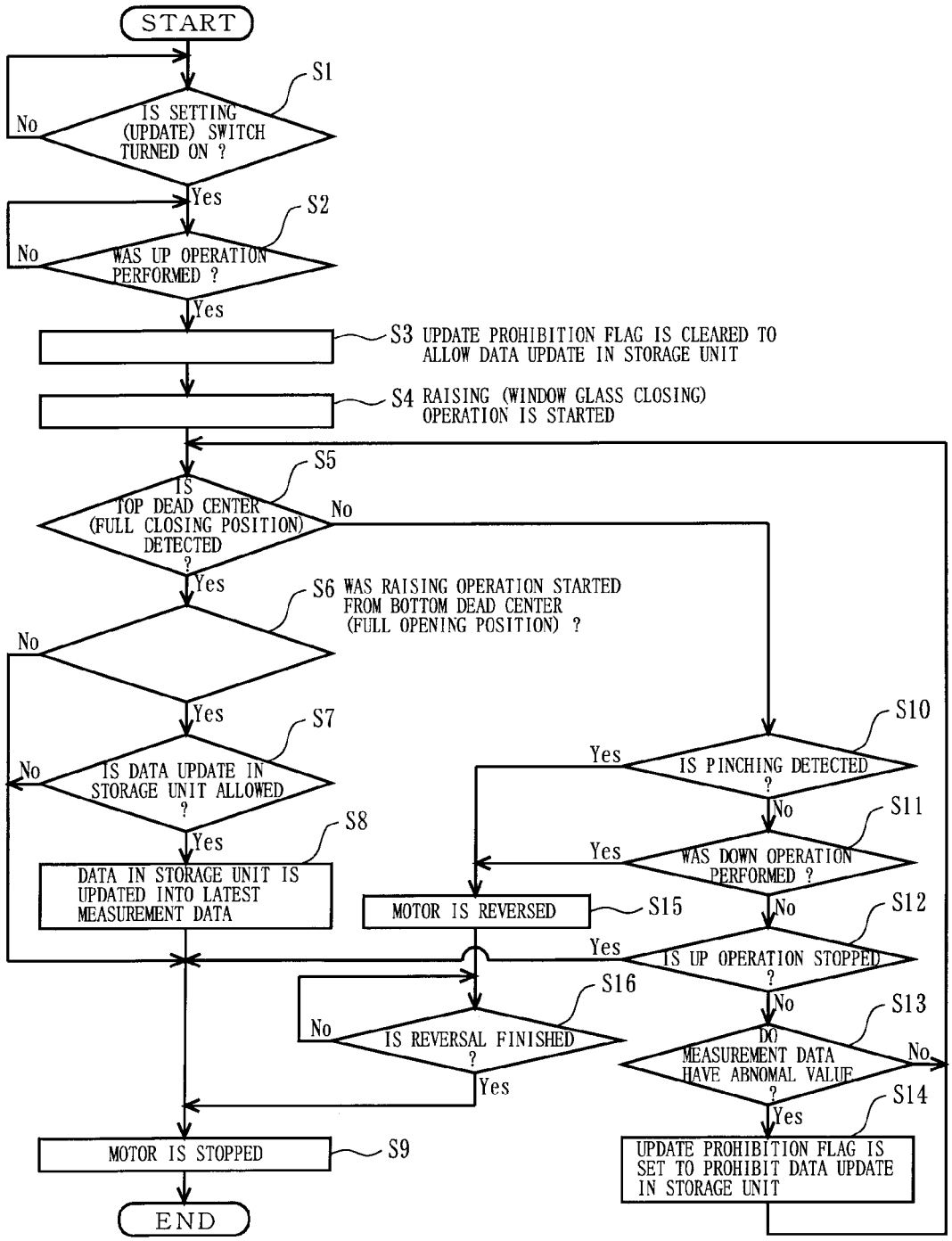
[FIG. 3] It shows a flowchart of updating (learning) change in capacitance.

An example of control in updating (learning) the capacitance change curve A is described according to a flowchart of FIG. 3. The flowchart of FIG. 3 relates to update processing (learning processing) executed by the controller 35. The update processing (learning processing) is started when the setting (update) switch 41 is subjected to on operation. The on operation of the setting (update) switch 41 may be performed manually or automatically (regularly).

When the setting (update) switch 41 is turned on (S1; Yes), the controller 35 checks whether UP operation was performed by the operational switch 34 from a state of the operational switch 34 (S2), and waits until the UP operation is performed (S2; No). If the UP operation was performed (S2; Yes), the controller clears an update prohibition flag for identifying whether update of the capacitance change curve A is prohibited and thus allows update in the storage unit 42 (S3), then provides a raising signal to the drive circuit 32 to drive the raising/lowering motor 24, so that raising operation (window closing operation) of the window glass 14 is started (S4). When drive of the raising/lowering motor 24 is started, the pulse generator 36 outputs a pulse every time the raising/lowering motor 24 rotates by a certain angle, the pulse is counted by the window position counter 37, and the counted value (window opening information) is outputted to the controller 35. The controller 35 produces the latest measurement data (capacitance change curve) while relating the variable value of capacitance inputted from the capacitance detector 40 to the window opening information inputted from the window position counter 37. Next, the controller 35 detects whether the window glass 14 is in the full closing state (top dead center) based on the window opening information inputted from the window position counter 37 (S5).

When the window glass is not in the full closing state (S5; No), the controller detects whether pinching occurs from the variable value of capacitance inputted from the capacitance detector 40 (S10), and when the controller does not detect pinching, the controller checks whether DOWN operation was performed from a state of the operational switch 34 (S10; No, S11). When the controller detects pinching (S10; Yes), or when the DOWN operation was performed even if the controller does not detect pinching (S11; Yes), the controller reverses the raising/lowering motor 24 via the drive circuit 32 (S15), and waits until the reversal operation is finished and then stops the raising/lowering motor 24 via the drive circuit 32 (S16, S9). On the other hand, when the DOWN operation was not performed (S11; No), the controller checks whether UP operation is stopped from the state of the operational switch 34 (S12), and when UP operation is stopped, the controller stops the raising/lowering motor 24 via the drive circuit 32 (S12; Yes, S9). In this way, in the case that before the window glass 14 is into the full closing state, pinching is detected (S10; Yes), or DOWN operation was performed (S11; Yes), or UP operation is stopped (S12; Yes), since reliable, adequate measurement data are not obtained, data update in the storage unit 42 is not performed.

When the UP operation is not stopped (S12, No), the controller checks whether the measurement data (the variable value of capacitance inputted from the capacitance detector 40 and the window opening information inputted from the window position counter 37) have an abnormal value (S13). Here, a case that the measurement data are determined to have an abnormal value includes a case that the measurement data suddenly greatly varies due to vibration during running. If the measurement data have an abnormal value (S13, Yes), the controller sets the update prohibition flag to prohibit data update in the storage unit 42 (S14), and returns processing to S5. If the measurement data do not have an abnormal value, the controller directly returns the processing to S5 (S13, No).

Processing of S10 to S14 is repeatedly performed until the window glass 14 is into the full closing state.

When the window glass 14 is in the full closing state (S5, Yes), the controller checks whether raising operation was started from the full opening state of the window glass 14 based on the window opening information (S6). Here, checking whether raising operation was started from the full opening state of the window glass 14 means checking whether all measurement data from the full opening state to the full closing state are acquired. When the raising operation was started from the full opening state of the window glass 14 (S6, Yes), the controller checks whether data update in the storage unit 42 is allowed based on whether the update prohibition flag is cleared (S7). If data update in the storage unit 42 is allowed (S7, Yes), the control unit updates the capacitance change curve A stored in the storage unit 42 into latest measurement data (capacitance change curve) (S8), and stops the raising/lowering motor 24 via the drive circuit 32 (S9). On the other hand, when the raising operation was not started from the full opening state of the window glass 14 (S6, No), since only part of measurement data were able to be acquired, the controller stops the raising/lowering motor 24 via the drive circuit 32 without performing data update in the storage unit 42 (S9). Moreover, if data update in the storage unit 42 is not allowed (S7, No), that is, when acquired measurement data are determined to have an abnormal value in S13, the controller directly stops the raising/lowering motor 24 via the drive circuit 32 without performing data update in the storage unit 42 (S9).

According to the above update processing (learning processing), when measurement data (capacitance change curve) during raising operation of the window glass 14 from the full opening state to the full closing state are appropriately obtained, the capacitance change curve A stored in the storage unit 42 is updated into the latest measurement data in S8.

Figure 4:
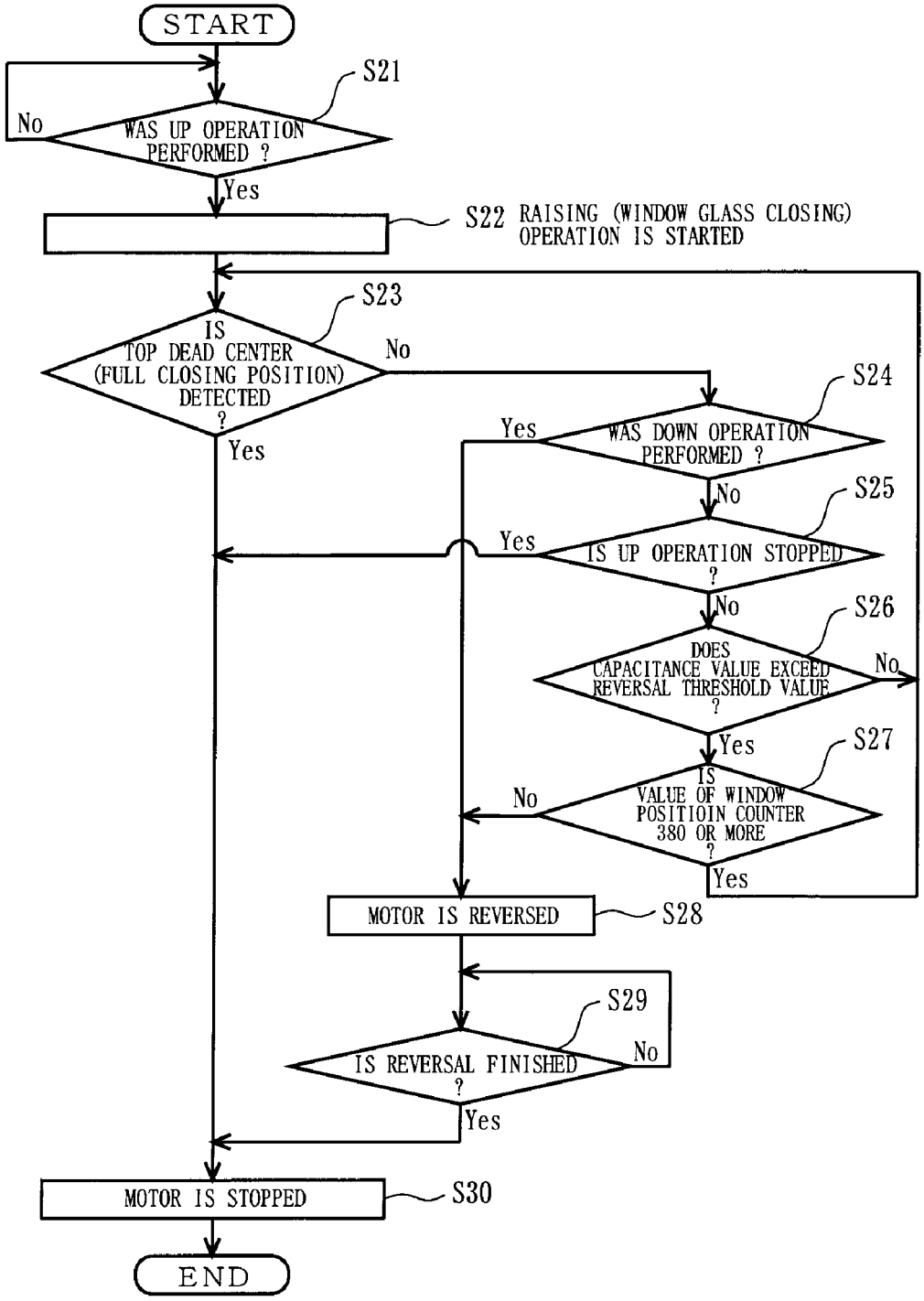
[FIG. 4] It shows a flowchart showing a control example when a window glass reaches a particular position near a top dead center.

A particular position (380 pulse position in the shown example) C near the top dead center on the horizontal axis of FIG. 2 is set as a position at which an upper edge of the window glass 14 contacts the glass-run added to the inside of an upper part of a sash portion 12. After the upper edge of the window glass 14 reaches the particular position C during raising operation, since there is no possibility of pinching of a foreign substance, closing operation of the window glass is preferably performed in disregard of change (increase) in capacitance. While it is detected by another sensor in the past that the upper edge of the window glass 14 reaches the particular position, the embodiment uses the window position information from the window position counter 37 to perform the above control. A flowchart shown in FIG. 4 relates to an embodiment of closing operation processing of the window glass 14, which is executed by the controller 35.

First, the controller 35 checks whether UP operation was performed from a state of the operational switch 34 (S21), and waits until the UP operation is performed (S21; No). When the UP operation is performed (S21; Yes), the controller provides a raising signal to the drive circuit 32 and thus drives the raising/lowering motor 24, so that raising operation (window closing operation) of the window glass 14 is started (S22). When drive of the raising/lowering motor 24 is started, the pulse generator 36 outputs a pulse every time the raising/lowering motor 24 rotates by a certain angle, and the pulse is counted by the window position counter 37, and the counted value (window opening information) is outputted to the controller 35.

Next, the controller 35 detects whether the window glass 14 is in the full closing state (top dead center) based on the window opening information inputted from the window position counter 37 (S23). When the window glass 14 is not in the full closing state (S23; No), the controller checks whether DOWN operation was performed from a state of the operational switch 34 (S24). When the DOWN operation was performed (S24; Yes), the controller reverses the raising/lowering motor 24 via the drive circuit 32 (S28), and waits until the reversal operation is finished and then stops the raising/lowering motor 24 via the drive circuit 32 (S29, S30). When the DOWN operation was not performed (S24; No), the controller checks whether UP operation is stopped similarly from the state of the operational switch 34 (S25). When UP operation is stopped, the controller stops the raising/lowering motor 24 via the drive circuit 32 (S25; Yes, S30).

When the DOWN operation was not performed, and the UP operation is not stopped (S25; No), the controller checks whether the capacitance value inputted from the capacitance detector 40 exceeds a reversal threshold value at a window position corresponding to the window opening information inputted from the window position counter 37 (S26). The reversal threshold value is set based on the capacitance change curve A stored in the storage unit 42. When the capacitance value exceeds the reversal threshold value (S26; Yes), the controller checks whether the upper edge of the window glass 14 reaches the position at which the upper edge contacts the glass-run added to the inside of the upper part of the sash portion 12 based on whether the window opening information from the window position counter 37 is 380 or more (S27). When the window opening information from the window position counter 37 is 380 or more (S27, Yes), since there is no possibility of pinching of a foreign substance, the controller continues rotation of the raising/lowering motor 24, and returns processing to S23. Conversely, when the window opening information from the window position counter 37 is less than 380 (S28), since there is a possibility of pinching of a foreign substance, the controller reverses the raising/lowering motor 24 via the drive circuit 32 (S28), and waits until the reversal operation is finished and then stops the raising/lowering motor 24 via the drive circuit 32 (S29, S30).

Processing of S24 to S27 is repeatedly performed until the window glass 14 is into the full closing state. When the window glass 14 is into the full closing state (S23, Yes), the controller starts the drive circuit 32 to stop the raising/lowering motor 24 (S30).

A device is known in the past as one of pinching detection devices, in which repetitive pulses are generated in accordance with a rotational frequency (angle) of the raising/lowering motor, and pinching is determined through detecting increase in width of the pulses. That is, pulse width in a normal condition is stored, and when pulse width in operation increases to an allowable value or more, pinching of a foreign substance is determined to occur. In the embodiment, the previously known configuration for detecting change in pulse width may be jointly used in order to detect pinching of a foreign substance after the upper edge of the window glass 14 reaches the position at which the upper edge contacts to the glass-run of the sash portion 12.

In the embodiment, the capacitance at an upper edge of the window glass 14 is detected via the electrode 15 provided on the upper edge of the window glass 14 and the capacitance detector 40. However, the electrode can be set with some degree of freedom if capacitance can be detected using the electrode.

In the embodiment, change in capacitance (reversal threshold value) is stored at each pulse of window opening information. However, the capacitance may not necessarily be changed at each pulse. For example, it is acceptable that window opening information is divided into a plurality of blocks in correspondence to the capacitance change curve, and one reversal threshold value is set in one block, and furthermore, values of the whole capacitance change curve are averaged to set a single reversal threshold value.

While the power window in the embodiment is in the X-arm type, the invention can be used for any power window irrespective of a type including wire type, if it is a motor-driven power window. Furthermore, the invention can be used not only for a side door of a vehicle, but also for a back door, a sunroof and the like.

Figure 5:
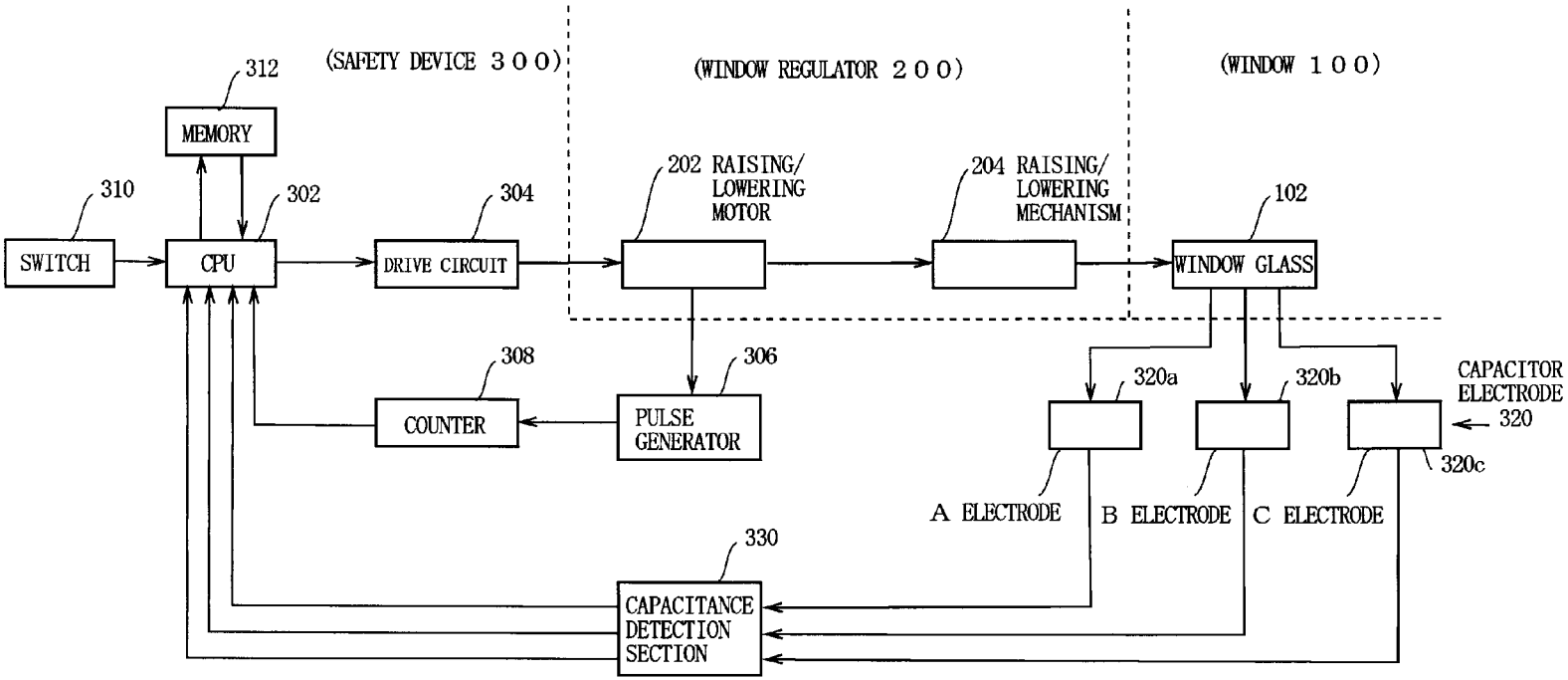
[FIG. 5] It shows a block diagram of a power window having a safety device as an example of the best mode for carrying out the invention.

FIG. 5 shows a block diagram of a power window. As shown in the figure, the power window includes a window 100, window regulator 200, and safety device 300.

The window 100 has a window glass 102. The window regulator 200 has a raising/lowering motor 202 and a raising/lowering mechanism 204, wherein the raising/lowering motor 202 raises or lowers the window glass 102 via the raising/lowering mechanism 204. The safety device 300 controls safety in raising and lowering of the window glass 102 by the window regulator 200.

The safety device 300 is an example of the best mode for carrying out the invention. A configuration of the safety device 300 shows an example of the best mode for carrying out the invention that relates to a safety device for a power window. The safety device 300 has CPU 302. The CPU 302 is a center of the safety device 300, and performs safety control of the window regulator 200 according to a predetermined program.

The CPU 302 controls the raising/lowering motor 202 via a drive circuit 304. The amount of rotation of the raising/lowering motor 202 is fed back to the CPU 302 through a pulse generator 306 and a counter 308. The CPU 302 is inputted with a window glass raising/lowering instruction through a switch 310. The switch 310 is operated by a user. The CPU 302 has a memory 312, and appropriately writes and reads data during executing the program.

The window glass 102 has a capacitor electrode 320. The capacitor electrode 320 is divided into three electrodes of A electrode 320*a*, B electrode 320*b* and C electrode 320*c*. Capacitance of each of the electrodes is individually detected by a capacitance detection section 330, and capacitance detection signals are individually inputted into the CPU 302. A portion including the capacitor electrode 320 together with the capacitance detection section 330 is an example of detection means of the invention.

Figure 6:
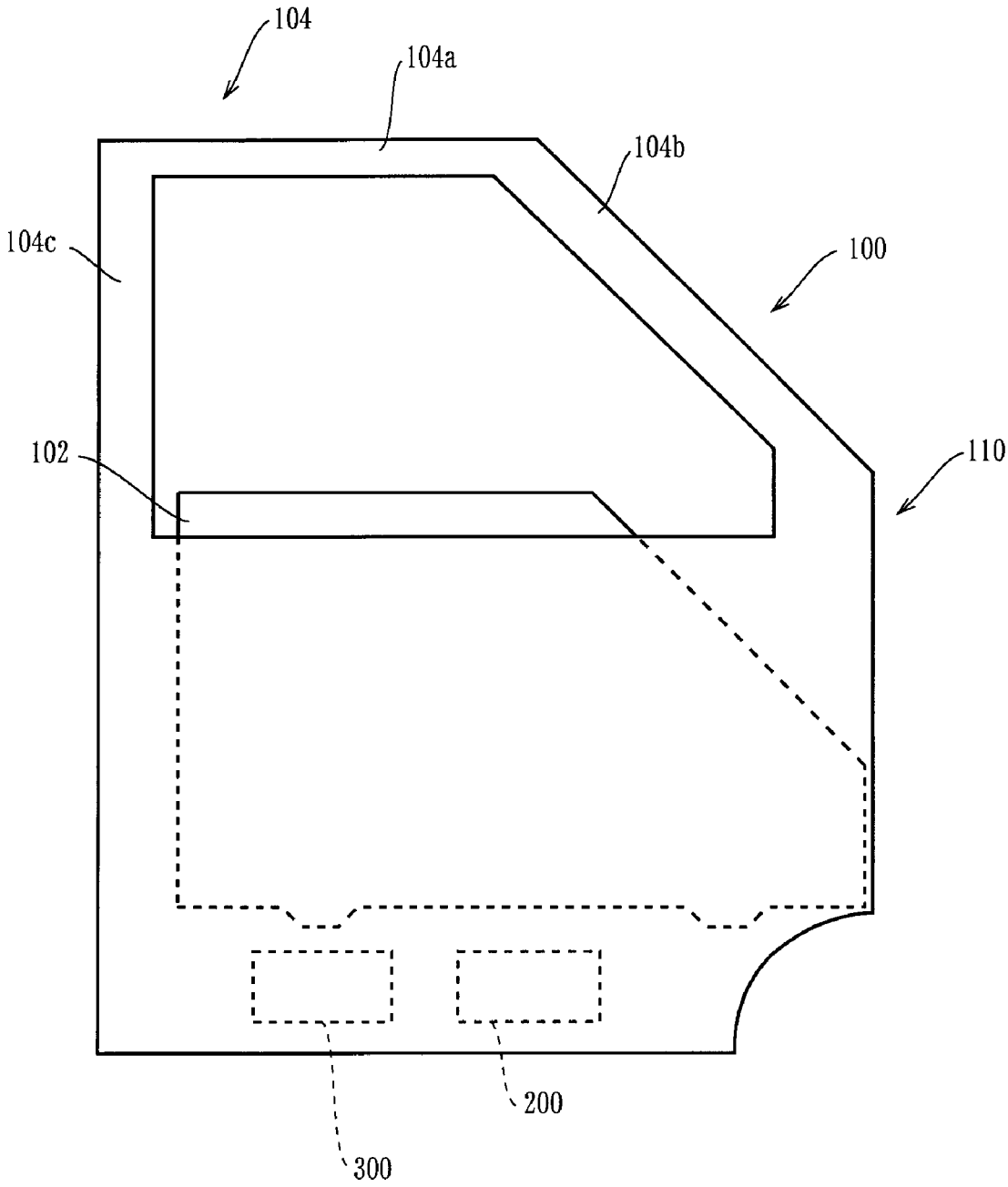
[FIG. 6] It shows a diagram showing a configuration of the power window having the safety device as the example of the best mode for carrying out the invention.

FIG. 6 shows an example of a vehicle door having such a power window. Here, an example of a rear door of a sedan type vehicle is shown. In the door, an upper part of a door body 110 is formed as the window 100. The window 100 has a structure where a window frame 104 is opened and closed by the window glass 102 that is raised or lowered from/into a door body 110 side. The window regulator 200 that raises or lowers the window glass 102 and the safety device 300 thereof are provided within the door body 110.

The window frame 104 has an upper frame 104*a*, a rear frame 104*b*, and a front frame 104*c*. The upper frame 104*a* is set approximately horizontally. The rear frame 104*b* is sloped approximately downward and backward. The front frame 104*c* is set approximately vertically. The capacitor electrodes 320 on the window glass 102 are provided on three sides corresponding to the frames respectively.

Figure 7:
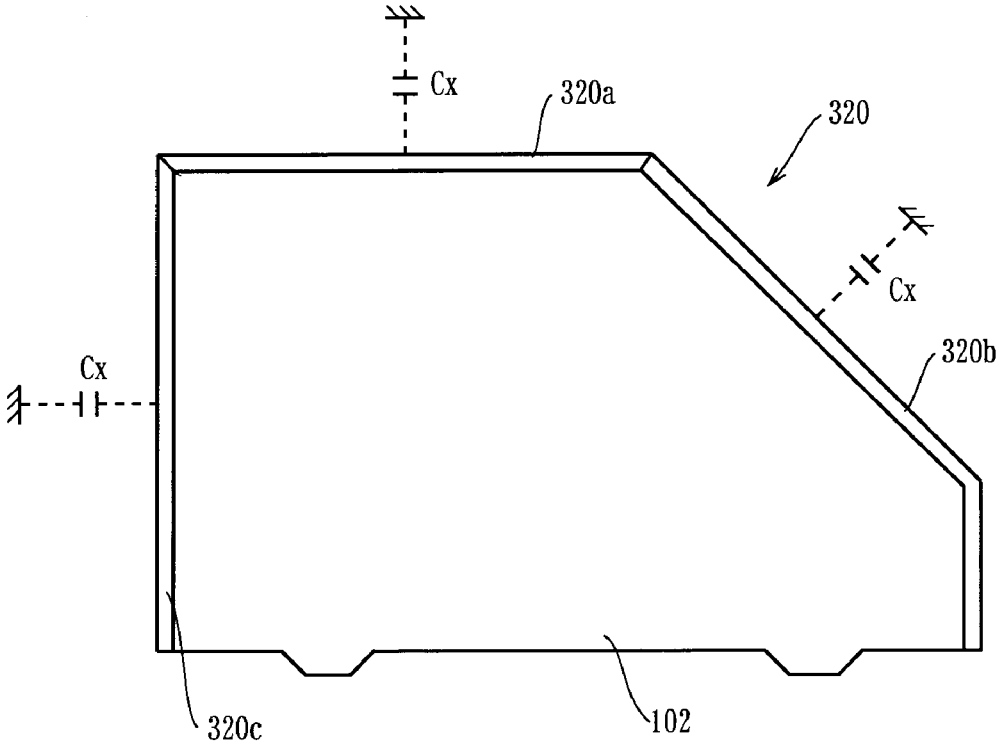
[FIG. 7] It shows a diagram showing a layout of capacitor electrodes on a window glass.

FIG. 7 shows a layout of the capacitor electrodes 320 on the window glass 102. As shown in the figure, the A electrode 320*a*, B electrode 320*b* and C electrode 320*c* are provided on an upper side, a rear side, and a front side of the window glass 102 respectively. While the rear side is partially bent, and strictly, includes two sides, here, the two sides are assumed to be one side together. Each of the electrodes is provided over approximately full length of each side, and the electrodes are isolated from one another. Each electrode is configured using a transparent conductive material or the like.

Each electrode at a window frame side corresponding to each of the electrode may be metal itself configuring the window frame. In such a case, corresponding electrodes need not be separated one by one, but may be connected in one. Alternatively, electrodes may be separately provided correspondingly to the respective electrodes.

Each electrode has capacitance cx with respect to a corresponding window frame. Since the window frame is at ground potential, the capacitance cx corresponds to capacitance to ground. The capacitance to ground increases when the electrode is contacted with a human body such as a hand or finger of a passenger.

Figure 8:
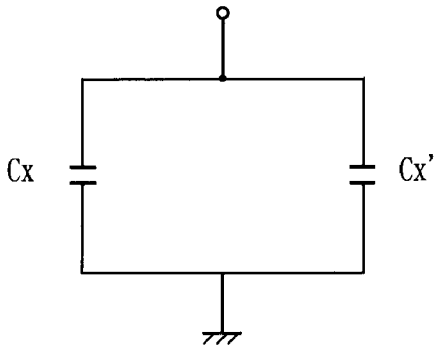
[FIG. 8] It shows an equivalent circuit diagram showing capacitance of the electrode.

As shown by an equivalent circuit of FIG. 8, this is because the capacitance cx of the electrode is connected in parallel with capacitance cx' of the human body. The capacitance cx of the electrode is, for example, about 80 pF, and the capacitance cx' of the human body is, for example, about 400 pF. Therefore, capacitance of the equivalent circuit extremely increases. Such change in capacitance is used for detecting contact of a human body.

Figure 9:
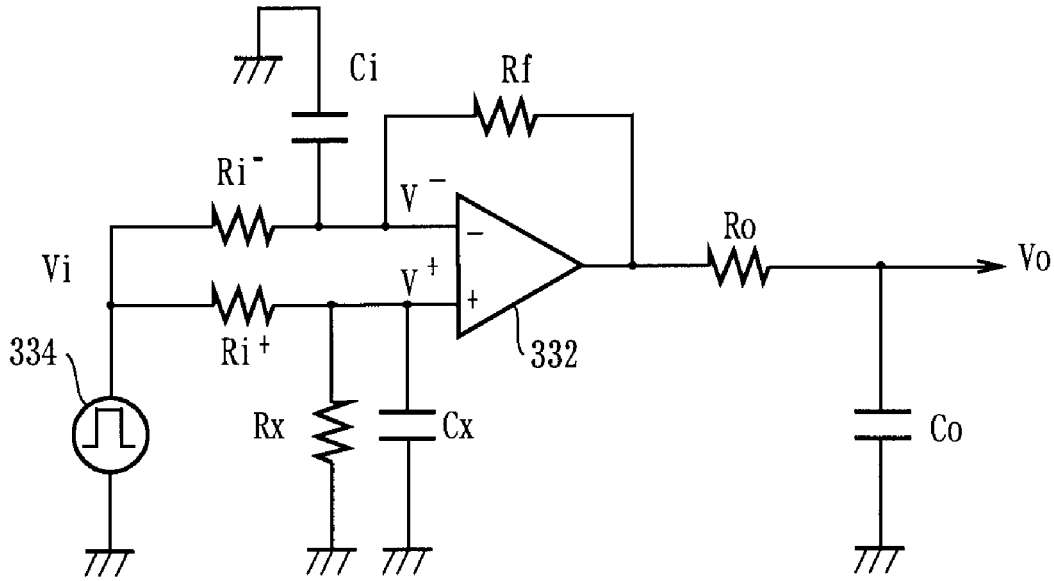
[FIG. 9] It shows a circuit diagram of a major part of a capacitance detection section.

FIG. 9 shows an example of a circuit for detecting change in capacitance. The circuit configures a major part of the capacitance detection section 330. As shown in the figure, the circuit is configured using an OP amplifier 332. The OP amplifier 332 is supplied with a unipolar DC power of, for example, VC=+5V and VE=0V.

In the OP amplifier 332, a capacitor cx and a resistance Rx are connected in parallel between a non-inverting input terminal and ground respectively, a capacitor ci is connected in parallel between an inverting input terminal and ground, and the inverting input terminal is connected to an output terminal through a resistance Rf.

The capacitor cx has the capacitance cx of the capacitor electrode on the window glass. The capacitor ci is a capacitor for compensation, and has capacitance corresponding to capacitance of the capacitor electrode when a human body or the like does not contact the electrode. The resistance Rx and the resistance Rf have the same value.

A voltage Vi from the voltage generator 334 is inputted into the non-inverting input terminal and the inverting input terminal of such an OP amplifier 332 through resistance Ri+ and resistance Ri−, respectively. The resistance Ri+ and resistance Ri− have the same value.

The OP amplifier 332 outputs a voltage given by amplifying a difference between a voltage V+ of the non-inverting input terminal and a voltage V− of the inverting input terminal with an amplification factor of Rf/Ri. The voltage is smoothed by a smoothing circuit including a resistance Ro and a capacitor Co so as to be into an output voltage Vo. The output voltage Vo is inputted into the CPU 302 as a capacitance detection signal. Such a circuit is provided for each of the A electrode 320*a*, B electrode 320*b*, and C electrode 320*c*.

Figure 10:
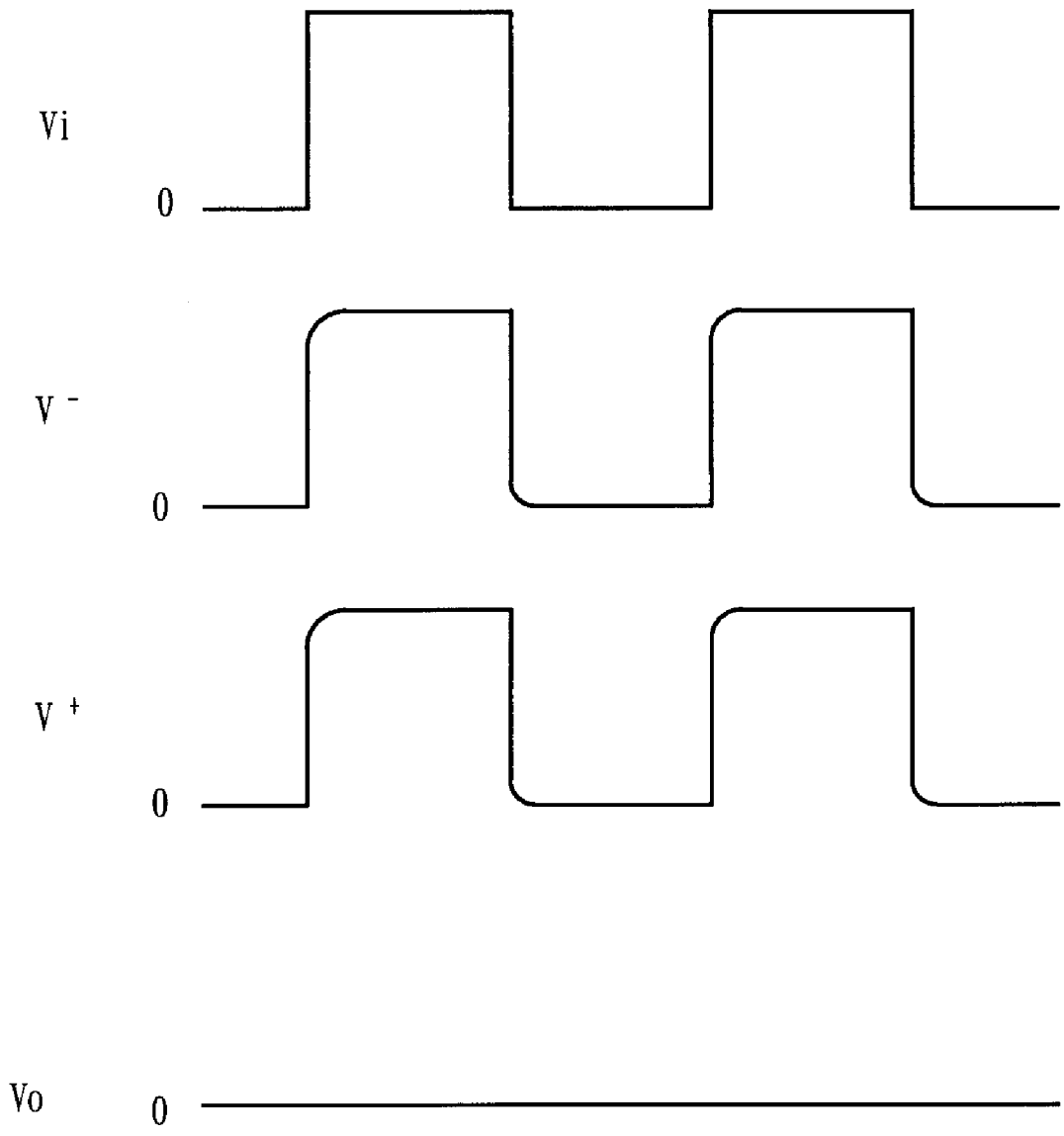
[FIG. 10] It shows a diagram showing voltage waveforms in a circuit of the major part of the capacitance detection section.
Figure 11:
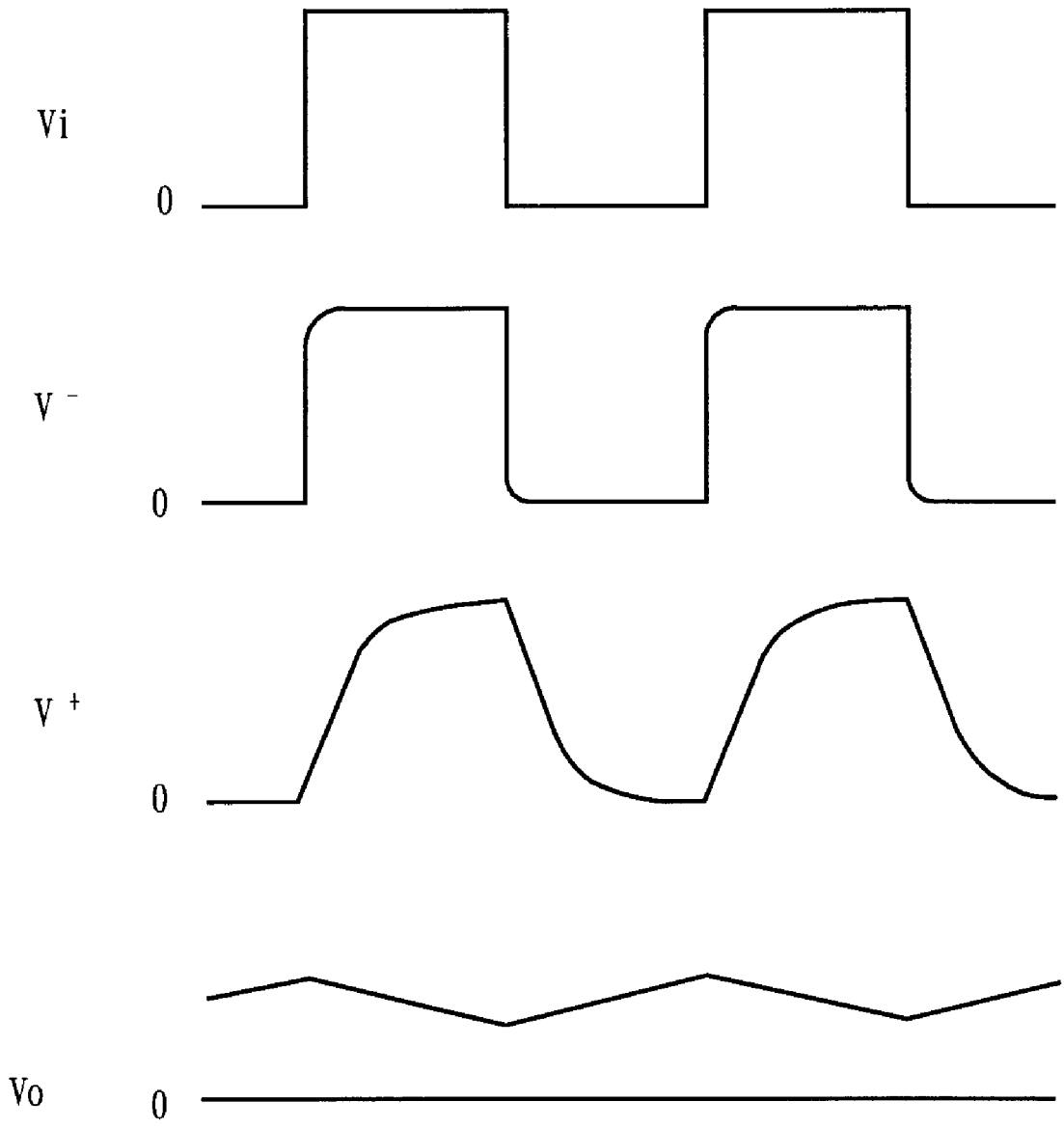
[FIG. 11] It shows a diagram showing voltage waveforms in the circuit of the major part of the capacitance detection section.

FIGS. 10 and 11 show an example of waveforms of the voltages Vi, V−, V+ and Vo respectively. As shown in the figures, the voltage Vi is a voltage of a unipolar, square wave pulse with a fixed cycle. The voltages V− and V+ are voltages for charging the capacitors Ci and Cx by the voltage Vi respectively. The voltage Vo corresponds to a voltage given by smoothing an amplified value of a difference between V+ and V−.

FIG. 10 shows a case that a human body or the like does not contact the capacitor electrode on the window glass, wherein since capacitance is not different between the capacitors Cx and Ci, the voltages V+ and V− are the same in waveform and amplitude, and the voltage Vo obtained by amplifying and smoothing a difference between the voltages is 0 V.

FIG. 11 shows a case that a human body or the like contacts to the capacitor electrode on the window glass, wherein since a waveform or amplitude of the voltage V+ changes with increase in capacitance of the capacitor Cx, the voltage Vo obtained by amplifying and smoothing a difference between V+ and V− is higher than 0 V. The amount of increase in voltage is corresponding to increase in capacitance of the capacitor Cx.

Figure 12:
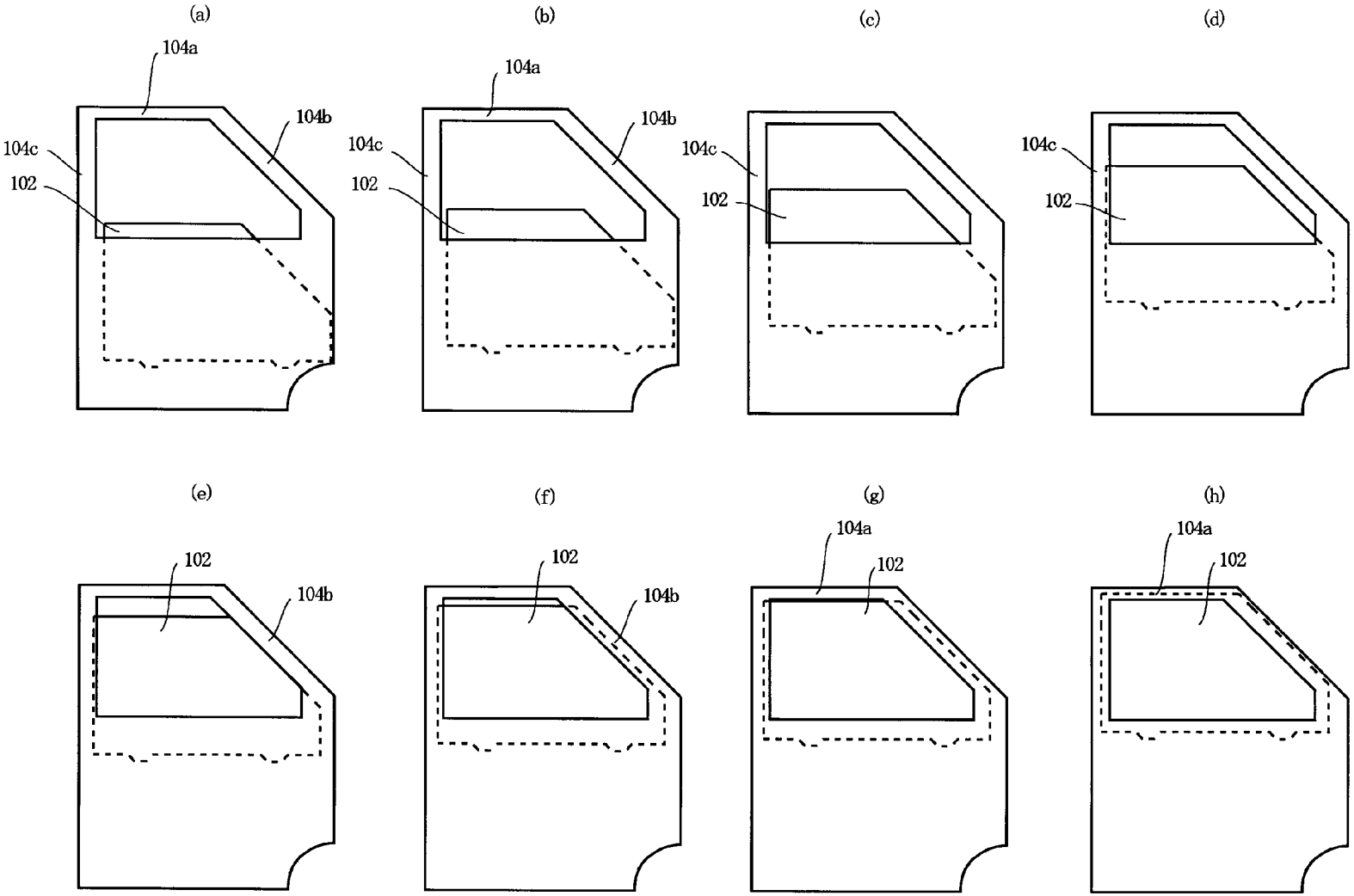
[FIG. 12] It shows diagrams showing raising/lowering conditions of the window glass respectively.

FIG. 12 shows a raising/lowering process of the window glass 102. As shown in the figure, the window glass 102 is raised in order of (a), (b), (c), (d), (e), (f), (g) and (h). The window glass is lowered in reverse order to this. (a) shows a state where the window glass 102 is in the bottom dead center, and (h) shows a state that it is in the top dead center. (b), (c), (d), (e), (f) and (g) show intermediate states respectively.

To further describe the respective states, (a) shows a full opening state of the power window. (b) shows a state where the window glass 102 begins to rise. In this state, all the three sides of the window glass 102 are spaced from the window frame respectively.

(c) shows a state where the front side of the window glass 102 begins to enter the front frame 104*c*, and (d) shows a state where the front side of the window glass 102 completely enters the front frame 104*c*. In this state, the upper side and the rear side of the window glass 102 are spaced from the window frame respectively.

(e) shows a state where the rear side of the window glass 102 begins to enter the rear frame 104*b*, and (f) shows a state where the rear side of the window glass 102 completely enters the rear frame 104*b*. In this state, only the upper side of the window glass 102 is spaced from the window frame.

(g) shows a state where the upper side of the window glass 102 begins to enter the upper frame 104*a*, and (h) shows a state where the upper side of the window glass 102 completely enters the upper frame 104*a*. This corresponds to a full closing state of the power window.

Figure 13:
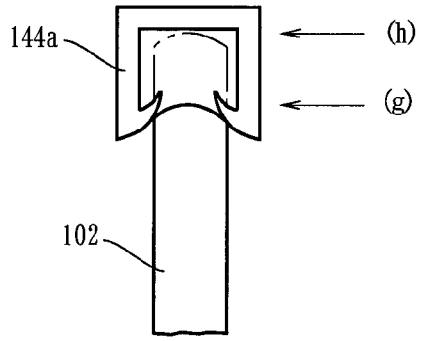
[FIG. 13] It shows a diagram showing a relationship between the window glass and a glass run.

To show the states of (g) and (h) in more detailed manner, for example, as shown in FIG. 13, in the state of (g), the upper side of the window glass 102 contacts a glass run 144*a* of the upper frame 104*a*, and in the state of (h), the upper side of the window glass 102 completely enters the glass run 144*a* of the upper frame 104*a*. The glass run 144*a* is configured by an insulating material such as rubber or plastic. The front frame 104*c* and the rear frame 104*b* have glass runs respectively, and (c) and (e) show states where the front side and the rear side contact the relevant glass runs respectively.

Figure 14:
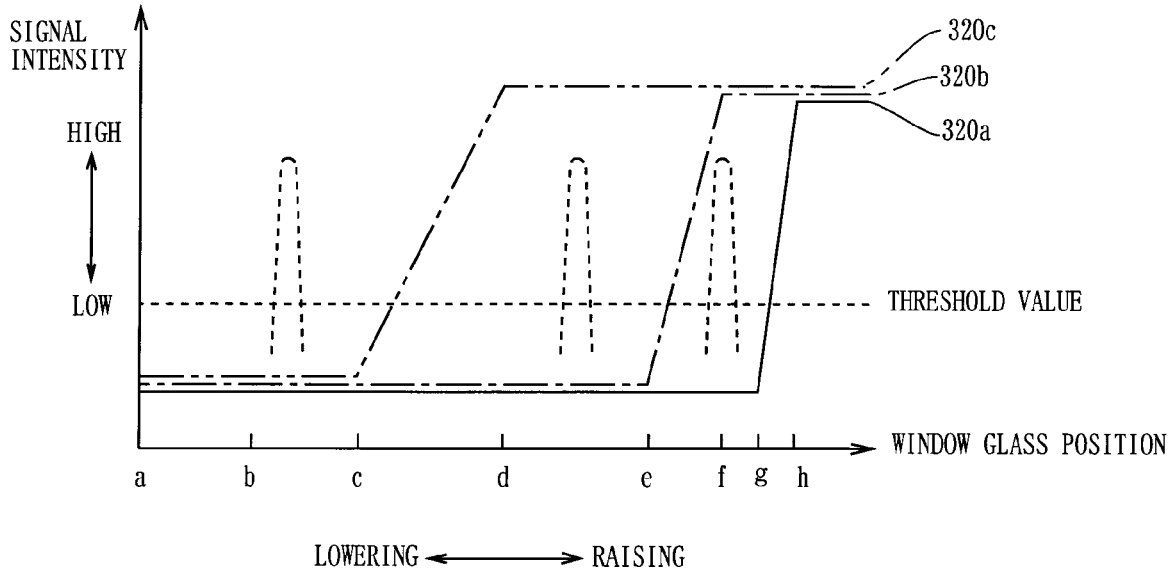
[FIG. 14] It shows a diagram showing a relationship between a window glass position and a capacitance detection signal.

FIG. 14 shows change in capacitance detection signal along with raising and lowering of the window glass 102. The figure shows a graph with a window glass position as a horizontal axis and signal intensity of a capacitance detection signal as a vertical axis. Signs a to h marked at various points on the horizontal axis correspond to the window glass positions (a) to (h) shown in FIG. 12 respectively. Hereinafter, the window glass may be called glass, and the window glass position may be called glass position.

The capacitance detection signal includes three signals corresponding to the three electrodes. Hereinafter, the capacitance detection signal may be called detection signal. A solid line graph shows a detection signal for the A electrode 320*a*, a chain line graph shows a detection signal for the B electrode 320*b*, and a two-dot chain line graph shows a detection signal for the C electrode 320*c*. The graphs are moved parallel to one another in a vertical axis direction to facilitate viewing of overlapped regions.

The detection signal for the C electrode 320*c* is small in signal intensity and slightly changes in a range from the position a to the position c. This is because a sufficient space exists between the C electrode 320*c* and the front frame 104*c*. The signal is abruptly increased in signal intensity in a range from the position c to the position d. This is because the C electrode 320*c* enters the front frame 104*c*. The signal is large in signal intensity and slightly changes in a range from the position d to the position h. This is because the C electrode 320*c* has completely entered the front frame 104*c*.

The detection signal for the B electrode 320*b* is small in signal intensity and slightly changes in a range from the position a to the position e. This is because a sufficient space exists between the B electrode 320*b* and the rear frame 104*b*. The signal is abruptly increased in signal intensity in a range from the position e to the position f. This is because the B electrode 320*b* enters the rear frame 104*b*. The signal is large in signal intensity and slightly changes in a range from the position f to the position h. This is because the B electrode 320*b* has completely entered the rear frame 104*b*.

The detection signal for the A electrode 320*a* is small in signal intensity and slightly changes in a range from the position a to the position g. This is because a sufficient space exists between the A electrode 320*a* and the upper frame 104*a*. The signal is abruptly increased in signal intensity in a range from the position g to the position h. This is because the A electrode 320*a* enters the upper frame 104*a*. The signal is large in signal intensity and slightly changes at a position higher than position h. This is because the A electrode 320*a* has completely entered the upper frame 104*a*.

Such a relationship between the glass position and the detection signal intensity is measured beforehand and stored in the memory 312. It is desirable that such measurement is performed at an appropriate frequency during service of a vehicle, so that the latest relationship is stored in the memory 312 at any time.

For such a detection signal, a threshold value is set for determining presence of contact of a human body or pinching. As the threshold value, for example, a value is set as shown by a broken line, which is larger than a value of detection signal intensity when any part of the window glass 102 does not enter the window frame, and smaller than a value of detection signal intensity when even a part of the window glass 102 has completely entered the window frame, and enables secure identification of increase in detection signal due to contact of a human body or the like. As the threshold value, an appropriate value may be individually set for each of the three detection signals.

The threshold value is also stored in the memory 312. If the threshold value is updated according to the latest measurement value on the relationship between the glass position and the detection signal intensity, an appropriate threshold value can be continuously set irrespective of change in relationship between the glass position and the detection signal intensity.

Figure 15:
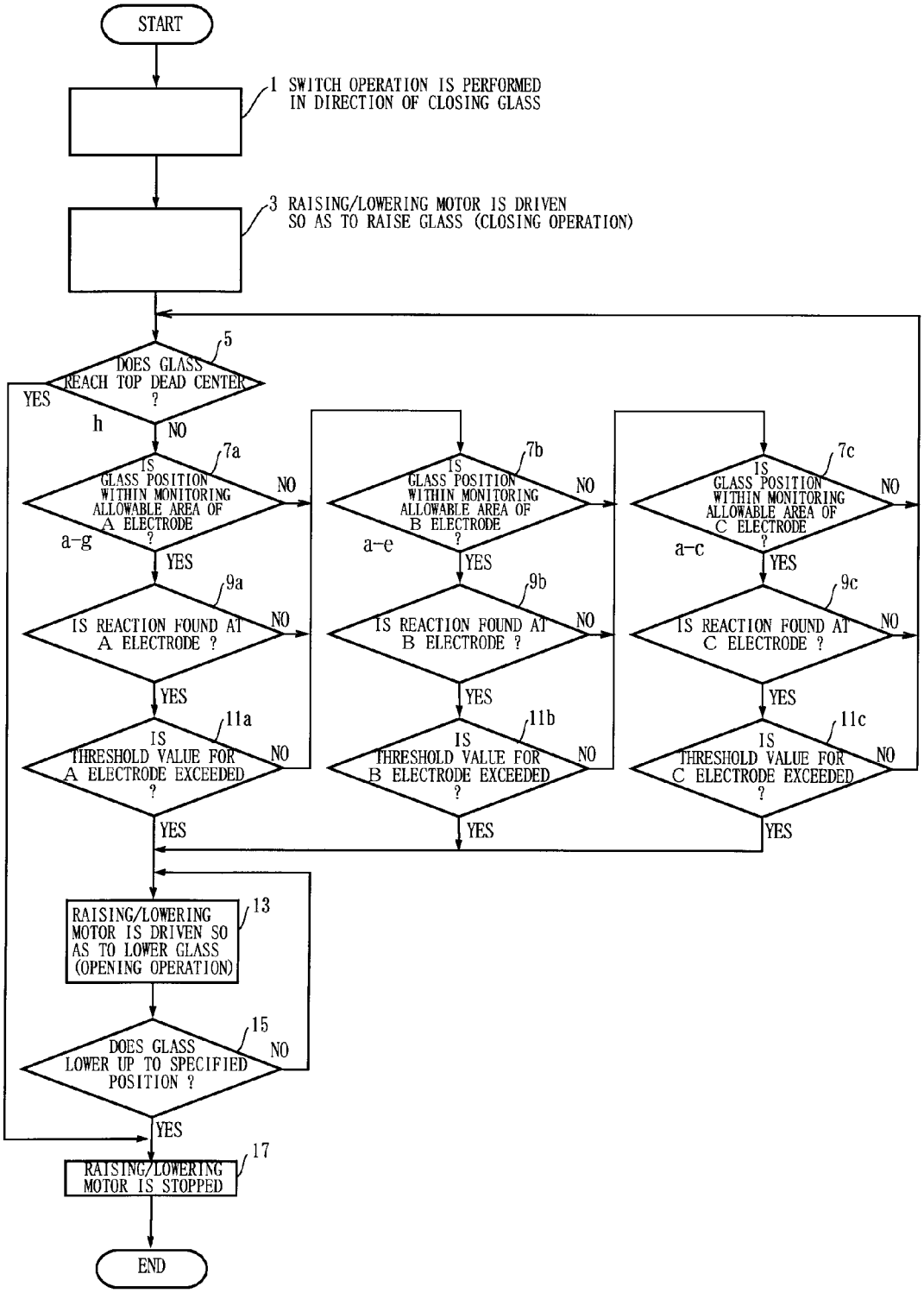
[FIG. 15] It shows a flowchart of operation of the safety device as the example of the best mode for carrying out the invention.

FIG. 15 shows a flowchart of operation of the safety device 300. Hereinafter, operation of the safety device 300 is described along the flowchart. As shown in the figure, a switch is operated in a direction of closing the glass in step 1. That is, a user operates the switch 310 in the direction of closing the glass.

Thus, the CPU 302 is inputted with an instruction of closing the window glass 102, and then the CPU 302 starts raising/lowering control of the window glass 102. That is, the CPU drives the raising/lowering motor so as to raise the glass in step 3. Thus, the window glass 102 starts to be raised (closing operation). The CPU 302 recognizes a position of the window glass 102 being raised by a counted value by the counter 308.

In step 5, the CPU determines whether the glass reaches a top dead center. The top dead center corresponds to the position h shown in FIG. 12 or FIG. 14. When the CPU determines YES, since the window is into the full closing state, the CPU stops the raising/lowering motor in step 17.

When the CPU determines NO, the CPU determines whether a glass position is within a monitoring allowable area of the A electrode, in step 7*a*. The monitoring allowable area of the A electrode corresponds to a range of the glass positions a to g. When the CPU determines YES, the CPU determines whether a reaction is found at the A electrode in step 9*a*. Whether the reaction exists is determined based on whether a detection signal is provided from the A electrode. When the CPU determines YES, the CPU determines whether a value of the detection signal exceeds the threshold value for the A electrode in step 11*a*. When the detection signal value increases to more than the threshold value in the range of the glass positions a to g as shown by a broken line in FIG. 14, the CPU determines YES, and when such increase is not found in the range, the CPU determines NO.

When the CPU determines NO in one of the steps 7*a*, 9*a* and 11*a*, it determines whether the glass position is within a monitoring allowable area of the B electrode in step 7*b*. The monitoring allowable area of the B electrode corresponds to a range of the glass positions a to e. When the CPU determines YES, the CPU determines whether a reaction is found at the B electrode in step 9*b*. Whether the reaction exists is determined based on whether a detection signal is provided from the B electrode. When the CPU determines YES, the CPU determines whether a value of the detection signal exceeds the threshold value for the B electrode in step 11*b*. When the detection signal value increases to more than the threshold value in the range of the glass positions a to e as shown by a broken line in FIG. 14, the CPU determines YES, and when such increase is not found in the range, the CPU determines NO.

When the CPU determines NO in one of the steps 7*b*, 9*b* and 11*b*, it determines whether the glass position is within a monitoring allowable area of the C electrode in step 7*c*. The monitoring allowable area of the C electrode corresponds to a range of the glass positions a to c. When the CPU determines YES, the CPU determines whether a reaction is found at the C electrode in step 9*c*. Whether the reaction exists is determined based on whether a detection signal is provided from the C electrode. When the CPU determines YES, the CPU determines whether a value of the detection signal exceeds the threshold value for the C electrode in step 11*c*. When the detection signal value increases to more than the threshold value in the range of the glass positions a to c as shown by a broken line in FIG. 14, the CPU determines YES, and when such increase is not found in the range, the CPU determines NO.

When the CPU determines YES in one of the steps 11*a*, 11*b* and 11*c*, it drives the raising/lowering motor so as to lower the glass in step 13. Thus, the window glass 102 starts to be lowered (opening operation). The CPU 302 recognizes a position of the window glass 102 being lowered based on a counted value by the counter 308. In step 15, the CPU determines whether the glass is lowered up to a specified position. When the CPU determines NO, the CPU continues lowering a glass by the raising/lowering motor in step 13 until the CPU determines YES. When the CPU determines YES, it stops the raising/lowering motor in step 17.

The CPU 302, which performs determination in steps 7*a*, 9*a*, 11*a*, 7*b*, 9*b*, 11*b*, 7*c*, 9*c* and 11*c*, is an example of the determination means of the invention. The CPU 302 that performs operations in steps 13, 15 and 17 is an example of the control means of the invention.

In this way, since the detection signal from each electrode is individually compared with the threshold value, contact of a human body or pinching can be sensitively detected through all stages of raising and lowering the window glass, and consequently danger can be avoided. Particularly, even in a stage that only the upper frame is spaced from the window frame, detection sensitivity of contact of a human body or pinching is still excellent, therefore safety of the power window is remarkably improved.

Figure 16:
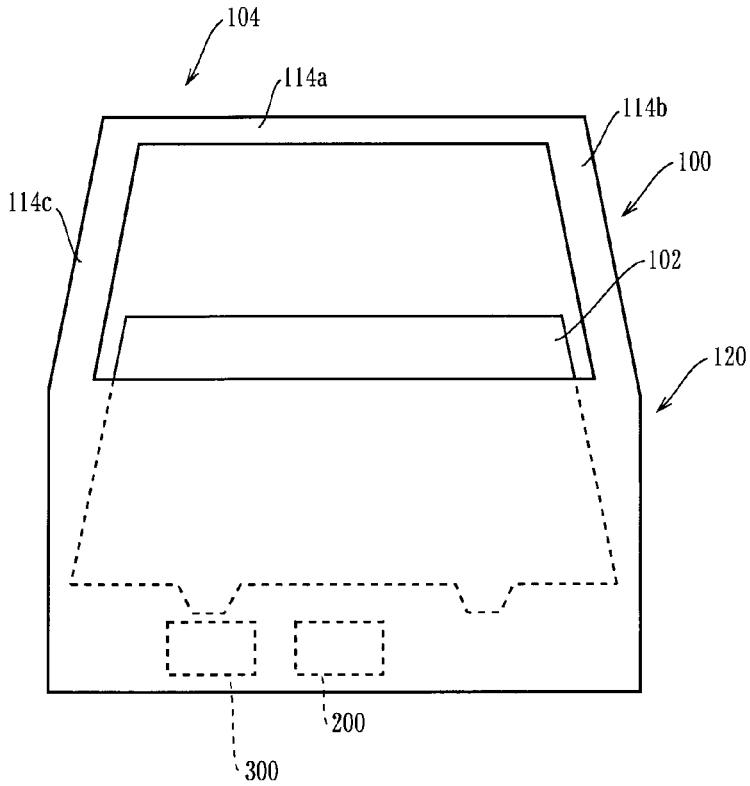
[FIG. 16] It shows a diagram showing a configuration of a power window having a safety device as an example of the best mode for carrying out the invention.

FIG. 16 shows another example of a vehicle door having a power window. Here, an example of a rear door of a wagon type vehicle is shown. In the door, an upper part of a door body 120 is formed as the window 100. The window 100 has a structure where the window frame 104 is opened or closed by the window glass 102 that is raised or lowered from/into a door body 120 side. The window regulator 200 that raises or lowers the window glass 102 and the safety device 300 thereof are provided within the door body 120.

The window frame 104 has an upper frame 114*a*, a right frame 114*b*, and a left frame 114*c*. The upper frame 114*a* is set approximately horizontally. The right frame 114*b* is sloped diagonally down right. The left frame 114*c* is sloped diagonally down left. The capacitor electrodes 320 on the window glass 102 are provided on three sides corresponding to the frames respectively.

Figure 17:
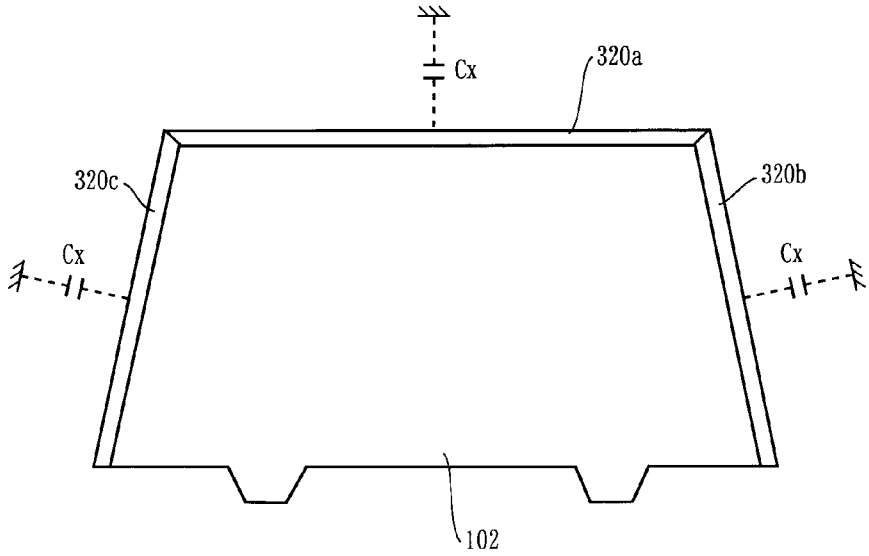
[FIG. 17] It shows a diagram showing a layout of capacitor electrodes on a window glass.

FIG. 17 shows a layout of the capacitor electrodes 320 on the window glass 102. As shown in the figure, the A electrode 320*a*, B electrode 320*b* and C electrode 320*c* are provided on an upper side, a right side, and a left side of the window glass respectively. Each of the electrodes is provided over approximately full length of each side, and the electrodes are isolated from one another. Each electrode is configured using a transparent conductive material or the like.

Each electrode has capacitance cx with respect to a corresponding window frame. Since the window frame is at ground potential, the capacitance cx corresponds to capacitance to ground. The capacitance to ground increases when the electrode is contacted with a human body such as a hand or finger of a passenger.

Figure 18:
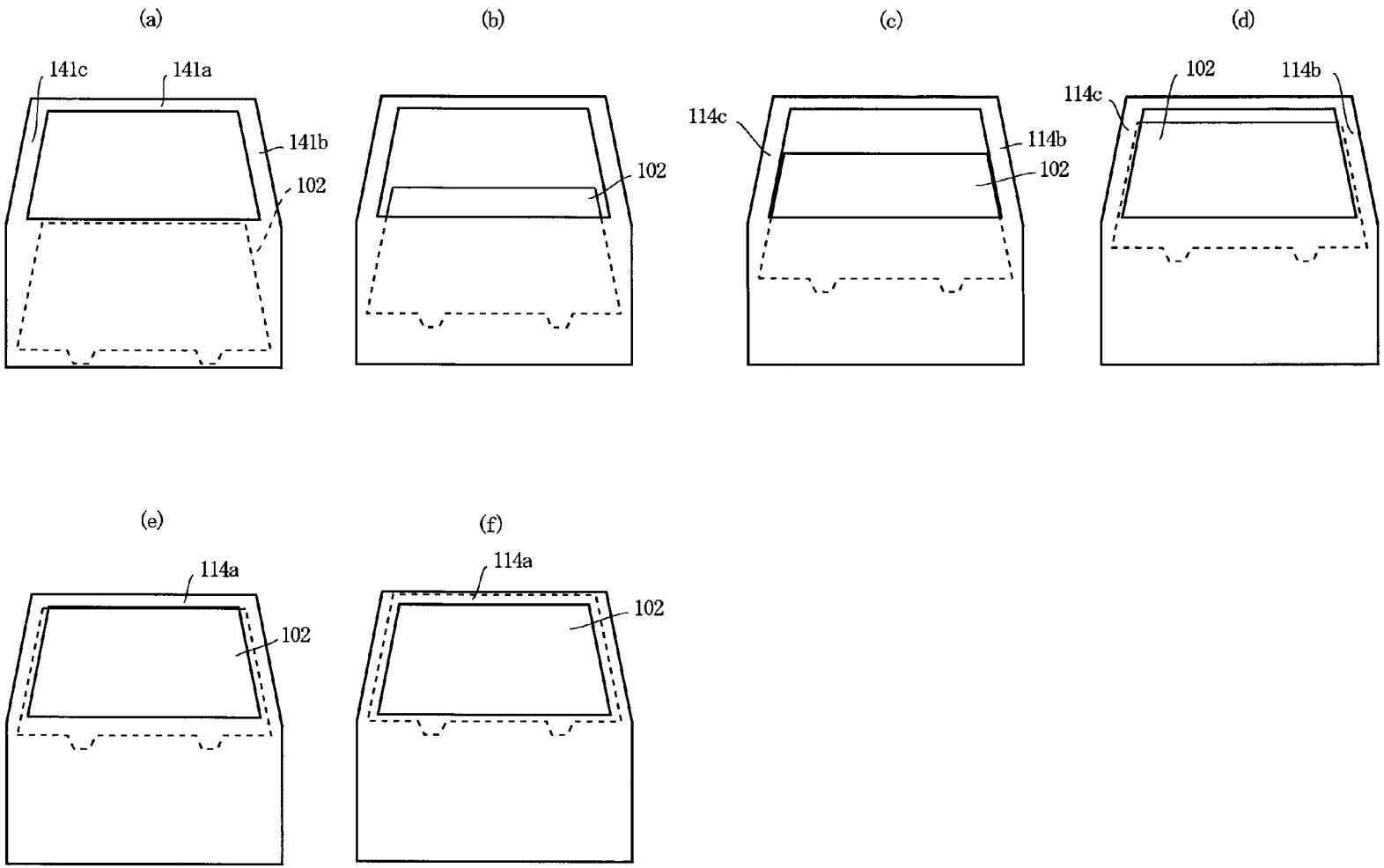
[FIG. 18] It shows diagrams showing raising/lowering conditions of the window glass respectively.

FIG. 18 shows a raising/lowering process of the window glass 102. As shown in the figure, the window glass 102 is raised in order of (a), (b), (c), (d), (e) and (f). The window glass is lowered in reverse order to this. (a) shows a state where the window glass 102 is in the bottom dead center, and (f) shows a state that it is in the top dead center. (b), (c), (d) and (e) show intermediate states respectively.

To further describe the respective states, (a) shows a full opening state of the power window. (b) shows a state where the window glass 102 begins to rise. In this state, all the three sides of the window glass 102 are spaced from the window frame respectively.

(c) shows a state where the right and left sides of the window glass 102 begin to enter the right and left frames 114*b* and 114*c* respectively. (d) shows a state where the right and left sides of the window glass 102 completely enter the right and left frames 114*b* and 114*c* respectively. In this state, only the upper side of the window glass 102 is spaced from the window frame.

(e) shows a state where the upper side of the window glass 102 begins to enter the upper frame 114*a*. (f) shows a state where the upper side of the window glass 102 completely enters the upper frame 114*a*. This shows the full closing state of the power window.

Figure 19:
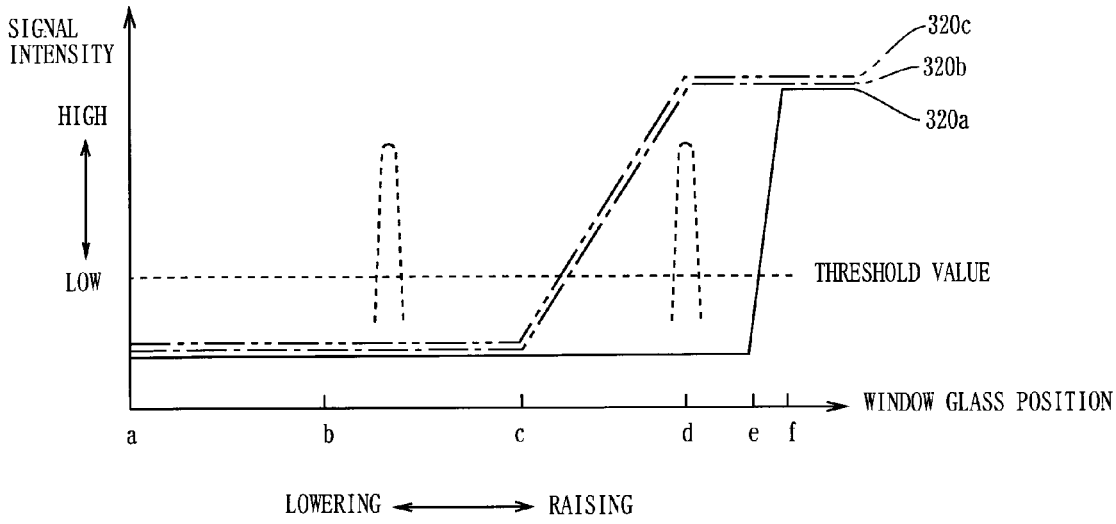
[FIG. 19] It shows a diagram showing a relationship between a window glass position and a capacitance detection signal.

FIG. 19 shows change in capacitance detection signal along with raising and lowering of the window glass 102. The figure shows a graph with a window glass position as a horizontal axis and signal intensity of a capacitance detection signal as a vertical axis. Signs a to f marked at various points on the horizontal axis correspond to the window glass positions (a) to (f) shown in FIG. 18 respectively.

The detection signals for the B electrode 320*b* and the C electrode 320*c* are small in signal intensity and slightly change in a range from the position a to the position c respectively. This is because a sufficient space exists between the B electrode 320*b* or the C electrode 320*c* and the right or left frame 114*b* or 114*c* respectively. The signal is abruptly increased in signal intensity in a range from the position c to the position d. This is because the B electrode 320*b* and the C electrode 320*c* enter the right and left frames 114*b* and 114*c* respectively. The signal is large in signal intensity and slightly changes in a range from the position d to the position h. This is because the B electrode 320*b* and the C electrode 320*c* have completely entered the right and left frames 114*b* and 114*c* respectively.

The detection signal for the A electrode 320*a* is small in signal intensity and slightly changes in a range from the position a to the position e. This is because a sufficient space exists between the A electrode 320*a* and the upper frame 114*a*. The signal is abruptly increased in signal intensity in a range from the position e to the position f. This is because the A electrode 320*a* enters the upper frame 114*a*. The signal is large in signal intensity and slightly changes at a position higher than the position f. This is because the A electrode 320*a* has completely entered the upper frame 114*a*.

Such a relationship between the glass position and the detection signal intensity is measured beforehand and stored in the memory 312. It is desirable that the measurement is performed at an appropriate frequency, so that the latest relationship is stored in the memory 312 at any time.

For such a detection signal, a threshold value is set for determining presence of contact of a human body or pinching. As the threshold value, for example, a value is set as shown by a broken line, which is larger than a value of detection signal intensity when any part of the window glass 102 does not enter the window frame, and smaller than a value of detection signal intensity when even a part of the window glass 102 has completely entered the window frame, and enables secure identification of increase in detection signal due to contact of a human body or the like. As the threshold value, an appropriate value may be individually set for each of the three detection signals.

The threshold value is also stored in the memory 312. If the threshold value is also updated according to the latest relationship between the glass position and the detection signal intensity, an appropriate threshold value can be continuously set irrespective of change in relationship between the glass position and the detection signal intensity.

Such a detection signal is determined based on the threshold value according to the flowchart of FIG. 15, thereby contact of a human body or pinching can be sensitively detected through all stages of raising and lowering of the window glass, and consequently danger can be avoided. Particularly, even in a stage that only the upper frame is spaced from the window frame as shown in (c) and (d) of FIG. 18, detection sensitivity of contact of a human body or pinching is still excellent, therefore safety of the power window is remarkably improved.

Figure 20:
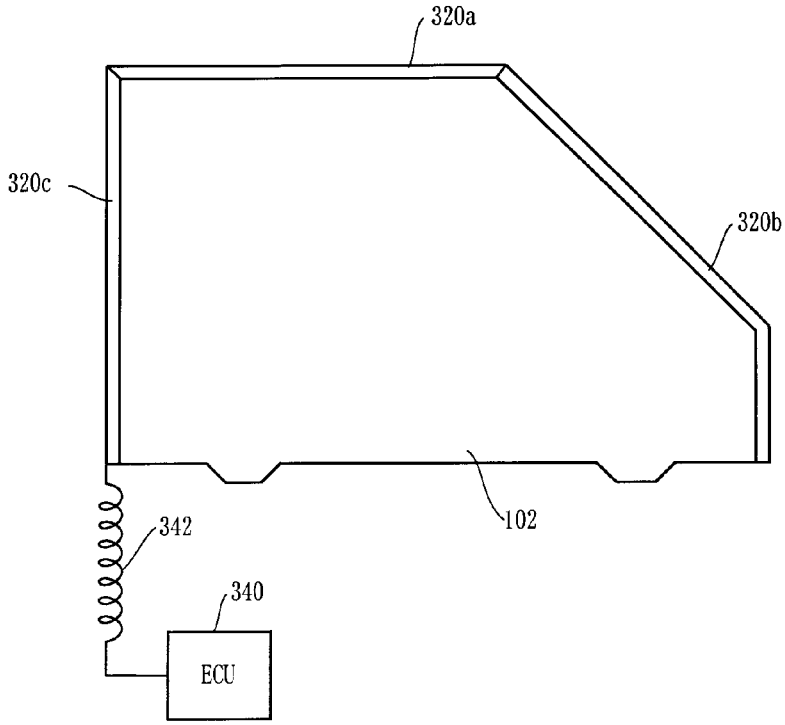
[FIG. 20] It shows a diagram showing a connection condition between the electrode and ECU.

FIG. 20 shows a connection condition between the electrode on the window glass and ECU (Electronic Control Unit). The ECU means an electric unit of the power window, and corresponds to the CPU 302 in FIG. 5 and peripheral electric circuits of the CPU.

As shown in the figure, the electrodes 320*a*, 320*b* and 320*c* are connected to ECU 340 by a spiral cord 342. The spiral cord 342 has three series of signal lines, and the electrodes 320*a*, 320*b* and 320*c* are connected to the ECU by the signal lines respectively.

The spiral cord 342 has an elastic coating being spirally formed, and may expand and contract like a coil spring. Thus, since the spiral cord 342 expands and contracts along with raising and lowering of the window glass 102, each signal line behaves orderly during raising and lowering of the window glass.

Figure 21:
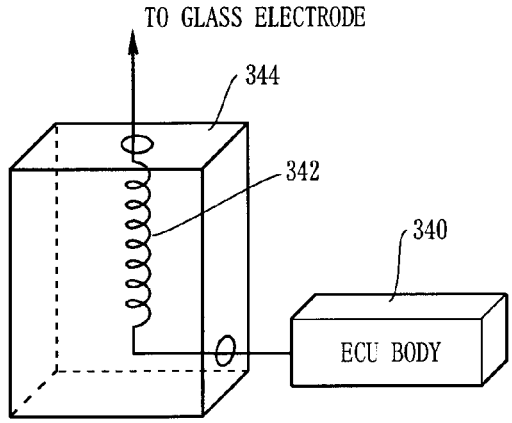
[FIG. 21] It shows a diagram showing an accommodation condition of a spiral cord.
Figure 22:
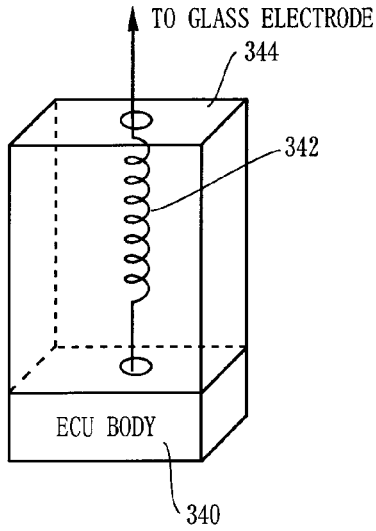
[FIG. 22] It shows a diagram showing an accommodation condition of the spiral cord and the ECU.

A spiral portion of the spiral cord 342 is preferably accommodated in a cord box 344 in the most contracted condition, for example, as shown in FIG. 21 in the light of effectively limiting behavior of the cord. The cord box 344 may accommodate an ECU body 340, for example, as shown in FIG. 22.

Hereinbefore, the safety device for a power window of a vehicle door was described. However, the safety device of the invention can be applied not only to the vehicle door but also to all power windows that may raise and lower the window glass by power.

Figure 23:
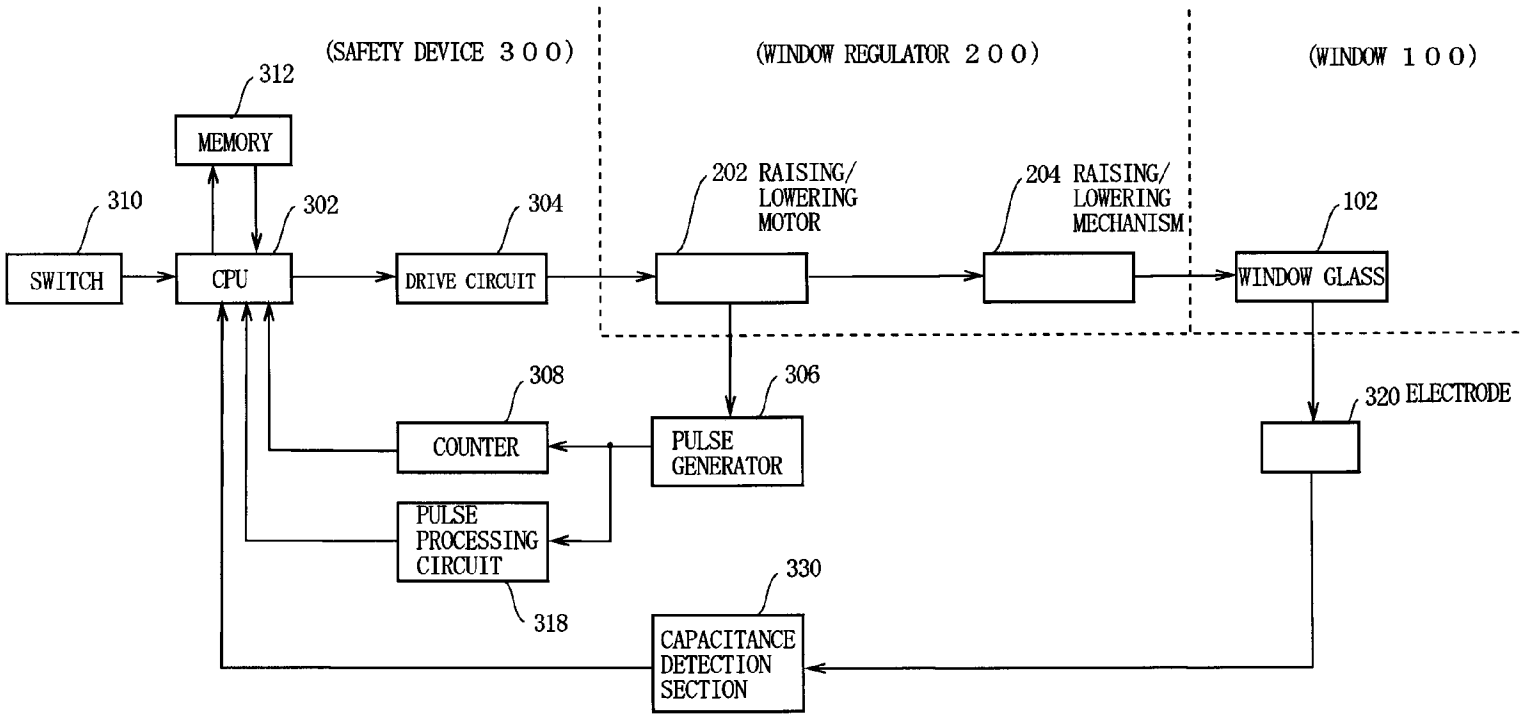
[FIG. 23] It shows a block diagram of a power window having a safety device as an example of the best mode for carrying out the invention.

FIG. 23 shows a block diagram of a power window. As shown in the figure, the power window includes a window 100, window regulator 200, and safety device 300.

The window 100 has a window glass 102. The window regulator 200 has a raising/lowering motor 202 and a raising/lowering mechanism 204, wherein the raising/lowering motor 202 raises or lowers the window glass 102 via the raising/lowering mechanism 204.

The safety device 300 controls safety in raising and lowering of the window glass 102 by the window regulator 200. The safety device 300 is an example of the best mode for carrying out the invention. A configuration of the device shows an example of the best mode for carrying out the invention that relates to a safety device for a power window.

The safety device 300 has CPU 302. The CPU 302 is a center of the safety device 300, and performs safety control of the window regulator 200 according to a predetermined program. The CPU 302 controls the raising/lowering motor 202 via a drive circuit 304. The amount of rotation of the raising/lowering motor 202 is fed back to the CPU 302 through a pulse generator 306 and a counter 308. The CPU 302 recognizes a window glass position based on a counted value by the counter 308.

An output pulse from the pulse generator 306 is processed by a pulse processing circuit 318, and a result of the processing is inputted into the CPU 302. The pulse processing circuit 318 processes the pulse in a manner of detecting pulse width or a pulse period.

The CPU 302 is inputted with a window glass raising/lowering instruction through a switch 310. The switch 310 is operated by a user. The CPU 302 has a memory 312, and appropriately writes and reads data during executing the program.

The window glass 102 has an electrode 320. Capacitance of the electrode 320 is detected by a capacitance detection section 330, and a capacitance detection signal is inputted into the CPU 302.

Figure 24:
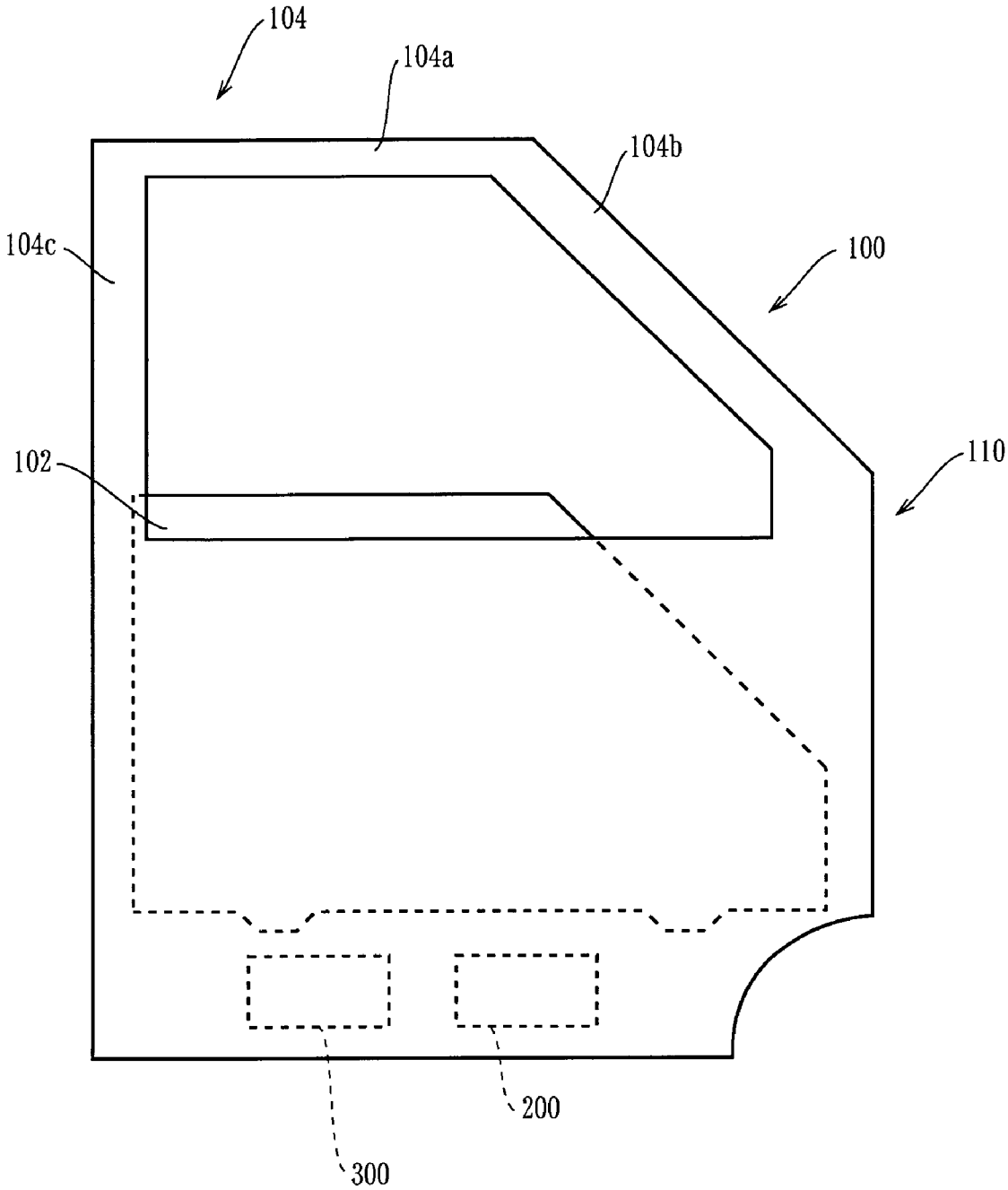
[FIG. 24] It shows a diagram showing a configuration of the power window having the safety device as the example of the best mode for carrying out the invention.

FIG. 24 shows an example of a vehicle door having such a power window. Here, an example of a rear door of a sedan type vehicle is shown. In the door, an upper part of a door body 110 is formed as the window 100. The window 100 has a structure where a window frame 104 is opened or closed by the window glass 102 that is raised or lowered from/into a door body 110 side. The window regulator 200 that raises or lowers the window glass 102 and the safety device 300 thereof are provided within the door body 110.

The window frame 104 has an upper frame 104*a*, a rear frame 104*b*, and a front frame 104*c*. The upper frame 104*a* is set approximately horizontally. The rear frame 104*b* is sloped approximately downward and backward. The front frame 104*c* is set approximately vertically. The electrode 320 on the window glass 102 is provided over two sides corresponding to the upper frame 104*a* and the rear frame 104*b*.

Figure 25:
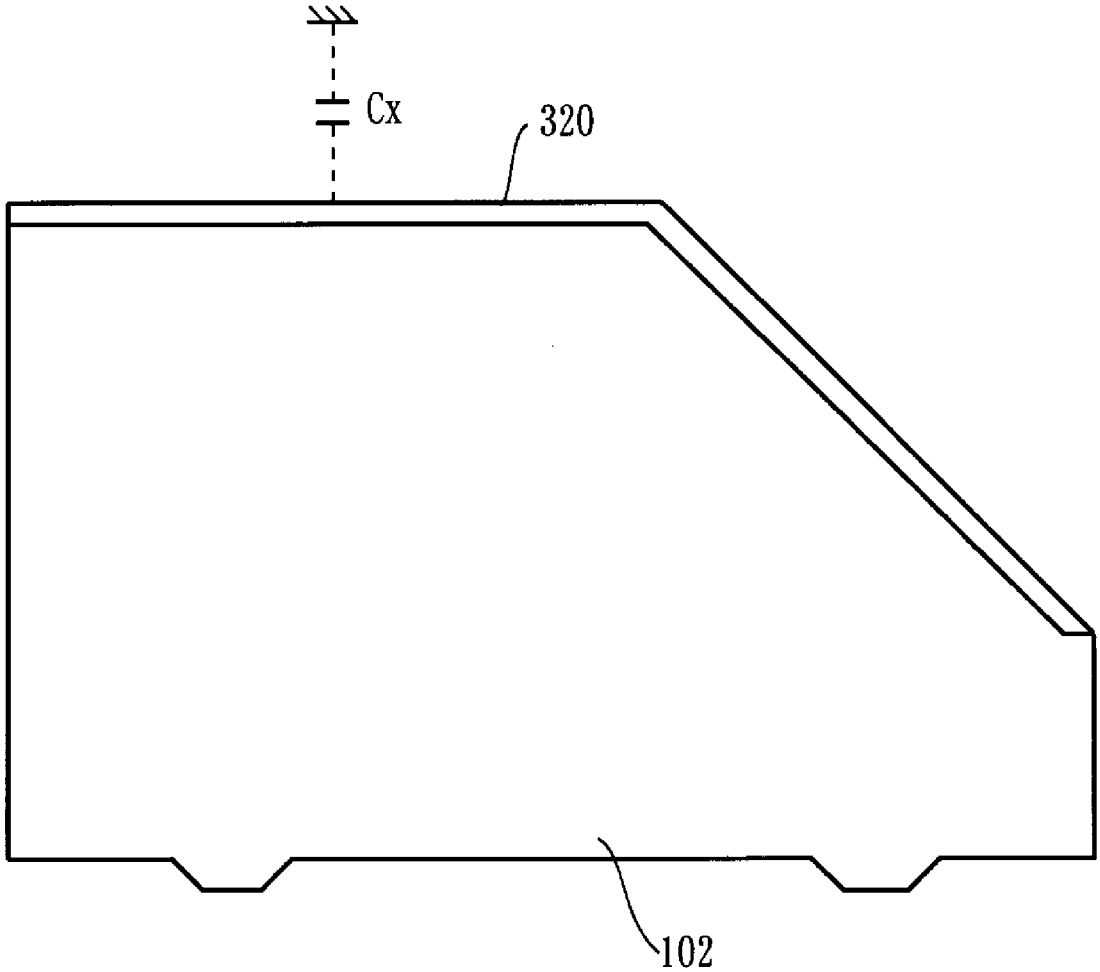
[FIG. 25] It shows a diagram showing a layout of an electrode on a window glass.

FIG. 25 shows a layout of the electrode 320 on the window glass 102. As shown in the figure, the electrode 320 is provided over an upper side to a rear side of the window glass 102. The electrode 320 is configured using a conductive material or the like. An electrode at a window frame side corresponding to the electrode 320 may be a metal itself configuring the window frame.

The electrode 320 has capacitance cx with respect to a corresponding window frame. Since the window frame is at ground potential, the capacitance cx corresponds to capacitance to ground. The capacitance to ground increases when the electrode 320 contacts with a human body such as a hand or finger of a passenger.

As shown by an equivalent circuit of FIG. 8, this is because the capacitance cx of the electrode 320 is connected in parallel with capacitance cx' of the human body. The capacitance cx of the electrode 320 is, for example, about 80 pF, and the capacitance cx' of the human body is, for example, about 400 pF. Therefore, capacitance of the equivalent circuit extremely increases. Such change in capacitance is used for detecting contact of a human body.

FIG. 9 shows an example of a circuit for detecting change in capacitance. The circuit configures a major part of the capacitance detection section 330. As shown in the figure, the circuit is configured using an OP amplifier 332. The OP amplifier 332 is supplied with a unipolar DC power of, for example, VC=+5V and VE=0V.

In the OP amplifier 332, a capacitor cx and a resistance Rx are connected in parallel between a non-inverting input terminal and ground respectively, a capacitor ci is connected in parallel between an inverting input terminal and ground, and the inverting input terminal is connected to an output terminal through a resistance Rf.

The capacitor cx has the capacitance cx of the electrode 320 on the window glass. The capacitor ci is a capacitor for compensation, and has capacitance corresponding to capacitance of the electrode 320 when a human body or the like does not contact the electrode. The resistance Rx and the resistance Rf have the same value.

A voltage Vi from the voltage generator 334 is inputted into the non-inverting input terminal and the inverting input terminal of such an OP amplifier 332 through resistance Ri+ and resistance Ri−, respectively. The resistance Ri+ and the resistance Ri− have the same value.

The OP amplifier 332 outputs a voltage given by amplifying a difference between a voltage V+ of the non-inverting input terminal and a voltage V− of the inverting input terminal with an amplification factor of Rf/Ri. The voltage is smoothed by a smoothing circuit including a resistance Ro and a capacitor Co so as to be into an output voltage Vo. The output voltage Vo is inputted into the CPU 302 as a capacitance detection signal.

FIGS. 10 and 11 show an example of waveforms of the voltages Vi, V−, V+ and Vo respectively. As shown in the figures, the voltage Vi is a voltage of a unipolar, square wave pulse with a fixed cycle. The voltages V− and V+ are voltages for charging the capacitors Ci and Cx by the voltage Vi respectively. The voltage Vo corresponds to a voltage given by smoothing an amplified value of a difference between V+ and V−.

FIG. 10 shows a case that a human body or the like does not contact to the electrode 320 on the window glass, wherein since capacitance is not different between the capacitors Cx and Ci, the voltages V+ and V− are the same in waveform and amplitude, and the voltage Vo obtained by amplifying and smoothing a difference between the voltages is 0 V.

FIG. 11 shows a case that a human body or the like contacts to the electrode 320 on the window glass, wherein since a waveform or amplitude of the voltage V+ changes with increase in capacitance of the capacitor Cx, the voltage Vo obtained by amplifying and smoothing a difference between V+ and V− is higher than 0 V. The amount of increase in voltage is corresponding to increase in capacitance of the capacitor Cx.

Figure 26:
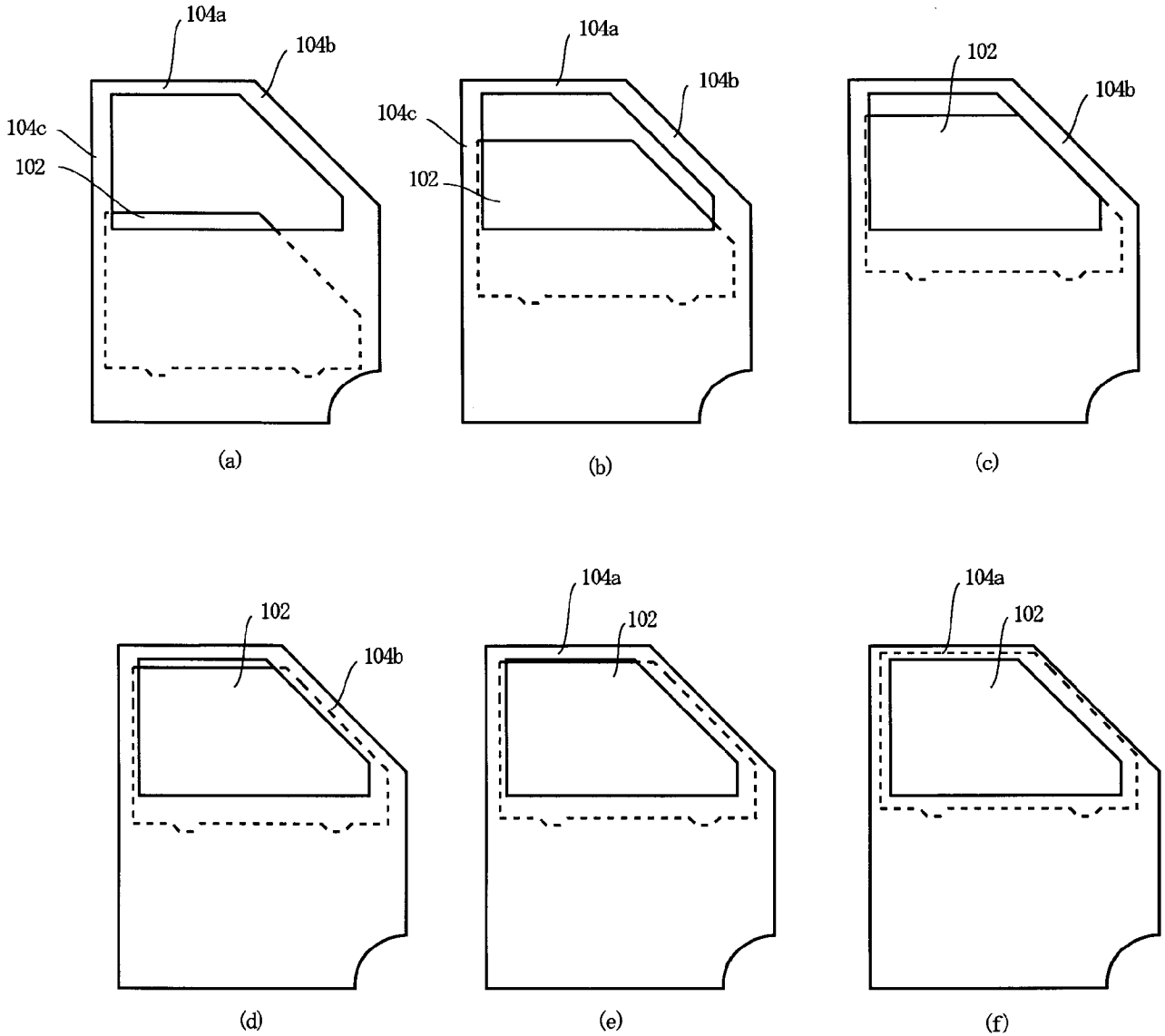
[FIG. 26] It shows diagrams showing raising/lowering conditions of the window glass respectively.

FIG. 26 shows a raising/lowering process of the window glass 102. As shown in the figure, the window glass 102 is raised in order of (a), (b), (c), (d), (e) and (f). The window glass is lowered in reverse order to this. (a) shows a state where the window glass 102 is in the bottom dead center, and (f) shows a state that it is in the top dead center. (b), (c), (d), and (e) show intermediate states respectively.

To further describe the respective states, (a) shows a full opening state of the power window. (b) shows a state where the window glass 102 begins to rise. In this state, the upper side and the rear side of the window glass 102 are spaced from the upper frame 104*a* and the rear frame 104*b* respectively. The front side of the window glass 102 is within the front frame 104*c* through all steps of raising and lowering.

(c) shows a state where the rear side of the window glass 102 begins to enter the rear frame 104*b*, and (d) shows a state where the rear side of the window glass 102 completely enters the rear frame 104*b*. In this state, only the upper side of the window glass 102 is spaced from the window frame.

(e) shows a state where the upper side of the window glass 102 begins to enter the upper frame 104*a*, and (f) shows a state where the upper side of the window glass 102 completely enters the upper frame 104*a*. This corresponds to a full closing state of the power window.

Figure 27:
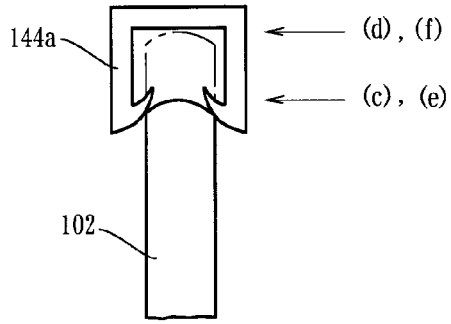
[FIG. 27] It shows a diagram showing a relationship between the window glass and a glass run.

FIG. 27 shows in more detailed manner the state where the window glass begins to enter the window frame and the state where it completely enters the window frame. This corresponds to the states of (c) and (d) for the rear side of the window glass 102, and corresponds to the states of (e) and (f) for the upper side of the window glass 102. First, the upper side or the rear side of the window glass 102 contacts a glass run 144*a* of the upper frame 104*a*, then the upper side or the rear side of the window glass 102 completely enters the glass run 144*a* of the upper frame 104*a*. The glass run 144*a* is configured by an insulating material such as rubber or plastic.

Figure 28:
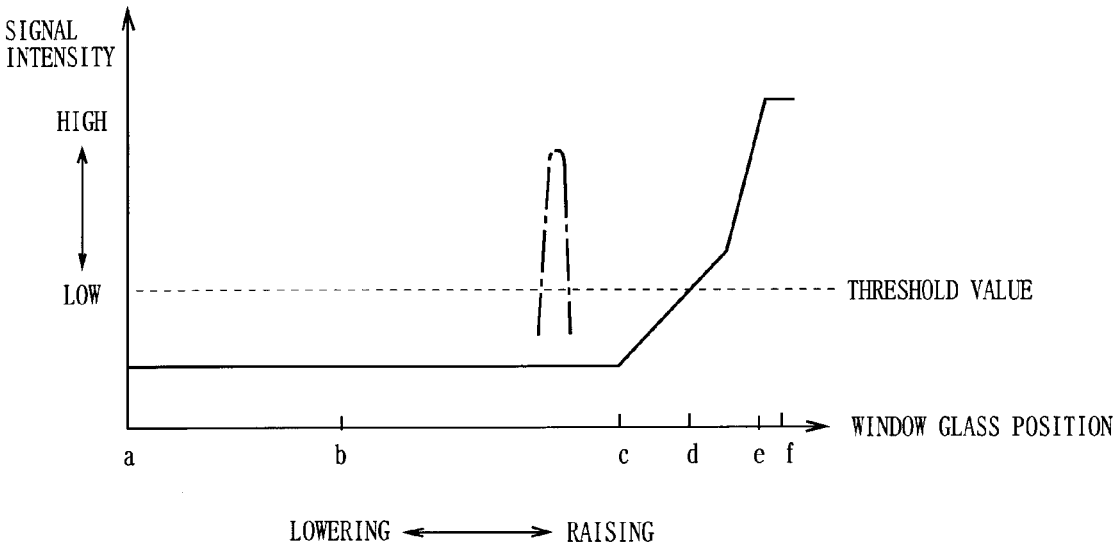
[FIG. 28] It shows a diagram showing a relationship between a window glass position and a capacitance detection signal.

FIG. 28 shows change in capacitance detection signal along with raising and lowering of the window glass 102. The figure shows a graph with a window glass position as a horizontal axis and signal intensity of a capacitance detection signal as a vertical axis. Signs a to f marked at various points on the horizontal axis correspond to the window glass positions (a) to (f) shown in FIG. 26 respectively. Hereinafter, the window glass may be called glass, and the window glass position may be called glass position. In addition, the capacitance detection signal may be called detection signal.

The detection signal is small in signal intensity and slightly changes in a range from the position a to the position c. This is because a sufficient space exists between the electrode 320 and the window frame 104. The signal is abruptly increased in signal intensity in a range from the position c to the position d. This is because the electrode 320 enters the rear frame 104*b*. Signal intensity is further increased in a range from the position d to the position e. This is because the electrode 320 enters the upper frame 104*a*. The signal is large in signal intensity and slightly changes in a range from the position e to the position f. This is because the electrode 320 has completely entered the window frame 104.

For such a detection signal, a threshold value is set for determining presence of contact of a human body or pinching. As the threshold value, for example, a value is set as shown by a broken line, which is larger than a value of detection signal intensity when any part of the window glass 102 does not enter the window frame, and smaller than a value of detection signal intensity when even a part of the window glass 102 has completely entered the window frame, and enables secure identification of increase in detection signal due to contact of a human body or the like as shown by a dashed line.

The threshold value is stored in the memory 312, and used for pinching determination by the CPU 302. If the threshold value is updated according to the latest measurement value on a relationship between the glass position and the detection signal intensity, an appropriate threshold value can be continuously set irrespective of change in relationship between the glass position and the detection signal intensity.

For the pinching determination by the CPU 302, physical quantity other than capacitance may be used. As such physical quantity, for example, an attribute of a pulse signal generated by the pulse generator 306 is used. The attribute of a pulse signal includes pulse width or a pulse period.

Figure 29:
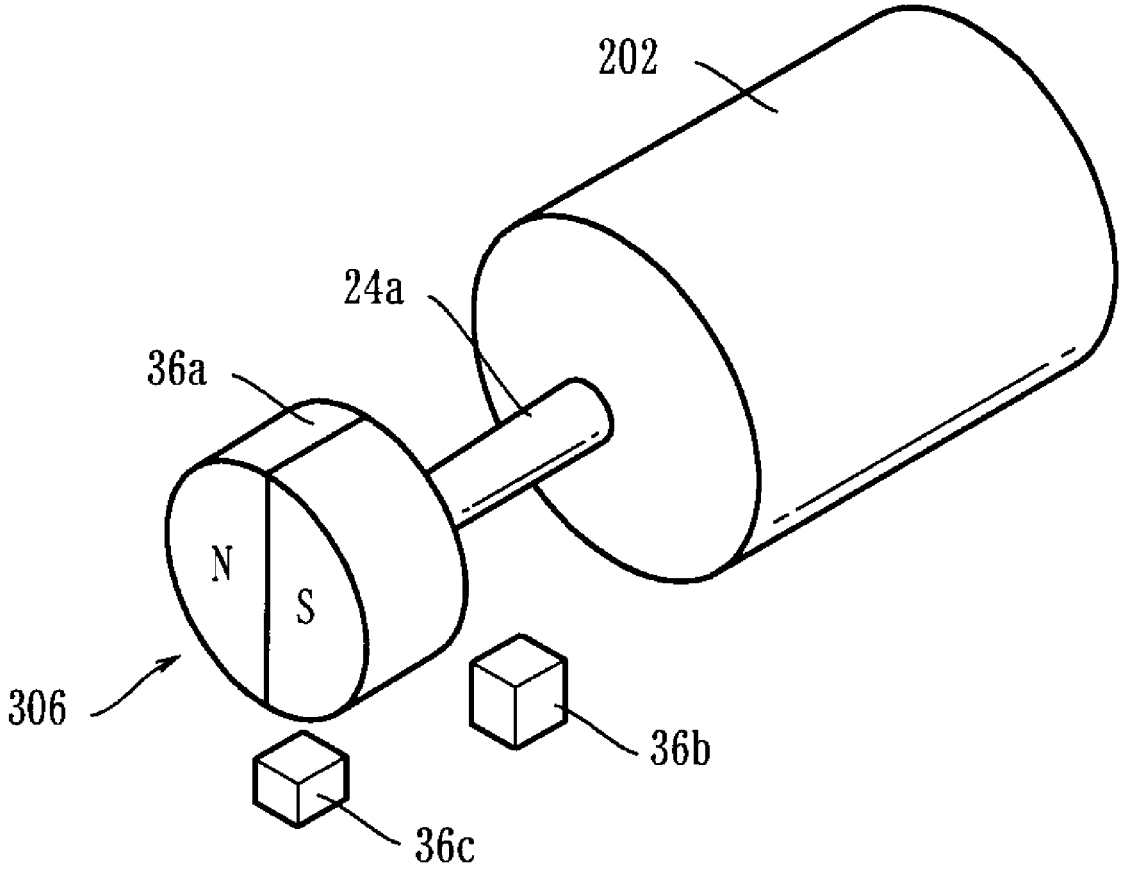
[FIG. 29] It shows a diagram showing a configuration of a pulse generator.

For example, as shown in FIG. 29, the pulse generator 306 has a permanent magnet 36*a* attached to a rotation shaft 24*a* of the raising/lowering motor 202, and two Hall elements 36*b* and 36*c* for detecting magnetic flux of the magnet, wherein the Hall elements 36*b* and 36*c* output pulse signals showing periodical change in magnetic flux associated with rotation of the permanent magnet 36*a* respectively.

Rotation speed of the raising/lowering motor 202 is reflected in pulse width and pulse period of a pulse signal, and increase and decrease in rotation speed result in shortening and expansion in pulse width and pulse period, respectively.

Figure 30:
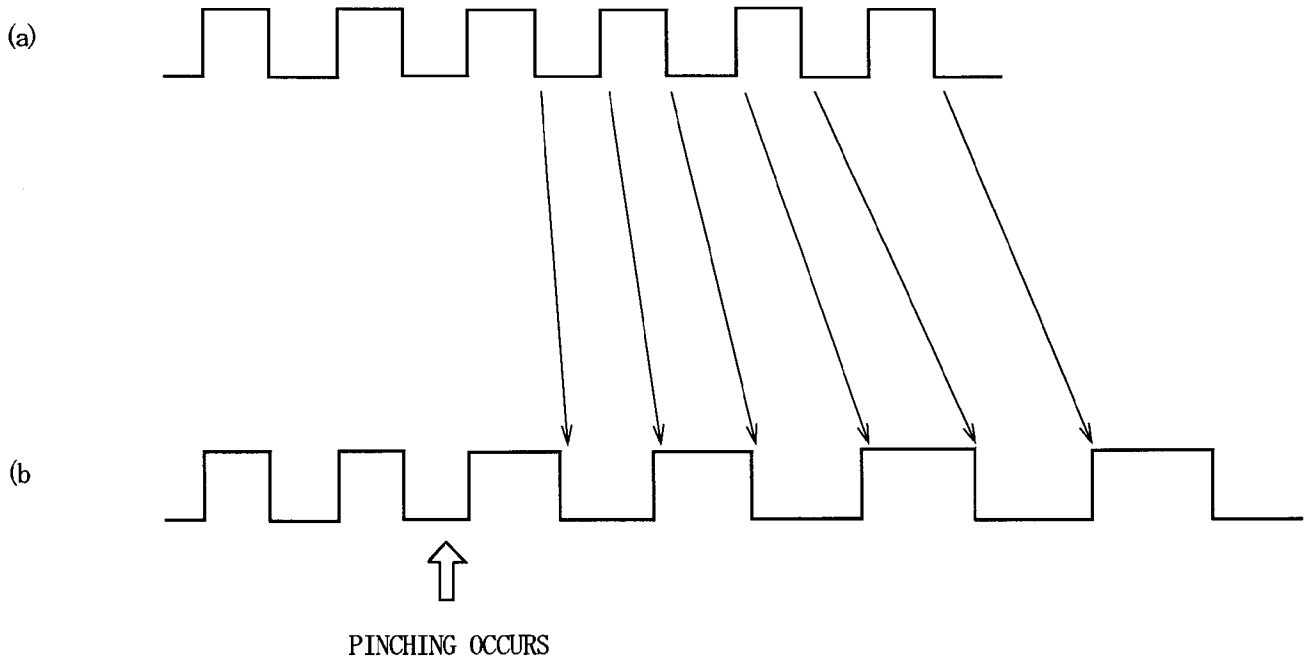
[FIG. 30] It shows diagrams showing waveforms of pulses generated by the pulse generator respectively.

FIG. 30 shows change in pulse width and pulse period corresponding to change in rotation speed. (a) shows a pulse signal during constant-speed rotation, wherein pulse width and a pulse period are constant. (b) shows a pulse signal when speed reduces during rotation, wherein pulse width and a pulse period are expanded respectively due to reduction in speed of the raising/lowering motor 202 associated with increase in load caused by the window glass 102 when pinching occurs.

For each of the pulse width and the pulse period, a predetermined threshold value is stored in the memory 310. The threshold value is used by the CPU 302 for pinching determination based on pulse width or a pulse period.

Hereinafter, a pinching detection system using capacitance may be called first sensor system, and a pinching detection system using a pulse signal may be called second sensor system. The first sensor system is configured by the electrode 320 and the capacitance detection section 330. The first sensor system is an example of first detection means of the invention. The second sensor system is configured by the pulse generator 306 and the pulse processing circuit 318. The second sensor system is an example of second detection means of the invention.

Figure 31:
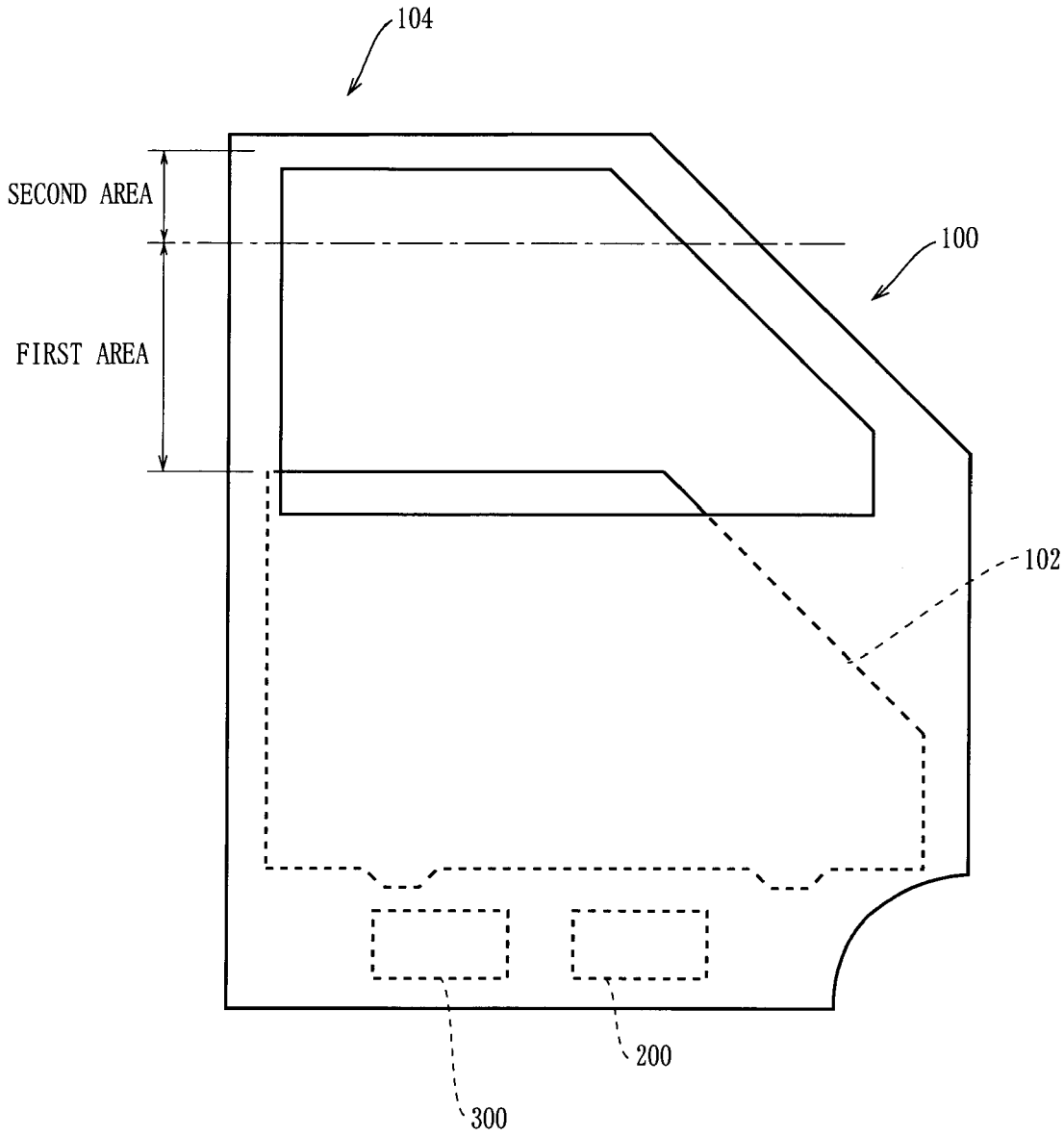
[FIG. 31] It shows a diagram showing areas of pinching detection.

For the first sensor system and the second sensor system, monitoring areas for pinching detection are set respectively. An example of setting the monitoring areas is shown in FIG. 31. The monitoring areas are set by dividing a moving range of a window glass into two areas with a boundary shown by a dashed line.

The moving range of a window glass is divided with the boundary into two areas of an area at an opening position side of a window frame (bottom dead center side) and an area at a closing position side (top dead center side) thereof. Hereinafter, a monitoring area at the opening position side (bottom dead center side) may be called first area, and a monitoring area at the closing position side (top dead center side) may be called second area.

A boundary position between the two areas is, for example, the window glass position c shown in FIG. 28 or a position near the position c. At this position, the rear side of the window glass 102 begins to enter the rear frame 104*b* as shown in (c) of FIG. 26, and abrupt increase in capacitance starts along with it. According to such boundary setting, in the first area, capacitance of the window glass does not exceed the threshold value unless pinching occurs. Under such monitoring area setting, control for avoiding pinching is performed by the CPU 302. The CPU 302 is an example of control means of the invention.

Figure 32:
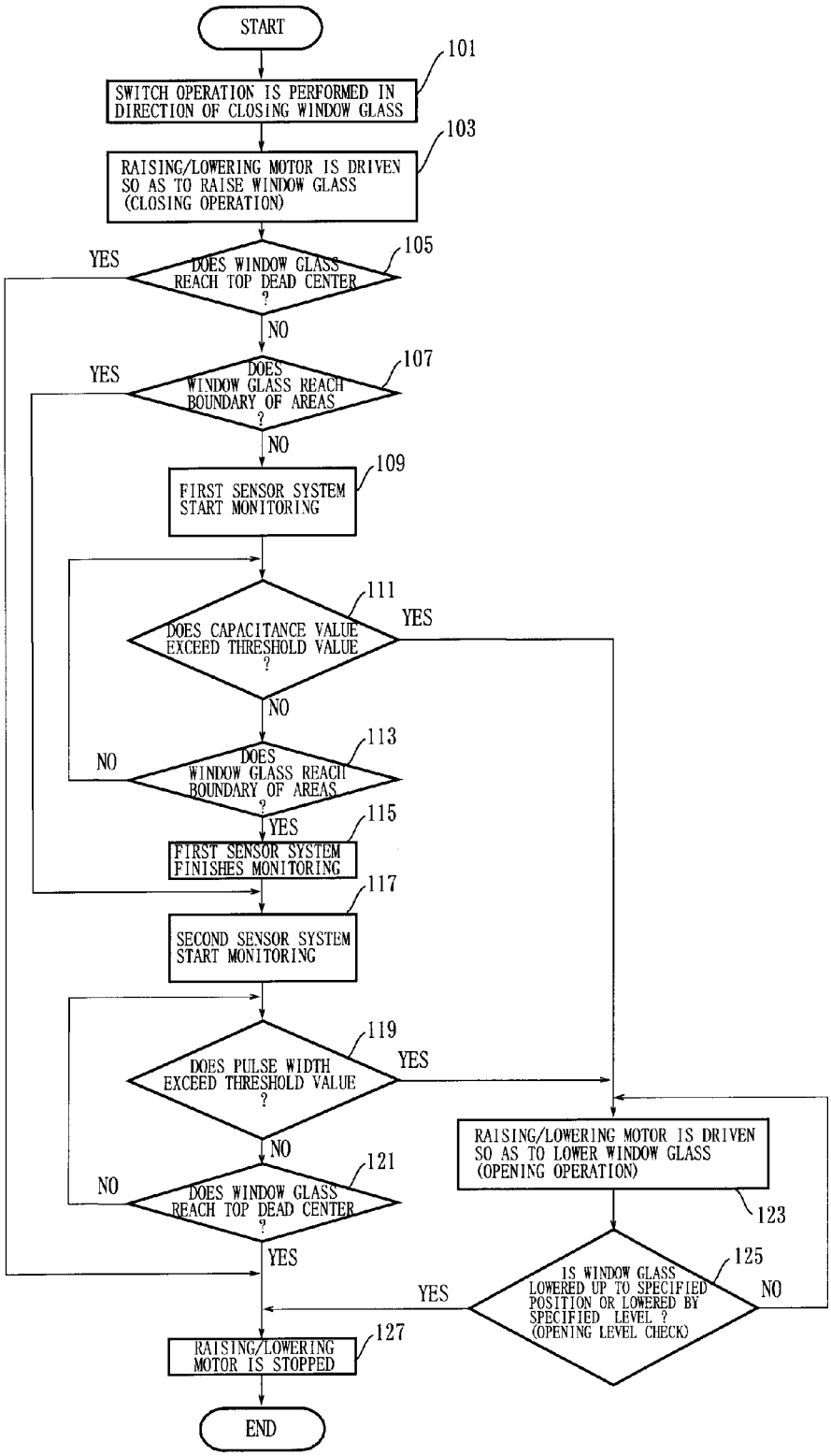
[FIG. 32] It shows a flowchart of operation of the safety device as the example of the best mode for carrying out the invention.

FIG. 32 shows a flowchart of an example of pinching avoidance operation by the CPU 302. When switch operation is performed in a direction of closing a window glass in step 101, the CPU 302 drives a raising/lowering motor so as to raise the window glass for closing operation in step 103.

In step 105, the CPU determines whether the window glass reaches a top dead center. When the CPU determines that the window glass reaches the top dead center, it stops the raising/lowering motor in step 127. When the CPU determines that the window glass does not reach the top dead center, it determines whether the window glass reaches the boundary of areas in step 107. When the CPU determines that the window glass does not reach the boundary of areas, the CPU allows the first sensor system to start monitoring in step 109.

The CPU determines whether a capacitance value exceeds a threshold value in step 111, and when the CPU determines NO, it determines whether the window glass reaches the boundary of areas in step 113. While the window glass does not reach the area boundary, and the capacitance value does not exceed the threshold value, operations of the steps 111 and 113 are repeated.

When the capacitance value exceeds the threshold value, the CPU drives the raising/lowering motor so as to lower the window glass for opening operation in step 123. In step 125, the CPU determines whether the window glass is lowered up to a specified value position (opening level check). When the CPU determines NO, it continues lowering of the window glass in the step 123. When the CPU determines YES, it stops the raising/lowering motor in step 127. In this way, pinching avoidance using capacitance is performed.

When the window glass reaches the boundary of areas while capacitance never exceeds the threshold value, the CPU finishes the detection in a method using capacitance in step 115, and the CPU allows the second sensor system to start monitoring in step 117. When the CPU determines that the window glass reaches the boundary of areas in the step 107, the CPU similarly allows the second sensor system to start monitoring in the step 117.

The CPU determines whether pulse width exceeds a threshold value in step 119. Determination may be performed on a pulse period in place of pulse width. When the CPU determines NO, the CPU determines whether the window glass reaches the top dead center in step 121, and When the CPU determines NO, pulse width monitoring in the step 119 is performed. While pulse width does not exceed the threshold value, and the window glass does not reach the top dead center, operations of the steps 119 and 121 are repeated.

When pulse width exceeds the threshold value, the CPU drives the raising/lowering motor so as to lower the window glass for opening operation in step 123. In step 125, the CPU determines whether the window glass is lowered up to a specified value position (opening level check). When the CPU determines NO, it continues lowering of the window glass in step 123. When the CPU determines YES, it stops the raising/lowering motor in step 127. In this way, pinching avoidance using a pulse signal is performed.

In this way, pinching detection using capacitance is performed only in the first area, and pinching detection is performed using the pulse signal in the second area in which capacitance of the window glass is abruptly increased. Therefore, false reversal of the window glass near the top dead center can be eliminated, which may occur in the case that pinching is detected using only capacitance as in the past.

Figure 33:
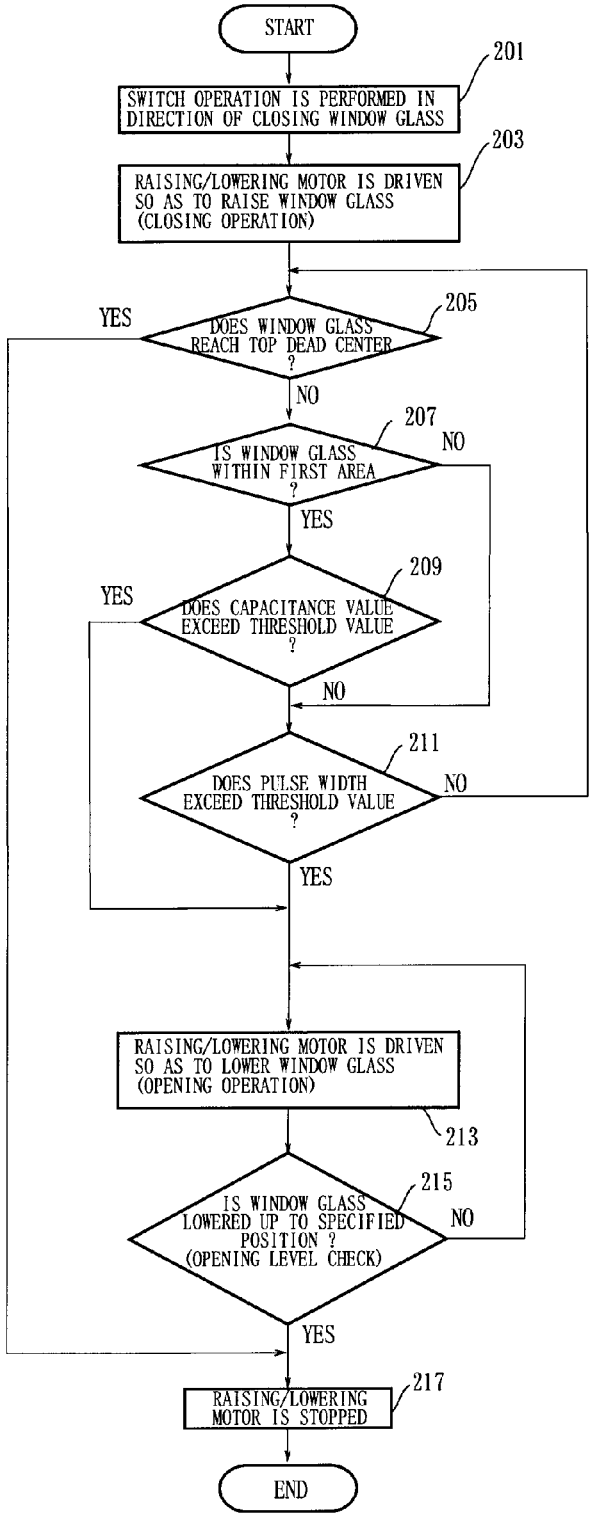
[FIG. 33] It shows a flowchart of operation of the safety device as the example of the best mode for carrying out the invention.

FIG. 33 shows a flowchart of another example of pinching avoidance operation by the CPU 302. When switch operation is performed in a direction of closing a window glass in step 201, the CPU drives a raising/lowering motor so as to raise the window glass for closing operation in step 203.

In step 205, the CPU determines whether the window glass reaches a top dead center. When the CPU determines that the window glass reaches the top dead center, it stops the raising/lowering motor in step 217. When the CPU determines that the window glass does not reach the top dead center, it determines whether the window glass is within the first area.

When the CPU determines YES, it determines whether a capacitance value exceeds a threshold value in step 209. When the CPU determines NO, it determines whether a pulse width value exceeds a threshold value in step 211. Determination may be performed on a pulse period in place of pulse width. While the window glass does not reach the top dead center, and is within the first area, and the capacitance value does not exceed the relevant threshold value, in addition, the pulse width value does not exceed the relevant threshold value, operations of the steps 205 to 211 are repeated.

When the capacitance value exceeds the threshold value in the first area, the CPU drives the raising/lowering motor so as to lower the window glass for opening operation in step 213. In step 215, the CPU determines whether the window glass is lowered up to a specified value position (opening level check). When the CPU determines NO, it continues lowering of the window glass in the step 213. Then, when the CPU determines YES, it stops the raising/lowering motor in step 217. In this way, pinching avoidance using capacitance is performed.

Even if the capacitance value does not exceed the threshold value in the first area, when the pulse width value exceeds the threshold value, the CPU drives the raising/lowering motor so as to lower the window glass for opening operation in step 213. In step 215, the CPU determines whether the window glass is lowered up to a specified value position (opening level check). When the CPU determines NO, it continues lowering of the window glass in step 213. Then, when the CPU determines YES, it stops the raising/lowering motor in step 217.

In this way, pinching avoidance using a pulse signal is performed even in the first area. Therefore, even if some object, which does not cause increase in capacitance, is pinched, pinching avoidance can be performed.

After the window glass is out of the first area while the capacitance value and the pulse width value never exceed the threshold values respectively, determination of capacitance in the step 209 is skipped, and only determination of pulse width in the step 211 is performed. Therefore, only pinching detection using a pulse signal is performed in the second area. While the window glass does not reach the top dead center, and the window glass is within the second area, and the pulse width value does not exceed the threshold value, operations of the steps 205 to 211 are repeated.

When the pulse width value exceeds the threshold value, the CPU drives the raising/lowering motor so as to lower the window glass for opening operation in step 213. In step 215, the CPU determines whether the window glass is lowered up to a specified value position (opening level check). When the CPU determines NO, it continues lowering of the window glass in the step 213. When the CPU determines YES, it stops the raising/lowering motor in step 217. In this way, pinching avoidance using a pulse signal is performed.

In this way, since pinching detection using capacitance is performed only in the first area, false reversal of the window glass near the top dead center can be eliminated, which may occur in the case that pinching is detected using only capacitance as in the past. Moreover, since pinching detection is performed using the pulse signal throughout the first and second areas, pinching of an object other than a human body can be avoided in the first area, in addition to avoidance of pinching of a human body in the second area.

Figure 34:
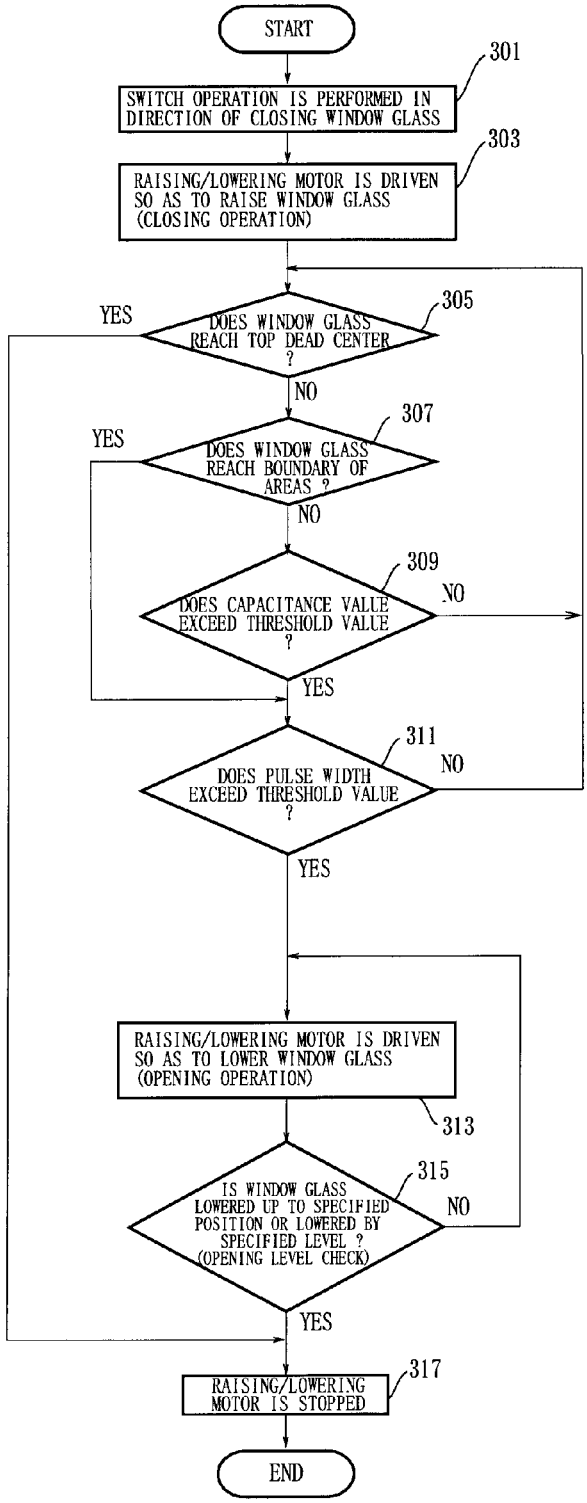
[FIG. 34] It shows a flowchart of operation of the safety device as the example of the best mode for carrying out the invention.

FIG. 34 shows a flowchart of still another example of pinching avoidance operation by the CPU 302. When switch operation is performed in a direction of closing a window glass in step 301, the CPU drives a raising/lowering motor so as to raise the window glass for closing operation in step 303.

In step 305, the CPU determines whether the window glass reaches a top dead center. When the CPU determines that the window glass reaches the top dead center, it stops the raising/lowering motor in step 317. When the CPU determines that the window glass does not reach the top dead center, it determines whether the window glass reaches the boundary of areas in step 307.

When the CPU determines NO, it determines whether a capacitance value exceeds a threshold value in step 309. When the capacitance value does not exceed the threshold value, the CPU returns processing to the step 305. While the window glass does not reach the top dead center, and does not reach the boundary of areas, in addition, the capacitance value does not exceed the threshold value, operations of the steps 305 to 309 are repeated.

When the capacitance value exceeds the threshold value, the CPU determines whether a pulse width value exceeds a threshold value in step 311. Determination may be performed on a pulse period in place of pulse width. When the pulse width value does not exceed the threshold value, the CPU returns processing to the step 305. While the window glass does not reach the top dead center, and does not reach the boundary of areas, and the capacitance value exceeds the relevant threshold value, in addition, the pulse width value does not exceed the relevant threshold value, operations of the steps 305 to 311 are repeated.

When the window glass does not reach the top dead center, and does not reach the boundary of areas, and the capacitance value exceeds the threshold value, in addition, the pulse width value exceeds the relevant threshold value, the CPU drives the raising/lowering motor so as to lower the window glass for opening operation in step 313. In step 315, the CPU determines whether the window glass is lowered up to a specified value position (opening level check). When the CPU determines NO, it continues lowering of the window glass in the step 313. Then, when the CPU determines YES, it stops the raising/lowering motor in step 317. In this way, in the first area, when the capacitance value exceeds the relevant threshold value, and the pulse width value exceeds the relevant threshold value, pinching avoidance is performed.

After the window glass is out of the first area while the capacitance value and the pulse width value never exceed the threshold values respectively, determination of capacitance in the step 309 is skipped, and only determination of pulse width in the step 311 is performed. Therefore, only pinching detection using a pulse signal is performed in the second area. While the window glass does not reach the top dead center, and is in the second area, in addition, the pulse width value does not exceed the threshold value, operations of the steps 305 to 311 are repeated.

When the pulse width value exceeds the threshold value, the CPU drives the raising/lowering motor so as to lower the window glass for opening operation in step 313. In step 315, the CPU determines whether the window glass is lowered up to a specified value position (opening level check). When the CPU determines NO, it continues lowering of the window glass in the step 313. When the CPU determines YES, it stops the raising/lowering motor in step 317. In this way, pinching avoidance using a pulse signal is performed.

In this way, since pinching detection using capacitance is performed only in the first area, false reversal of the window glass near the top dead center can be eliminated, which may occur in the case that pinching is detected using only capacitance as in the past. Moreover, in the first area, when the capacitance value exceeds the relevant threshold value, and the pulse width value exceeds the relevant threshold value, pinching avoidance is performed, therefore false pinching avoidance, which may occur in the case of using only capacitance, can be eliminated.

Hereinbefore, while an example of the power window for a vehicle was shown, the power window is not limited to the power window for a vehicle, and any power window is acceptable if it moves a window glass by using a window regulator. Moreover, while an example of the power window, which closed a window frame by raising the window glass, was shown, a power window that closes the window frame by lowering the window glass, or a power window that closes the window frame by moving the window glass in a horizontal or an oblique direction is also acceptable.

While an example where an attribute of a pulse signal was used as physical quantity other than capacitance was shown, the physical quantity other than capacitance is not limited to the attribute of a pulse signal, and an electromagnetic wave including light, an ultrasonic wave, temperature, pressure, distortion or the like may be used. Moreover, while an example where a voltage signal was used as a capacitance detection signal was shown, the capacitance detection signal may include a current signal, a frequency signal, or capacitance itself.

Figure 35:
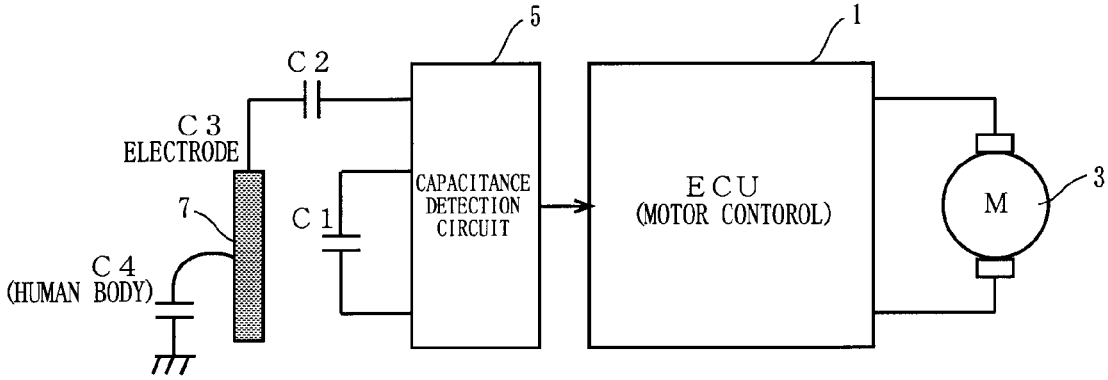
[FIG. 35] It shows a block diagram of an opening/closing control unit.

FIG. 35 shows a block diagram of an example of an opening/closing control unit for a power window. Operation of the unit shows an example of the best mode for carrying out the invention that relates to an opening/closing control method.

As shown in FIG. 35, the unit has ECU 1. The ECU 1 includes a control circuit that controls a motor 3 of a power window. The ECU 1 is configured by LSI and the like. The ECU 1 detects presence of pinching based on sensor output inputted from a capacitance detection circuit 5, and when the ECU 1 detects pinching, it reverses the motor 3. The sensor output is an example of a detection signal from a sensor of the invention.

The capacitance detection circuit 5 has capacitors C1, C2 and an electrode 7 at an input side. The capacitors C1, C2 and the electrode 7 configure a sensor circuit. The capacitors C1 and C2 have capacitance C1 and C2 respectively. The electrode 7 may be contacted with a pinched human body. Capacitance of the electrode 7 corresponds to floating capacitance C3 when a human body does not contact the electrode. When a human body contacts the electrode, the capacitance of the electrode 7 corresponds to capacitance given by parallel connection of the floating capacitance C3 and capacitance C4 of a human body.

The capacitor C1 is connected in parallel to one of two input systems of the capacitance detection circuit 5. A series circuit of the capacitor C2 and the electrode 7 is connected in parallel to the other of the two input systems of the capacitance detection circuit 5.

Capacitance of the circuit including the capacitors C1, C2 and the electrode 7 is given by the following expression.

[Numeral Expression 1]

$$C=C1+C2*C3/(C2+C3) \quad (1)$$

$$C=C1+C2*(C3+C4)/(C2+(C3+C4)) \quad (2)$$

$$C=C1 \quad (3)$$

$$C=C1+C2 \quad (4)$$

Expression (1) shows capacitance when pinching of a human body does not occur. Expression (2) shows capacitance when a human body is pinched. Expression (3) shows capacitance when a line between the electrode 7 and the capacitor C2 is broken. Expression (4) shows capacitance when the electrode 7 short-circuits to ground.

The capacitance detection circuit 5 converts the capacitance C given by each of the above expressions into, for example, a frequency signal or the like, and then inputs the signal into the ECU 1. Frequency is inversely proportional to a square root of the capacitance C. The ECU 1 compares the frequency signal to a threshold value being set beforehand and thus determines presence of pinching. As the threshold value, threshold value 1, threshold value 2, and threshold value 3 are used. The threshold value 1 is an example of a threshold value of the invention. The threshold value 2 is an example of a second threshold value of the invention. The threshold value 3 is an example of a third threshold value of the invention.

Figure 36:
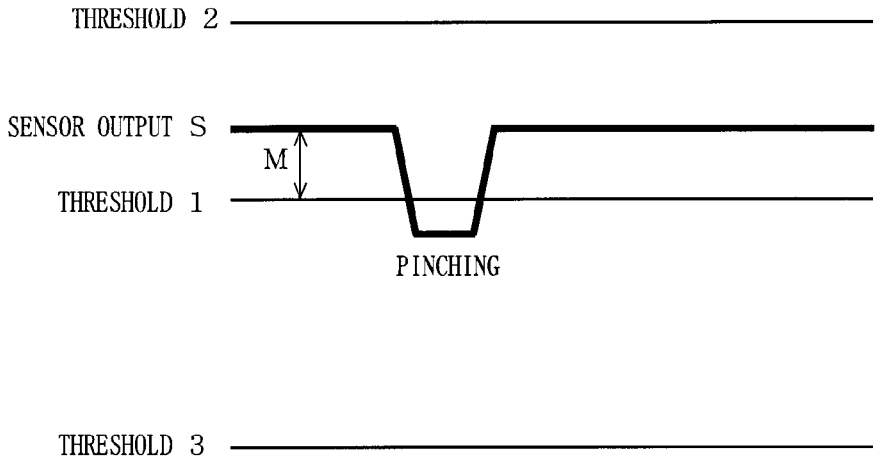
[FIG. 36] It shows a diagram showing a relationship between sensor output, threshold value 1, threshold value 2 and threshold value 3.

FIG. 36 shows a magnitude relation between the threshold values. As shown in FIG. 36, the threshold value 1 is set to be low by a predetermined margin M compared with a value of sensor output S when pinching does not occur. The margin M has a small value compared with a value corresponding to a reduction level of the sensor output S when pinching occurs. Therefore, pinching can be detected using the threshold value 1. The margin M is an example of an offset of the invention. The margin M may be a fixed value or a variable value. The threshold value 2 is set by which change in capacitance can be detected when disconnection occurs. The threshold value 3 is set by which change in capacitance can be detected when short-circuit occurs.

For the threshold value 1, a reference value is set, and a value being low by the margin M compared with the reference value is assumed as the threshold value 1. The reference value is an example of a reference value for control of the invention. As the reference value, a value of sensor output S when pinching does not occur is used. When the sensor output S temporally varies from a cause other than pinching, the reference value is modified following such variation. When the reference value is modified, the threshold value 1 is changed in conjunction with it. The reference value is modified by the ECU 1.

Figure 37:
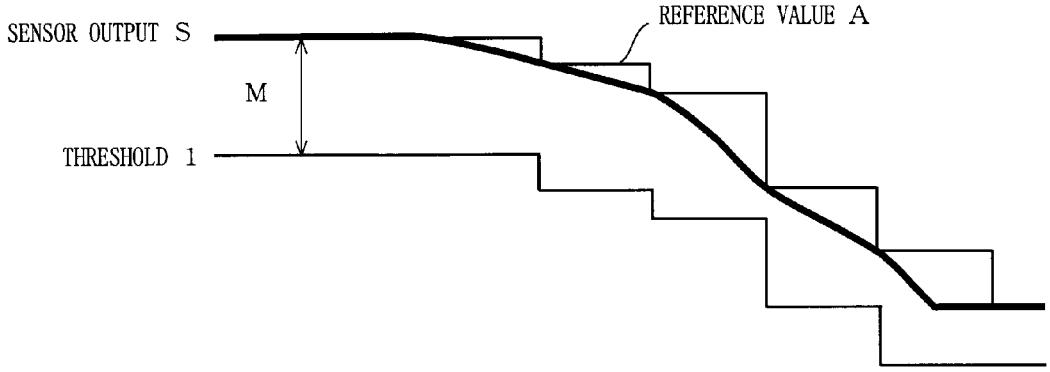
[FIG. 37] It shows a diagram showing update of the threshold value 1 corresponding to change in sensor output.

FIG. 37 shows an example of modification of the reference value associated with temporal change in sensor output S. As shown in FIG. 37, first, the reference value A is adjusted to a value of sensor output S in an initial state. In conjunction with this, the threshold value 1 is established as a value smaller by the margin M than the reference value A. Thus, the margin M becomes even a margin to the sensor output S.

The sensor output S is monitored by a certain period. Therefore, when the sensor output S temporally changes, a changed level in the relevant period can be recognized. When the changed level does not exceed the margin M, the reference value A is sequentially updated in correspondence to the changed sensor output S. The threshold value 1 also changes in conjunction with the update.

In this way, since the threshold value 1 changes following temporal change of the sensor output S, the margin of the threshold value 1 to the sensor output S is continuously appropriately secured. Therefore, false operation due to temporal change of the sensor output S or the like does not occur. Consequently, even if the margin M is reduced so that sensitivity of pinching detection is improved, accurate opening/closing control can be performed without causing false operation. Moreover, since the threshold value 1 changes in conjunction with the reference value A being updated by a certain period, the threshold value is hardly affected by temporary disturbance of sensor output S due to an external condition such as static electricity or an electromagnetic wave.

Figure 38:
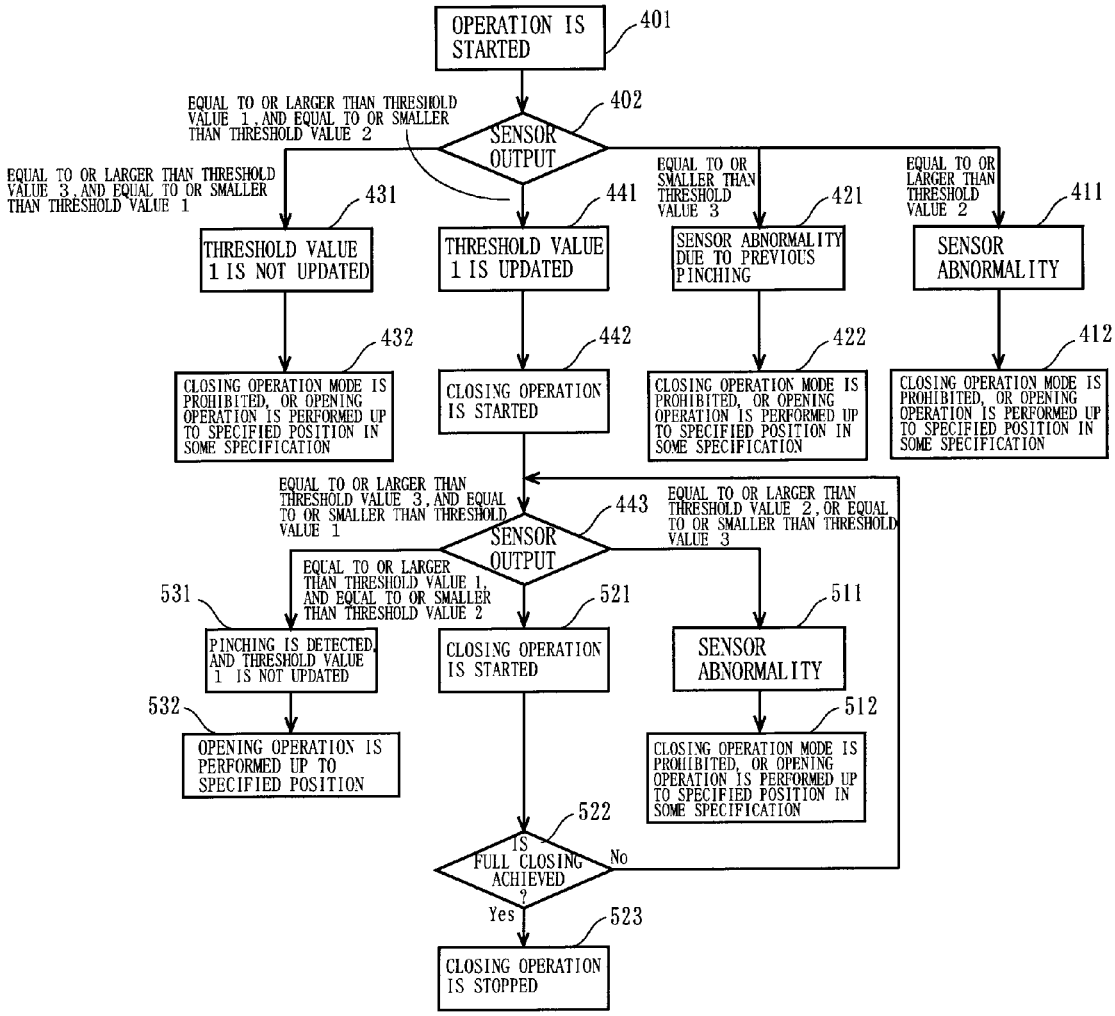
[FIG. 38] It shows a flowchart showing an example of the best mode for carrying out the invention.

FIG. 38 shows a flowchart of opening/closing control performed by the ECU 1. As shown in FIG. 38, when operation is started in step 401, determination of sensor output is performed in step 402. The determination is performed using the threshold value 1, threshold value 2, and threshold value 3.

When a value of the sensor output is equal to or larger than the threshold value 2, sensor abnormality is determined in step 411, and a closing operation mode is prohibited in step 412. Alternatively, opening operation may be performed up to a specified position in some specification.

When a value of sensor output is equal to or smaller than the threshold value 3, sensor abnormality due to previous pinching is determined in step 421, and the closing operation mode is prohibited in step 422. Alternatively, opening operation may be performed up to a specified position in some specification.

When a value of sensor output is equal to or larger than the threshold value 3, and equal to or smaller than the threshold value 1, it is determined in step 431 that the threshold value 1 is not updated, and a closing operation mode is prohibited in step 432. Alternatively, opening operation is performed up to a specified position in some specification.

When a value of sensor output is equal to or larger than the threshold value 1, and equal to or smaller than the threshold value 2, the threshold value 1 is updated in step 441. The threshold value 1 is updated according to the procedure as shown in FIG. 37. Thus, the threshold value 1 has an appropriate margin to the sensor output at any time.

Closing operation is started in step 442, and sensor output is determined in step 443. The threshold value 1 used for the determination is a value being updated in conjunction with the sensor output through processing in the step 441.

When a value of sensor output is equal to or larger than the threshold value 2, or equal to or smaller than the threshold value 3, sensor abnormality is determined in step 511, and the closing operation mode is prohibited in step 512. Alternatively, opening operation is performed up to a specified position in some specification.

When a value of sensor output is equal to or larger than the threshold value 1, and equal to or smaller than the threshold value 2, closing operation is continued in step 521. Then, whether full closing is achieved is determined in step 522. In the case of NO, processing is returned to step 443, and in the case of YES, closing operation is stopped in step 523.

When a value of sensor output is equal to or larger than the threshold value 3, and equal to or smaller than the threshold value 1, pinching is detected and the threshold value 1 is not updated in step 531, and opening operation is performed up to a specified position in step 532. Thus, pinching is prevented.

Hereinbefore, an opening/closing control unit for a power window of a car was described. However, the opening/closing control method of the invention is not limitedly applied to the power window, and can be applied to any component having a structure where an opening is opened or closed by a movable plate, including a sunroof, sunshade, slide door, and back door. Moreover, pinching may be detected not only based on capacitance, but also based on other appropriate physical quantity.

Figure 39:
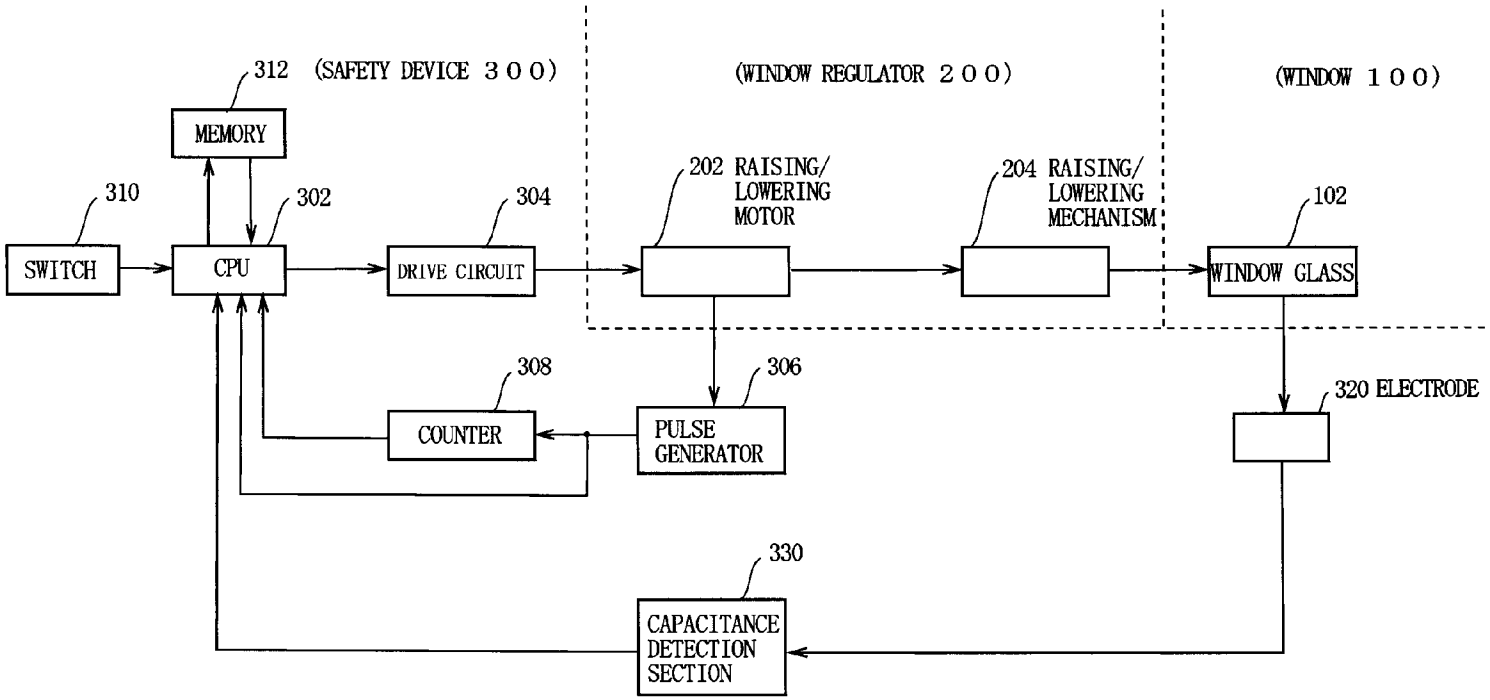
[FIG. 39] It shows a block diagram of a power window using an opening/closing control method as an example of the best mode for carrying out the invention.

FIG. 39 shows a block diagram of a power window. As shown in the figure, the power window includes a window 100, window regulator 200, and safety device 300.

The window 100 has a window glass 102. The window regulator 200 has a raising/lowering motor 202 and a raising/lowering mechanism 204, wherein the raising/lowering motor 202 raises or lowers the window glass 102 via the raising/lowering mechanism 204. The safety device 300 controls safety in raising and lowering of the window glass by the window regulator 200.

The safety device 300 performs safety control using an opening/closing control method as an example of the best mode for carrying out the invention. Operation of the safety device 300 shows an example of the best mode for carrying out the invention, which relates to an opening/closing control method.

The safety device 300 has CPU 302. The CPU 302 is a center of the safety device 300, and performs safety control of the window regulator 200 according to a predetermined program. The CPU 302 controls the raising/lowering motor 202 via a drive circuit 304. The amount of rotation of the raising/lowering motor 202 is fed back to the CPU 302 through a pulse generator 306 and a counter 308. An output signal from the pulse generator 306 is also inputted into the CPU 302.

The CPU 302 is inputted with a window glass raising/lowering instruction through a switch 310. The switch is operated by a user. The CPU 302 has a memory 312, and appropriately writes and reads data during executing the program.

The window glass 102 has an electrode 320. Capacitance of the electrode 320 is detected by a capacitance detection section 330, and a capacitance detection signal is inputted into the CPU 302.

FIG. 24 shows an example of a vehicle door having such a power window. Here, an example of a rear door of a sedan type vehicle is shown. In the door, an upper part of a door body 110 is formed as the window 100. The window 100 has a structure where a window frame 104 is opened and closed by the window glass 102 that is raised or lowered from/into a door body 110 side. The window regulator 200 that raises or lowers the window glass 102 and the safety device 300 thereof are provided within the door body 110.

The window frame 104 has an upper frame 104*a*, a rear frame 104*b*, and a front frame 104*c*. The upper frame 104*a* is set approximately horizontally. The rear frame 104*b* is sloped approximately downward and backward. The front frame 104*c* is set approximately vertically. The electrode 320 on the window glass 102 is provided over two sides corresponding to the upper frame 104*a* and the rear frame 104*b*.

FIG. 25 shows a layout of the electrode 320 on the window glass 102. As shown in the figure, the electrode 320 is provided over an upper side to a rear side of the window glass 102. The electrode 320 is configured using a conductive material or the like. An electrode at a window frame side corresponding to the electrode 320 may be a metal itself configuring the window frame.

The electrode 320 has capacitance cx with respect to a corresponding window frame. Since the window frame is at ground potential, the capacitance cx corresponds to capacitance to ground. The capacitance to ground increases when the electrode 320 is contacted with a human body such as a hand or finger of a passenger.

As shown by an equivalent circuit of FIG. 8, this is because the capacitance cx of the electrode 320 is connected in parallel with capacitance cx' of the human body. The capacitance cx of the electrode 320 is, for example, about 80 pF, and the capacitance cx' of the human body is, for example, about 400 pF. Therefore, capacitance of the equivalent circuit extremely increases. Such change in capacitance is used for detecting contact of a human body.

FIG. 9 shows an example of a circuit for detecting change in capacitance. The circuit configures a major part of the capacitance detection section 330. As shown in the figure, the circuit is configured using an OP amplifier 332. The OP amplifier 332 is supplied with a unipolar DC power of, for example, VC=+5V and VE=0V.

In the OP amplifier 332, a capacitor cx and a resistance Rx are connected in parallel between a non-inverting input terminal and ground respectively, a capacitor ci is connected in parallel between an inverting input terminal and ground, and the inverting input terminal is connected to an output terminal through a resistance Rf.

The capacitor cx has the capacitance cx of the electrode 320 on the window glass. The capacitor ci is a capacitor for compensation, and has capacitance corresponding to capacitance of the electrode 320 when a human body or the like does not contact the electrode. The resistance Rx and the resistance Rf have the same value.

A voltage Vi from the voltage generator 334 is inputted into the non-inverting input terminal and the inverting input terminal of such an OP amplifier 332 through resistance Ri+ and resistance Ri− respectively. The resistance Ri+ and the resistance Ri− have the same value.

The OP amplifier 332 outputs a voltage given by amplifying a difference between a voltage V+ of the non-inverting input terminal and a voltage V− of the inverting input terminal with an amplification factor of Rf/Ri. The voltage is smoothed by a smoothing circuit including a resistance Ro and a capacitor Co so as to be into an output voltage Vo. The output voltage Vo is inputted into the CPU 302 as a capacitance detection signal.

FIGS. 10 and 11 show an example of waveforms of the voltages Vi, V−, V+ and Vo respectively. As shown in the figures, the voltage Vi is a voltage of a unipolar, square wave pulse with a fixed cycle. The voltages V− and V+ are voltages for charging the capacitors Ci and Cx by the voltage Vi respectively. The voltage Vo corresponds to a voltage given by smoothing an amplified value of a difference between V+ and V−.

FIG. 10 shows a case that a human body or the like does not contact the electrode 320 on the window glass, wherein since capacitance is not different between the capacitors Cx and Ci, the voltages V+ and V− are the same in waveform and amplitude, and the voltage Vo obtained by amplifying and smoothing a difference between the voltages is 0 V.

FIG. 11 shows a case that a human body or the like contacts the electrode 320 on the window glass, wherein since a waveform or amplitude of the voltage V+ changes with increase in capacitance of the capacitor Cx, the voltage Vo obtained by amplifying and smoothing the difference between V+ and V− is higher than 0 V. The amount of increase in voltage is corresponding to increase in capacitance of the capacitor Cx.

Figure 40:
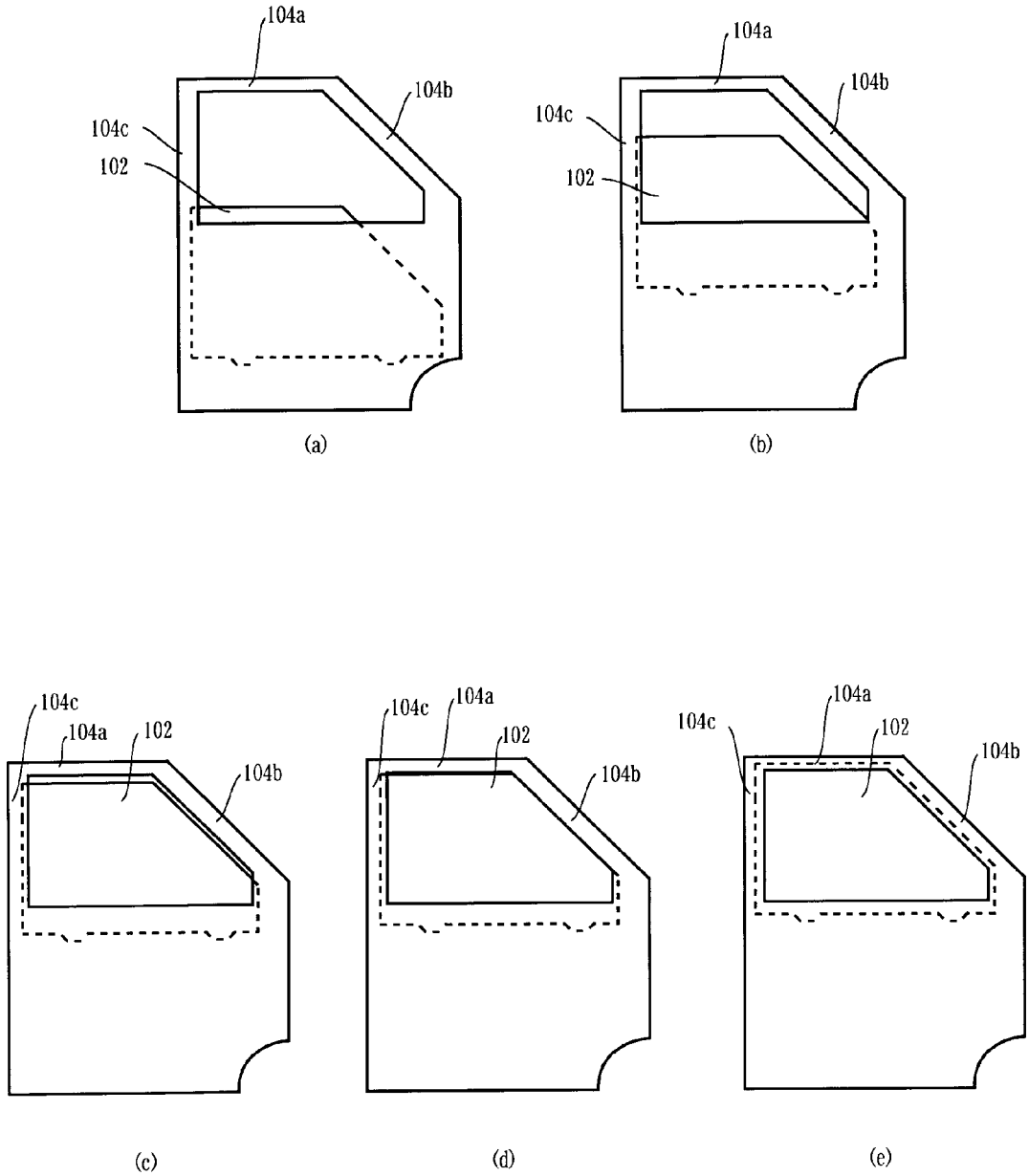
[FIG. 40] It shows diagrams showing raising/lowering conditions of the window glass respectively.

FIG. 40 shows a raising/lowering process of the window glass 102. As shown in the figure, the window glass 102 is raised in order of (a), (b), (c), (d) and (e). The window glass is lowered in reverse order to this. (a) shows a state where the window glass 102 is in the bottom dead center, and (e) shows a state that it is in the top dead center. (b), (c) and (d) show intermediate states respectively.

To further describe the respective states, (a) shows a full opening state of the power window. (b) shows a state where the window glass 102 begins to rise. In this state, the upper side and the rear side of the window glass 102 are spaced from the upper frame 104*a* and the rear frame 104*b* respectively. The front side of the window glass 102 is within the front frame 104*c* through all steps of raising and lowering.

(c) shows a state where the upper side and the rear side of the window glass 102 approach the upper frame 104*a* and the rear frame 104*b* respectively. (d) shows a state where the upper side and the rear side of the window glass 102 begin to enter the upper frame 104*a* and the rear frame 104*b* respectively. (e) shows a state where the upper side and the rear side of the window glass 102 completely enter the upper frame 104*a* and the rear frame 104*b* respectively. This corresponds to a full closing state of the power window.

Figure 41:
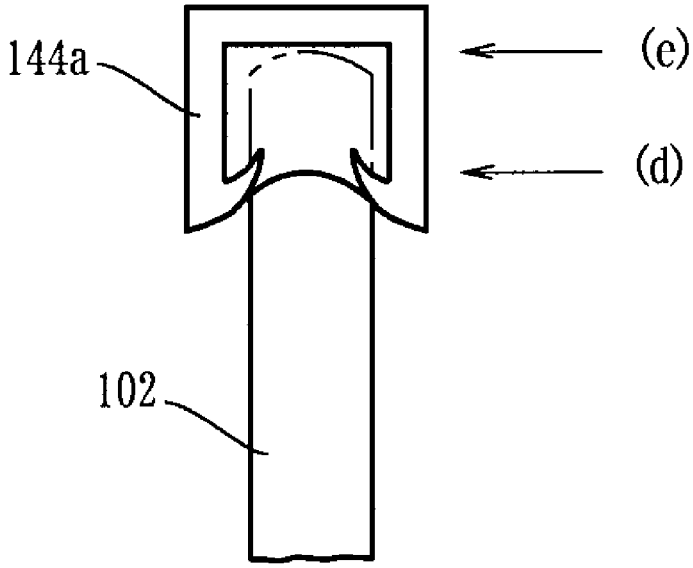
[FIG. 41] It shows a diagram showing a relationship between the window glass and a glass run.

To show the states of (d) and (e) in more detailed manner, as shown in FIG. 41, in the state of (d), the upper side and the rear side of the window glass 102 contact glass runs 144*a* of the upper frame 104*a* and the rear frame 104*b* respectively, and in the state of (e), the upper side and the rear side of the window glass 102 completely enter the glass runs 144*a* of the upper frame 104*a* and the rear frame 104*b* respectively. The glass runs 144*a* are configured by an insulating material such as rubber or plastic.

Figure 42:
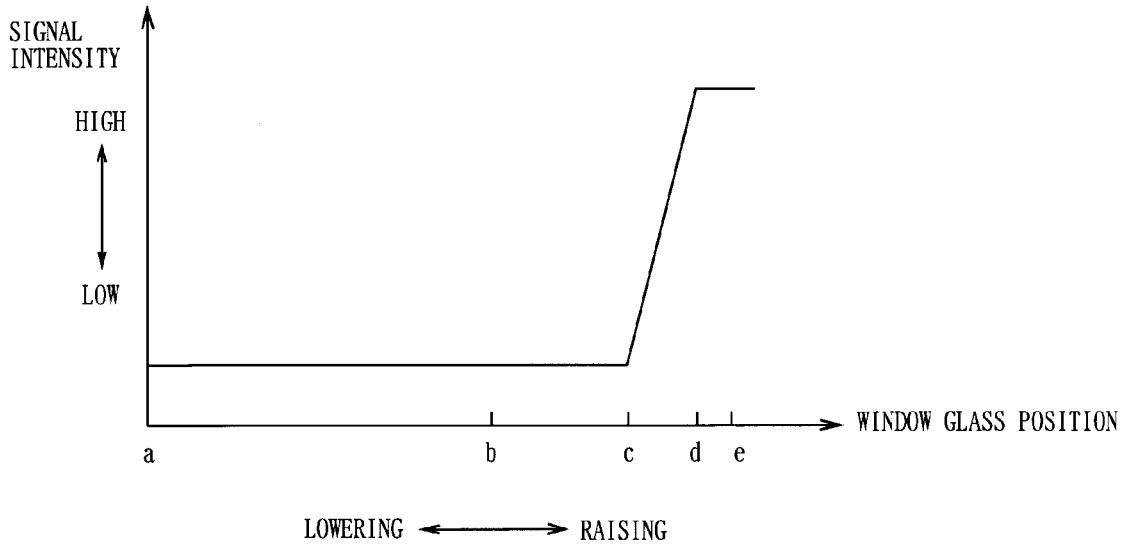
[FIG. 42] It shows a diagram showing a relationship between a window glass position and a capacitance detection signal.

FIG. 42 shows change in capacitance detection signal along with raising and lowering of the window glass 102. The figure shows a graph with a window glass position as a horizontal axis and signal intensity of a capacitance detection signal as a vertical axis. Signs a to e marked at various points on the horizontal axis correspond to the window glass positions (a) to (e) shown in FIG. 40 respectively. Hereinafter, the window glass may be called glass, and the window glass position may be called glass position. In addition, the capacitance detection signal may be called detection signal.

The detection signal is small in signal intensity and slightly changes in a range from the position a to the position c. This is because a sufficient space exists between the electrode 320 and the window frame 104. The signal is abruptly increased in signal intensity in a range from the position c to the position d. This is because the electrode 320 enters the window frame 104. The signal is large in signal intensity and slightly changes in a range from the position d to the position e. This is because the electrode 320 has completely entered the window frame 104.

Figure 43:
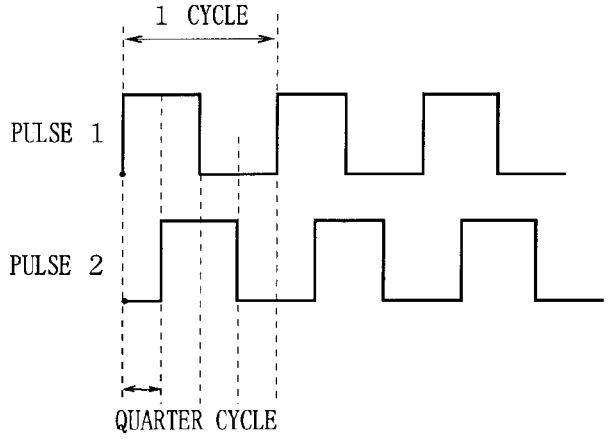
[FIG. 43] It shows a diagram showing timing of capacitance measurement.

The detection signal is measured at a predetermined timing. The measurement timing is, for example, timing at every quarter cycle of a pulse generated by the pulse generator 306. Such measurement timing is established based on, for example, two series of pulses having a phase difference of quarter cycle as shown in FIG. 43. The measurement timing is not limited to this, and may be appropriately optionally determined.

Figure 44:
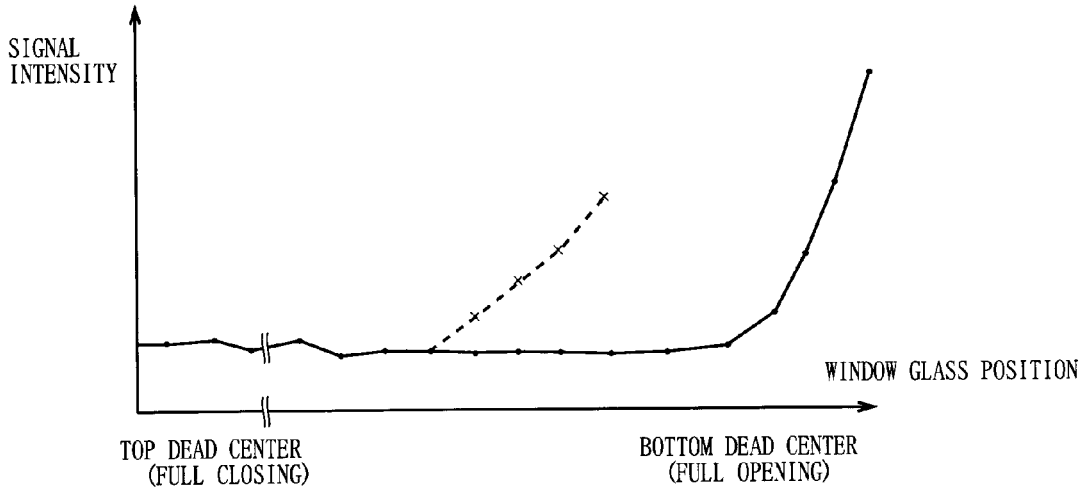
[FIG. 44] It shows a diagram showing a measurement result of capacitance.

Such a measurement provides a measurement result, for example, as shown by line graphs in FIG. 44. Each break point on the graph shows measurement timing. Hereinafter, the measurement timing may be called check point.

A black-circle line graph shows a case that contact of a human body does not occur, wherein signal intensity abruptly increases over a range from a point just before a top dead center to the top dead center. On the contrary, in the case that contact of a human body occurs, increase in signal intensity begins from a position at which the contact occurs as shown by a cross-mark line graph.

Figure 45:
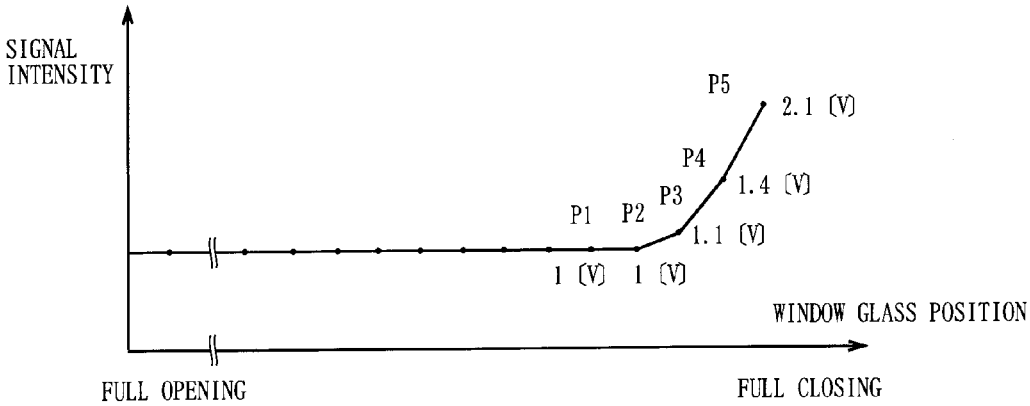
[FIG. 45] It shows a diagram showing a measurement result of capacitance.
Figure 46:
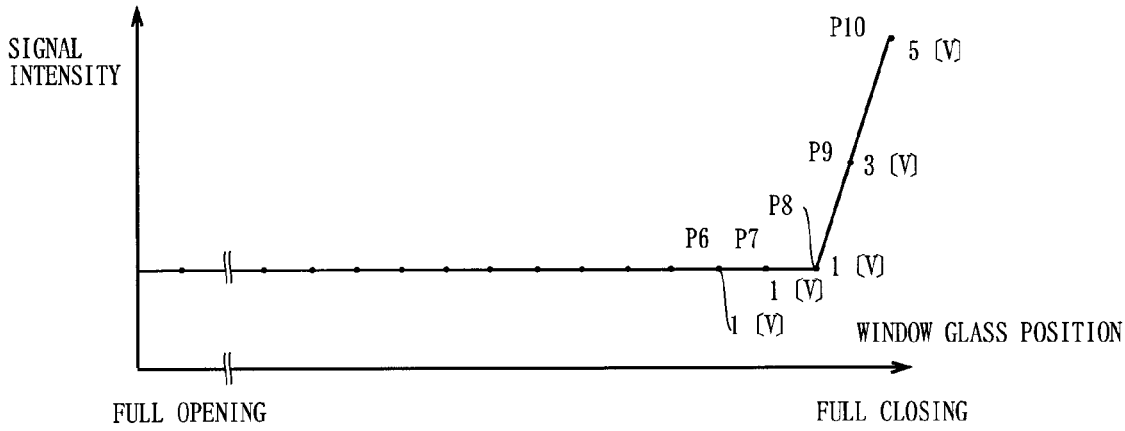
[FIG. 46] It shows a diagram showing a measurement result of capacitance.

Typically, a rate of increase in signal intensity in the case that contact of a human body occurs is smaller than a rate of increase in signal intensity due to approach of the glass to the top dead center. An example of such a fact is shown in FIGS. 45 and 46. FIG. 45 shows increase in signal intensity due to contact of a human body, and FIG. 46 shows increase in signal intensity due to approach of the glass to the top dead center.

Figure 47:
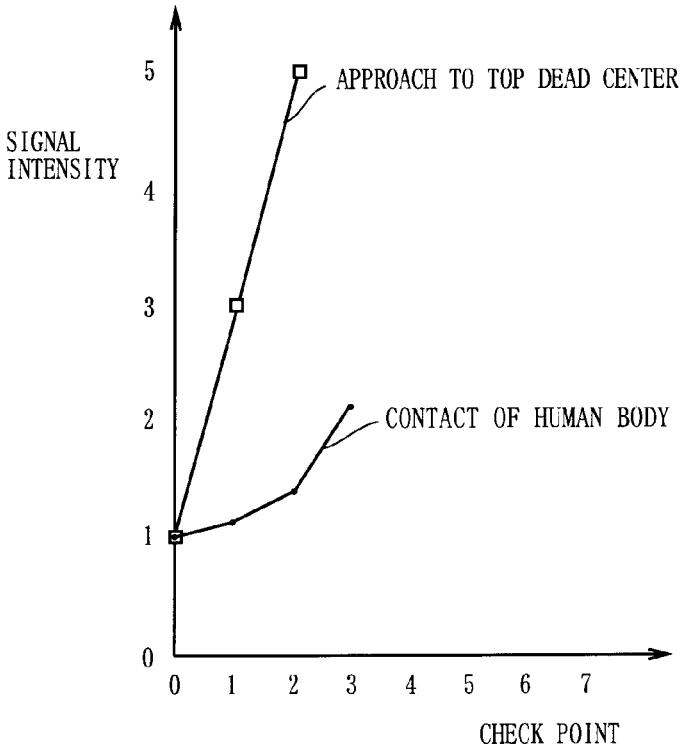
[FIG. 47] It shows a diagram showing part of the measurement result of capacitance.

When only change regions in the figures are shown by graphs, FIG. 47 is given. When the regions are shown by numerical values, FIG. 48 is given. In FIG. 48, (a) shows a case of contact of a human body, and (b) shows a case of approach of the glass to the top dead center. In the case of contact of a human body, a rate of increase over three check points is first 0.1 V, next 0.4 V, and next 1.0 V. In the case of approach of the glass to the top dead center, a rate of increase over three check points is first 2.0 V, and next 4.0 V. A conspicuous difference obviously exists between them.

Such a difference is used, thereby it can be made that change in detection signal due to contact of a human body is distinguished from change in detection signal due to approach of the glass to the top dead center, so that pinching avoidance is made valid so as to reverse a window glass only in the case of contact of a human body, and pinching avoidance is made invalid so as to fully close a window in other cases. Pinching avoidance is controlled to be valid or invalid by the CPU 302.

Figure 49:
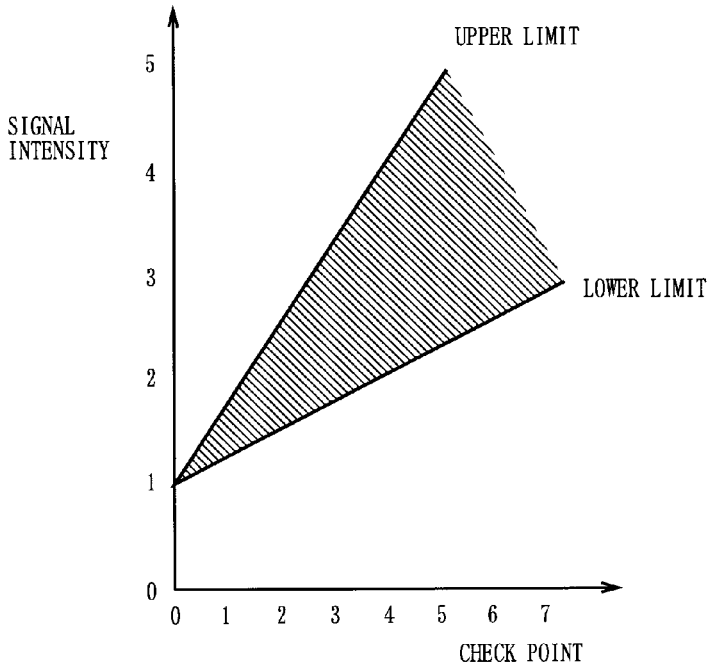
[FIG. 49] It shows a diagram showing upper and lower limit values for capacitance determination.

To determine a cause of change in detection signal, an upper limit and a lower limit are set for a rate of change in detection signal. The upper limit and the lower limit of the rate of change in detection signal are set, for example, in a way as shown by FIG. 49. In the upper limit, for example, amount of change over three check points is 1.5 V. In the lower limit, for example, amount of change over three check points is 0.5 V. The lower limit value is established to neglect slight signal change due to contact of an object other than a human body or the like. The upper and lower limit values are not limited to these, and may be appropriately optionally set.

Figure 50:
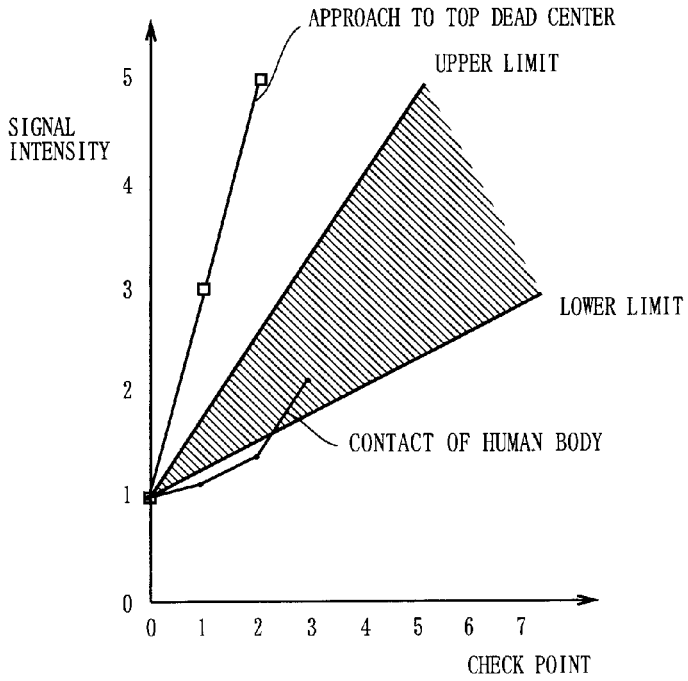
[FIG. 50] It shows a diagram showing a relationship between the part of the measurement result of capacitance and the upper and lower limit values for capacitance determination.

With respect to such upper and lower limit setting values, signal change in contact of a human body and signal change in approach of the glass to the top dead center are given as shown in FIG. 50. As shown in FIG. 50, in the case of contact of a human body, signal change is within a range specified by the upper and lower limits, but in the case of approach of the glass to the top dead center, signal change exceeds the upper limit.

Therefore, a rate of change in detection signal is determined based on such upper and lower limit values, thereby the phenomenon of contact of a human body is distinguished from the phenomenon of approach of the glass to the top dead center, so that pinching avoidance is made valid so as to reverse a window glass only in the case of contact of a human body, and pinching avoidance is made invalid so as to prevent false reversal of the window glass in the case of approach of the glass to the top dead center.

Such prevention of false reversal may be limitedly performed in a region near the top dead center. Moreover, the rate of change in signal is not limited to the change rate over three check points, and change rate over an appropriate number of points, that is, change rate over at least three or at most three points may be used.

Hereinbefore, while an example of the power window for a vehicle was shown, the power window is not limited to the power window for a vehicle, and any power window is acceptable if it moves a window glass by using a window regulator. Moreover, while an example of the power window, which closed a window frame by raising the window glass, was shown, a power window that closes the window frame by lowering the window glass, or a power window that closes the window frame by moving the window glass in a horizontal or an oblique direction is also acceptable. In addition, while an example where a voltage signal was used as a capacitance detection signal was shown, the capacitance detection signal may include a current signal, a frequency signal, or capacitance itself.

Figure 51:
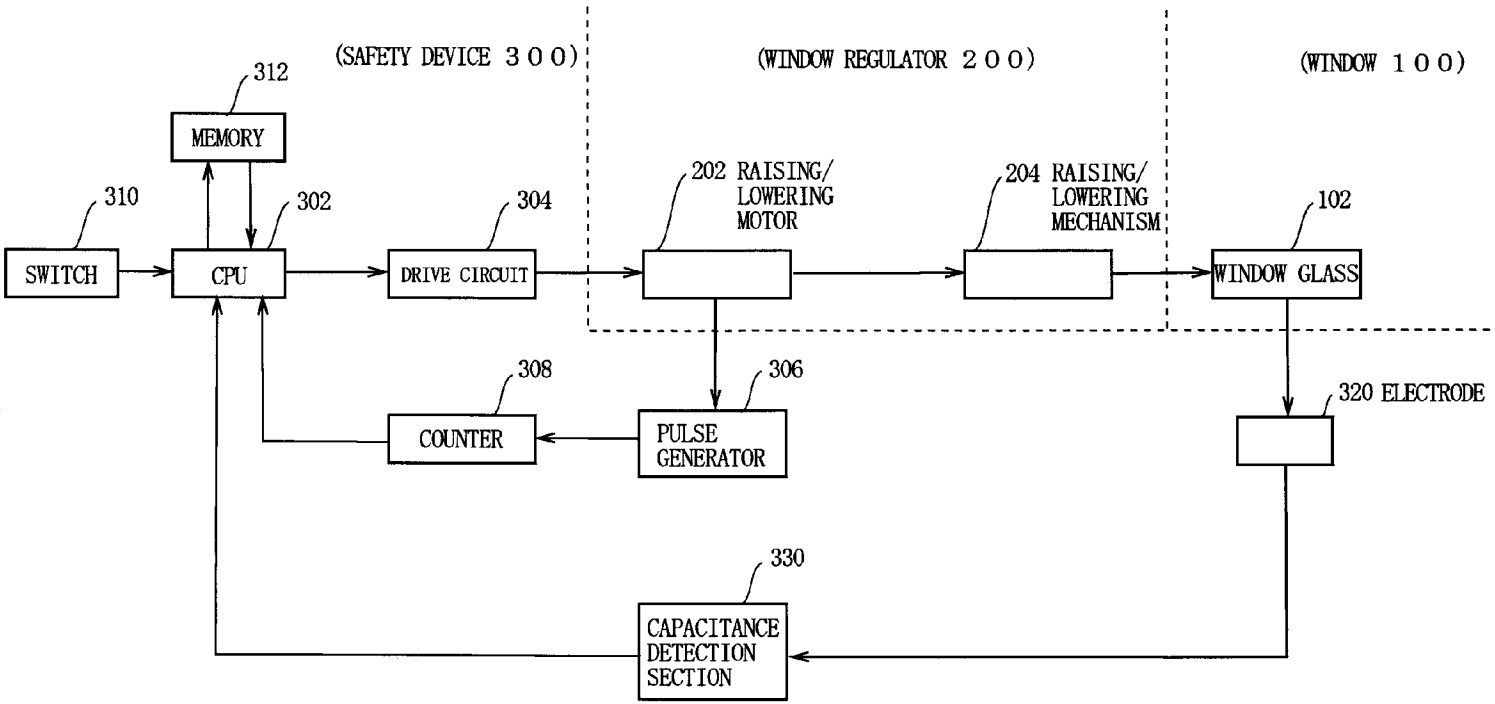
[FIG. 51] It shows a block diagram of a power window using an opening/closing control method as an example of the best mode for carrying out the invention.

FIG. 51 shows a block diagram of an example of a power window. As shown in the figure, the power window includes a window 100, window regulator 200, and safety device 300.

The window 100 has a window glass 102. The window regulator 200 has a raising/lowering motor 202 and a raising/lowering mechanism 204, wherein the raising/lowering motor 202 raises or lowers the window glass 102 via the raising/lowering mechanism 204. The safety device 300 controls safety in raising and lowering of the window glass by the window regulator 200.

The safety device 300 performs safety control using an opening/closing control method as an example of the best mode for carrying out the invention. Operation of the safety device shows an example of the best mode for carrying out the invention, which relates to an opening/closing control method.

The safety device 300 has CPU 302. The CPU 302 is a center of the safety device 300, and performs safety control of the window regulator 200 according to a predetermined program. The CPU 302 controls the raising/lowering motor 202 via a drive circuit 304. The amount of rotation of the raising/lowering motor 202 is fed back to the CPU 302 through a pulse generator and a counter 308. The CPU 302 recognizes a window glass position based on a counted value by the counter 308.

In a vehicle having a plurality of power windows, a plurality of systems, each including the window 100 and the window regulator 200, are provided, and a plurality of systems, each including the pulse generator 306, counter 308, electrode 320 and capacitance detection section 330, are correspondingly provided. FIG. 51 shows one system in the respective systems. The CPU 302 individually controls safety in raising and lowering of the window glass 102 for each of the plurality of systems of the window and the window regulator.

The CPU 302 is inputted with a window glass raising/lowering instruction through a switch 310. The switch 310 is operated by a user. In an automatic mode, the window glass is raised or lowered by one-touch operation of the switch 310. In a manual mode, the window glass is raised or lowered only while the switch 310 is on.

The switch 310 has a plurality of switches corresponding to a plurality of windows. The switches are concentrated in a region near a driver seat, and any of the plurality of switches can be opened and closed from the driver seat. Hereinafter, the switches are called master switches. Switches other than the master switches are provided near windows corresponding to the switches respectively.

The window glass 102 has the electrode 320. Capacitance of the electrode 320 is detected by the capacitance detection section 330, and a capacitance detection signal is inputted into the CPU 302. The CPU 302 has a memory 312, and appropriately writes and reads data during executing the program.

FIG. 24 shows an example of a vehicle door having such a power window. While an example of a rear door of a sedan type vehicle is shown here, other doors essentially have the same configuration. In the vehicle door, an upper part of a door body 110 is formed as the window 100. The window 100 has a structure where a window frame 104 is opened and closed by the window glass 102 that is raised or lowered from/into a door body 110 side. The window regulator 200 that raises or lowers the window glass 102 and the safety device 300 thereof are provided within the door body 110.

The window frame 104 has an upper frame 104*a*, a rear frame 104*b*, and a front frame 104*c*. The upper frame 104*a* is set approximately horizontally. The rear frame 104*b* is sloped approximately downward and backward. The front frame 104*c* is set approximately vertically. The electrode 320 on the window glass 102 is provided over two sides corresponding to the upper frame 104*a* and the rear frame 104*b*.

FIG. 25 shows a layout of the electrode 320 on the window glass 102. As shown in the figure, the electrode 320 is provided over an upper side to a rear side of the window glass 102. The electrode 320 is configured using a conductive material or the like. An electrode at a window frame side corresponding to the electrode 320 may be a metal itself configuring the window frame.

The electrode 320 has capacitance cx with respect to a corresponding window frame. Since the window frame is at ground potential, the capacitance cx corresponds to capacitance to ground. The capacitance to ground increases when the electrode 320 is contacted with a human body such as a hand or finger of a passenger.

As shown by an equivalent circuit of FIG. 8, this is because the capacitance cx of the electrode 320 is connected in parallel with capacitance cx' of the human body. The capacitance cx of the electrode 320 is, for example, about 80 pF, and the capacitance cx' of the human body is, for example, about 400 pF. Therefore, capacitance of the equivalent circuit extremely increases. Such change in capacitance is used for detecting contact of a human body.

FIG. 9 shows an example of a circuit for detecting change in capacitance. The circuit configures a major part of the capacitance detection section 330. As shown in the figure, the circuit is configured using an OP amplifier 332. The OP amplifier 332 is supplied with a unipolar DC power of, for example, VC=+5V and VE=0V.

In the OP amplifier 332, a capacitor cx and a resistance Rx are connected in parallel between a non-inverting input terminal and ground respectively, a capacitor ci is connected in parallel between an inverting input terminal and ground, and the inverting input terminal is connected to an output terminal through a resistance Rf.

The capacitor cx has the capacitance cx of the electrode 320 on the window glass. The capacitor ci is a capacitor for compensation, and has a capacitance corresponding to capacitance of the electrode 320 when a human body or the like does not contact the electrode. The resistance Rx and the resistance Rf have the same value.

A voltage Vi from the voltage generator 334 is inputted into the non-inverting input terminal and the inverting input terminal of such an OP amplifier 332 through resistance Ri+ and resistance Ri− respectively. The resistance Ri+ and the resistance Ri− have the same value.

The OP amplifier 332 outputs a voltage given by amplifying a difference between a voltage V+ of the non-inverting input terminal and a voltage V− of the inverting input terminal with an amplification factor of Rf/Ri. The voltage is smoothed by a smoothing circuit including a resistance Ro and a capacitor Co so as to be into an output voltage Vo. The output voltage Vo is inputted into the CPU 302 as a capacitance detection signal.

FIGS. 10 and 11 show an example of waveforms of the voltages Vi, V−, V+ and Vo respectively. As shown in the figures, the voltage Vi is a voltage of a unipolar, square wave pulse with a fixed cycle. The voltages V− and V+ are voltages for charging the capacitors Ci and Cx by the voltage Vi respectively. The voltage Vo corresponds to a voltage given by smoothing an amplified value of a difference between V+ and V−.

FIG. 10 shows a case that a human body or the like does not contact the electrode 320 on the window glass, wherein since capacitance is not different between the capacitors Cx and Ci, the voltages V+ and V− are the same in waveform and amplitude, and the voltage Vo obtained by amplifying and smoothing a difference between the voltages is 0 V.

FIG. 11 shows a case that a human body or the like contacts the electrode 320 on the window glass, wherein since a waveform or amplitude of the voltage V+ changes with increase in capacitance of the capacitor Cx, the voltage Vo obtained by amplifying and smoothing the difference between V+ and V− is higher than 0 V. The amount of increase in voltage is corresponding to increase in capacitance of the capacitor Cx.

FIG. 40 shows a raising/lowering process of the window glass 102. As shown in the figure, the window glass 102 is raised in order of (a), (b), (c), (d) and (e). The window glass is lowered in reverse order to this. (a) shows a state where the window glass 102 is in the bottom dead center, and (e) shows a state that it is in the top dead center. (b), (c) and (d) show intermediate states respectively.

To further describe the respective states, (a) shows a full opening state of the power window. (b) shows a state where the window glass 102 begins to rise. In this state, the upper side and the rear side of the window glass 102 are spaced from the upper frame 104*a* and the rear frame 104*b* respectively. The front side of the window glass 102 is within the front frame 104*c* through all steps of raising and lowering.

(c) shows a state where the upper side and the rear side of the window glass 102 approach the upper frame 104*a* and the rear frame 104*b* respectively. (d) shows a state where the upper side and the rear side of the window glass 102 begin to enter the upper frame 104*a* and the rear frame 104*b* respectively. (e) shows a state where the upper side and the rear side of the window glass 102 completely enter the upper frame 104*a* and the rear frame 104*b* respectively. This corresponds to a full closing state of the power window.

To show the states of (d) and (e) in more detailed manner, as shown in FIG. 41, in the state of (d), the upper side and the rear side of the window glass 102 contact glass runs 144*a* of the upper frame 104*a* and the rear frame 104*b* respectively, and in the state of (e), the upper side and the rear side of the window glass 102 completely enter the glass runs 144*a* of the upper frame 104*a* and the rear frame 104*b* respectively. The glass runs 144*a* are configured by an insulating material such as rubber or plastic.

Figure 52:
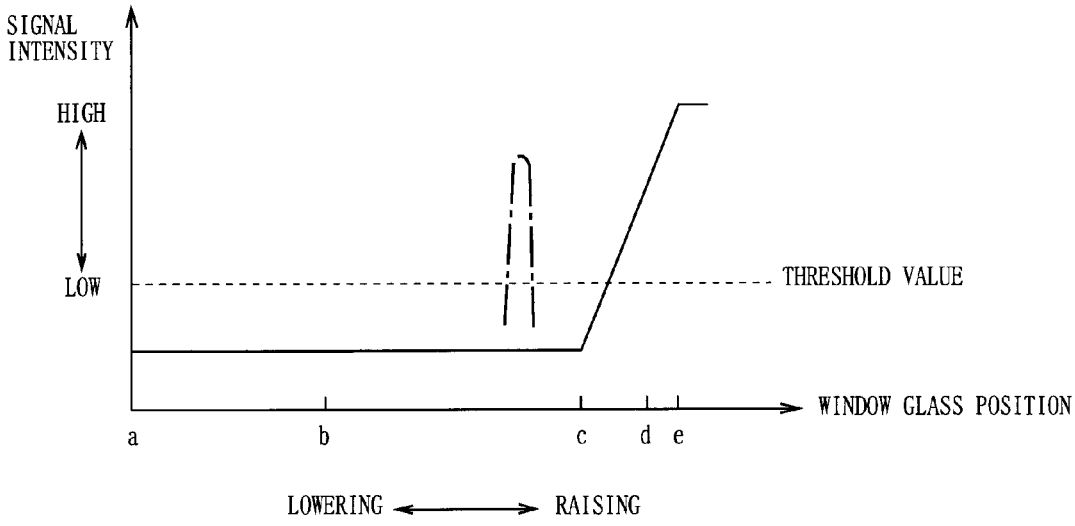
[FIG. 52] It shows a diagram showing a relationship between a window glass position and a capacitance detection signal.

FIG. 52 shows change in capacitance detection signal along with raising and lowering of the window glass 102. The figure shows a graph with a window glass position as a horizontal axis and signal intensity of a capacitance detection signal as a vertical axis. Signs a to e marked at various points on the horizontal axis correspond to the window glass positions (a) to (e) shown in FIG. 40 respectively. Hereinafter, the window glass may be called glass, and the window glass position may be called glass position. In addition, the capacitance detection signal may be called simply capacitance or detection signal.

The detection signal is small in signal intensity and slightly changes in a range from the position a to the position c. This is because a sufficient space exists between the electrode 320 and the window frame 104. The signal is abruptly increased in signal intensity in a range from the position c to the position d. This is because the electrode 320 enters the window frame 104. The signal is large in signal intensity and slightly changes in a range from the position d to the position e. This is because the electrode 320 has completely entered the window frame 104.

For such a detection signal, a threshold value is set for determining presence of contact of a human body or pinching. As the threshold value, for example, a value is set as shown by a broken line, which is larger than a value of detection signal intensity when the window glass 102 does not enter the window frame, and smaller than a value of detection signal intensity when the window glass 102 has completely entered the window frame, and enables secure identification of increase in detection signal due to contact of a human body or the like as shown by a dashed line. The threshold value may be set for each of the glass positions. The threshold value is stored in the memory 312, and used for pinching determination by the CPU 302. When the CPU 302 determines pinching occurs, it lowers the window glass 102 so as to avoid pinching.

Figure 53:
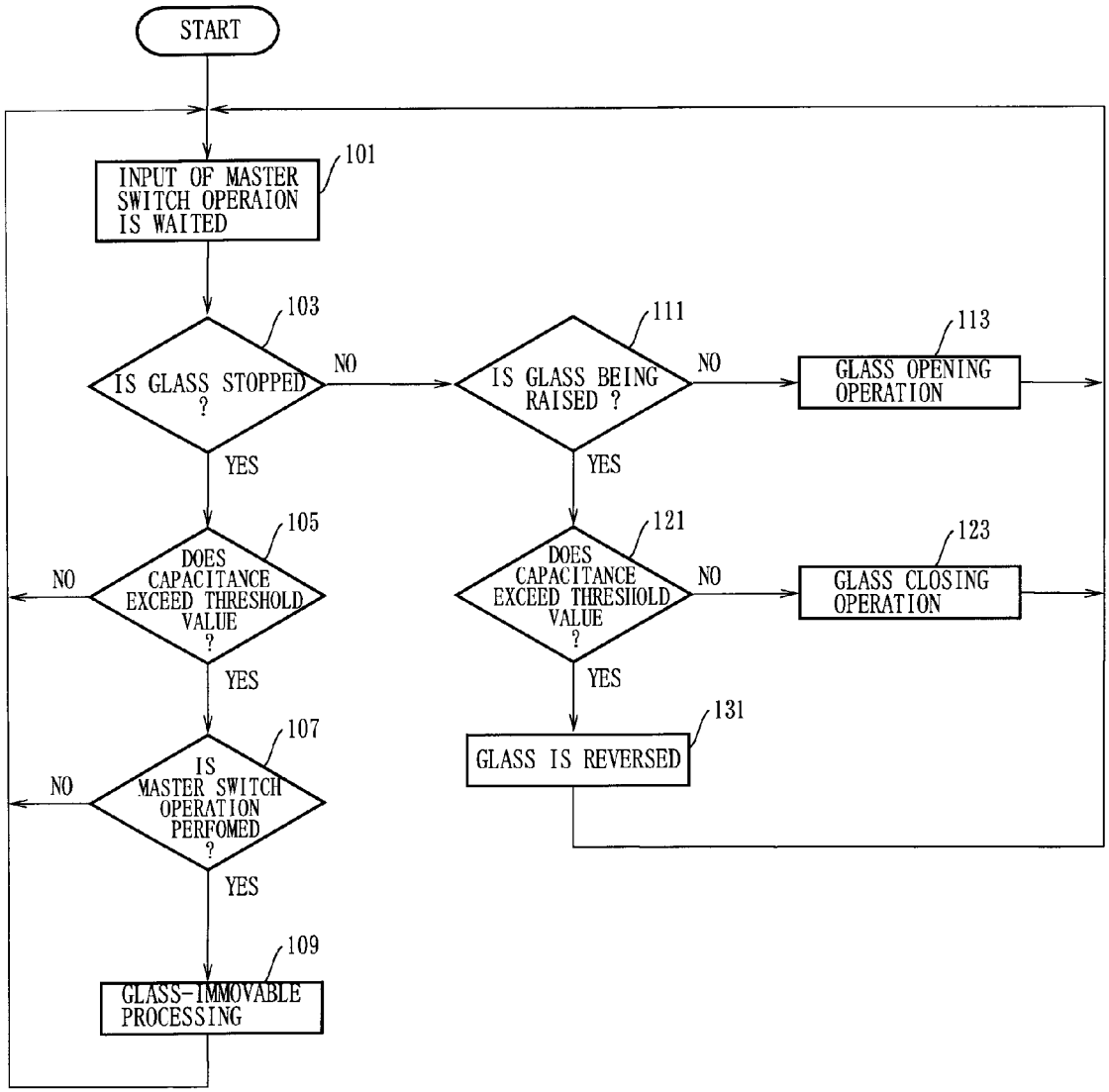
[FIG. 53] It shows a flowchart of operation of the safety device as the example of the best mode for carrying out the invention.

The CPU 302 performs control to prevent occurrence of an inconvenient situation due to careless switch operation by a user. FIG. 53 shows a flowchart of an example of operation of the CPU 302 when the CPU performs such control.

In step 101, the CPU 302 waits input of master switch operation. During waiting input of master switch operation, the CPU determines whether glass is stopped in step 103. When the glass is stopped, the CPU 302 determines whether a value of capacitance (detection signal) exceeds a threshold value in step 105, and when the capacitance value does not exceed the threshold value, the CPU returns processing to the step 101 and waits input of master switch operation. While the glass is stopped, and the capacitance does not exceed the threshold value, operations of the steps 101 to 105 are repeated.

When the capacitance value exceeds the threshold value, the CPU determines whether master switch operation is performed. When the CPU determines master switch operation is not performed, the CPU returns processing to the step 101 and waits input of master switch operation. While the glass is stopped, the capacitance exceeds the threshold value, and master switch operation is not performed, operations of the steps 101 to 107 are repeated.

When the CPU determines master switch operation is performed in the step 107, glass-immovable processing is performed in step 109. The glass-immovable processing is processing to prevent movement of the window glass 102 despite a fact that master switch operation is performed. The window glass 102 is subjected to the processing and thereby left in a current position.

Therefore, even if a user intends to raise or lower the window glass using the master switch in a condition that glass is stopped, and capacitance exceeds a threshold value, the window glass 102 remains in a current position irrespective of such operation. Operation of the master switch may be performed in either of an automatic mode or a manual mode.

Consequently, for example, when a passenger in a different seat from a driver seat rests its elbow on a belt line while a window is fully opened, even if the master switch is operated at the driver seat, the window glass is not raised, in addition, when a passenger in the different seat rests against a window glass remaining half opened, even if the master switch is operated, the window glass is not suddenly raised or lowered. This is the same in the driver seat itself as in the different seat.

When the CPU determines the glass is not stopped in the step 103, the CPU determines whether the glass is being raised in step 111. The glass is raised or lowered according to switch operation in the automatic mode.

When the CPU determines the glass is not being raised in the step 111, it allows glass opening operation to be performed in step 113 and then returns processing to the step 101. The glass opening operation is operation that the window glass 102 is lowered in a full opening direction.

When the CPU determines the glass is being raised in the step 111, the CPU determines whether capacitance exceeds a threshold value in step 121. When the capacitance does not exceed the threshold value, the CPU allows glass closing operation to be performed in step 123 and then returns processing to the step 101. The glass closing operation is operation that the window glass 102 is raised in a full closing direction.

When the CPU determines the capacitance exceeds the threshold value in the step 121, it allows reversal of the glass in step 131. Thus, when the glass is being raised, and the capacitance exceeds the threshold value, the window glass 102 being raised is lowered.

A phenomenon that the capacitance exceeds the threshold value during raising of the glass occurs when a human body is going to be pinched by the window glass 102. However, since the glass is reversely moved at that time, pinching is avoided in the different seat or in the driver seat.

Hereinbefore, while an example of the power window for a vehicle was shown, the power window is not limited to the power window for a vehicle, and any power window is acceptable if it moves a window glass by using a window regulator. Moreover, while an example of the power window, which closed a window frame by raising the window glass, was shown, a power window that closes the window frame by lowering the window glass, or a power window that closes the window frame by moving the window glass in a horizontal or an oblique direction is also acceptable. In addition, while an example where a voltage signal was used as a capacitance detection signal was shown, the capacitance detection signal may include a current signal, a frequency signal, or capacitance itself.

Figure 54:
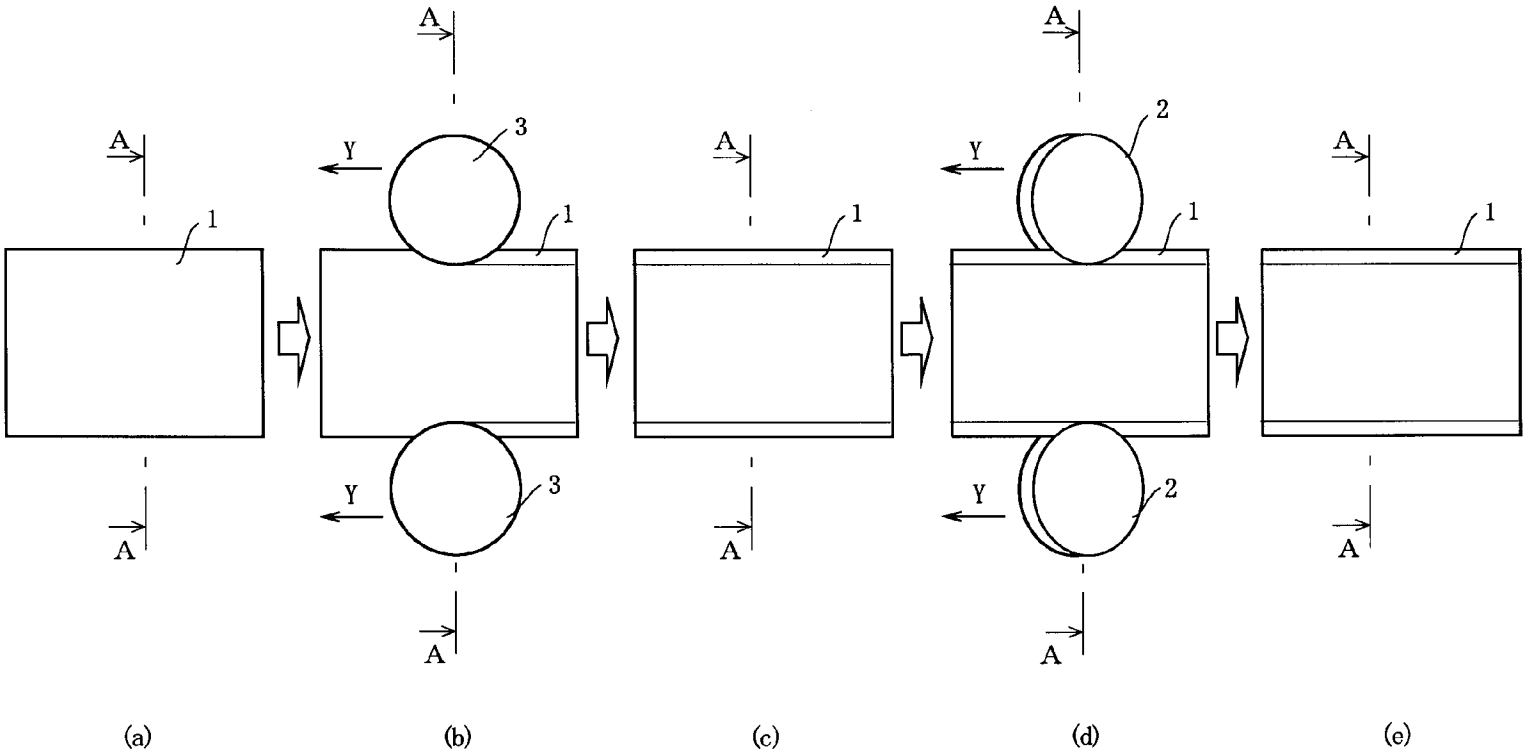
[FIG. 54] It shows conceptual diagrams of plate-glass processing according to a method as an example of the best mode for carrying out the invention.
Figure 55:
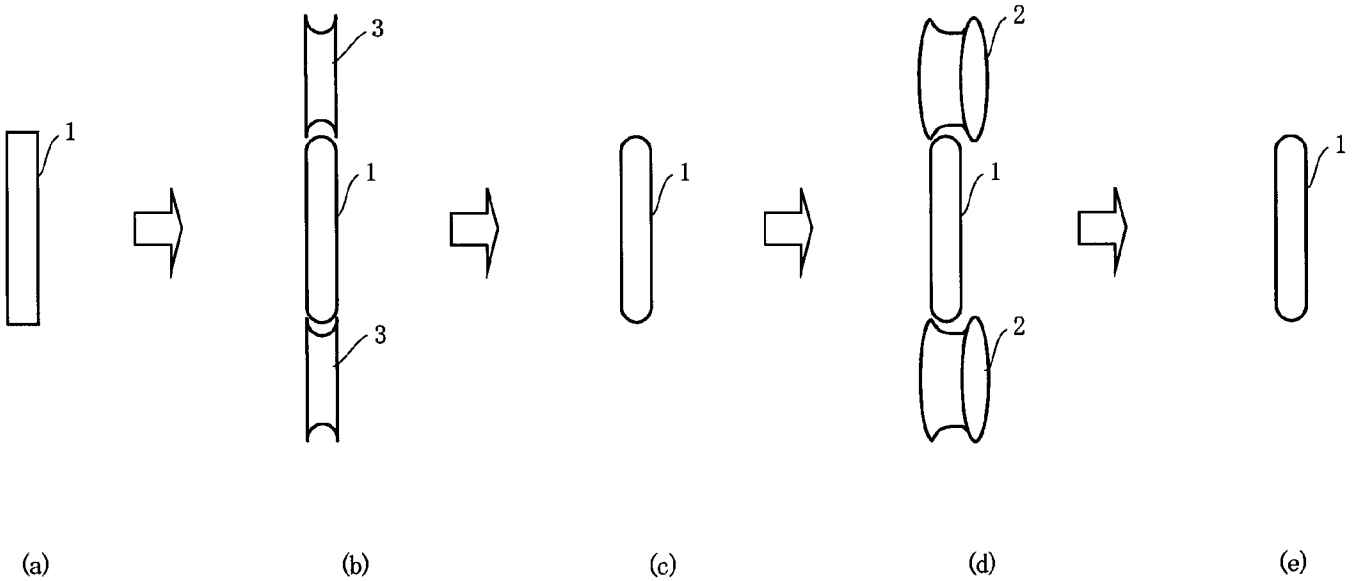
[FIG. 55] It shows conceptual diagrams of the plate-glass processing according to the method as the example of the best mode for carrying out the invention.

FIGS. 54 and 55 conceptually show a plate-glass processing process according to a method as an example of the best mode for carrying out the invention. FIGS. 54 and 55 show process diagrams represented by front diagrams and section diagrams respectively. Each section is an A-A section in FIG. 54. The process proceeds in order of (a), (b), (c), (d) and (e).

Plate glass 1, which is in an unprocessed state in step (a), is subjected to primary processing at edge portions by an approximately disk-shaped diamond wheel 3 in step (b). The primary processing is performed through relative displacement in a Y direction in FIG. 54 while grinding the edge portions of the plate glass 1 by the rotating diamond wheel 3.

Through the primary processing, each edge portion of the plate glass 1 is formed into an R surface corresponding to a concave circumferential surface, which abrasively contacts the edge portion, of the diamond wheel 3. This condition is shown in (c). The primary processing may be performed such that each edge portion of the plate glass 1 is formed into a C surface by a diamond wheel having a spool-like circumferential surface.

In step (d), each edge portion of the plate glass 1 is subjected to secondary processing by an approximately disk-like chamfering wheel 2. The secondary processing is performed through relative displacement in the Y direction in FIG. 54 while grinding the edge portion of the plate glass 1 by the rotating chamfering wheel 2. Through the secondary processing, each edge portion of the plate glass 1 is formed into an R surface corresponding to a concave circumferential surface, which abrasively contacts the edge portion, of the chamfering wheel 2.

Figure 56:
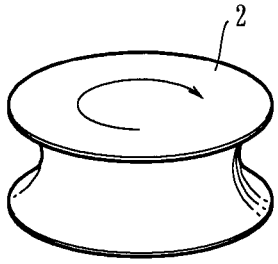
[FIG. 56] It shows diagrams showing an example of a chamfering wheel used for the plate-glass processing.
Figure 56:
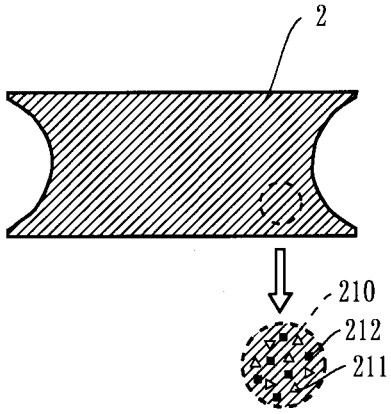

As the chamfering wheel 2, a chamfering wheel is used, which may deposit a conductive substance onto each edge portion of the plate glass 1 along with abrasion. FIG. 56 shows an example of such a chamfering wheel 2. In FIG. 56, (a) shows an exterior view of the wheel, and (b) shows a section thereof. The section includes a central axis and is parallel to the central axis.

As shown in a partially expanded manner in (b) of FIG. 56, for example, the chamfering wheel 2 is configured by a material including rubber 210 in which Cerium oxide (CeO2) particles 211 and metal particles 212 are dispersed. The Cerium oxide (CeO2) particles 211 act as an abrasive. The metal particles 212 act as a conductive substance. The rubber 210 is a substance acting as a substrate for holding those particles. As an abrasive, diamond particles may be used in place of the Cerium oxide (CeO2) particles. As the metal particles 212, for example, silver particles are used. The metal particles 212 may be not only the silver particles, but also other appropriate metal particles.

Since the chamfering wheel 2 has such a composition, the chamfering wheel 2 itself is also abraded during abrading the plate glass 1. Therefore, the metal particles 212 are separated from a portion of the wheel, which is abrasively contacted with the plate glass 1, and easily deposited onto a surface to be processed of the plate glass 1.

Figure 57:
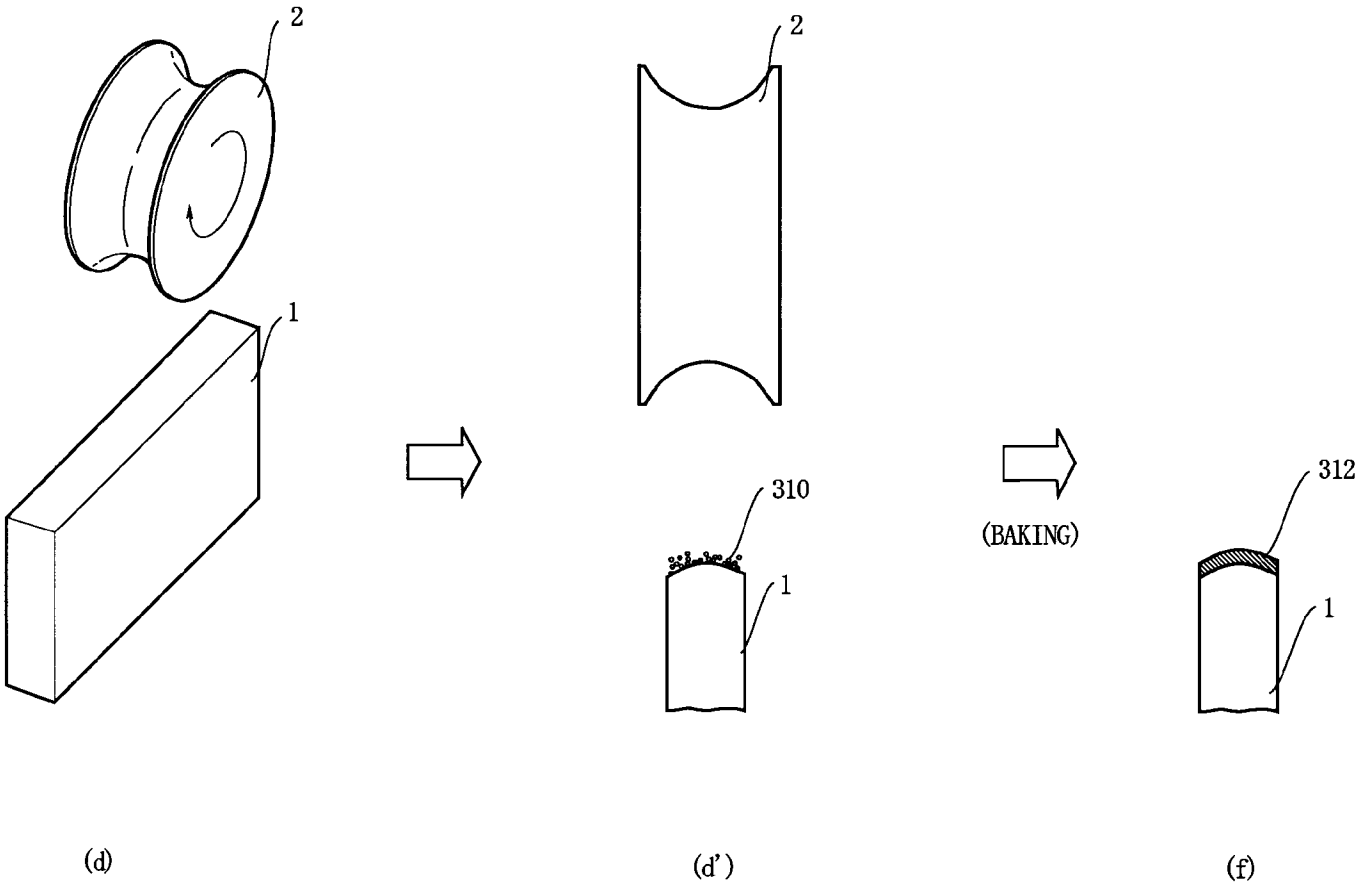
[FIG. 57] It shows diagrams showing part of a plate-glass processing process respectively.

Such a condition is schematically shown in FIG. 57. That is, the metal particles 310 separated from the chamfering wheel 2 are deposited onto the edge portion of the plate glass 1 during abrasion of the step (d), as shown in (d'). Such plate glass 1 is baked at an appropriate temperature, thereby a metal layer 312, which adheres to the edge portion of the plate glass 1, can be formed. The metal layer 312 can be used as an electrode.

In this way, since the conductive substance for the electrode is naturally deposited onto the edge portion of the plate glass 1 along with abrasion, a conductive substance need not be further deposited onto the edge portion of the plate glass 1. Consequently, an apparatus or a step for such deposition is also unnecessary.

Figure 58:
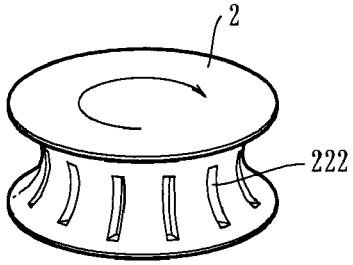
[FIG. 58] It shows diagrams showing an example of a chamfering wheel used for the plate-glass processing.
Figure 58:
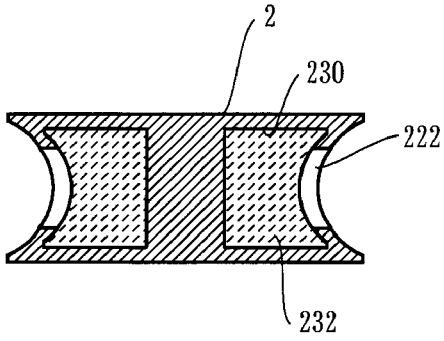

FIG. 58 shows another example of the chamfering wheel 2. In FIG. 58, (a) shows an exterior view of the wheel, and (b) shows a section thereof. The section includes a central axis and is parallel to the central axis. In the chamfering wheel 2, a circumferential surface, which is a portion to be abrasively contacted with the plate glass 1, is configured by an abrasive, in addition, such a portion has a plurality of slit-like through holes 222. The through holes 222 communicate with a ring-like hollow portion 230 within the chamfering wheel 2, and the hollow portion 230 is filled with a conductive substance 232.

Figure 59:
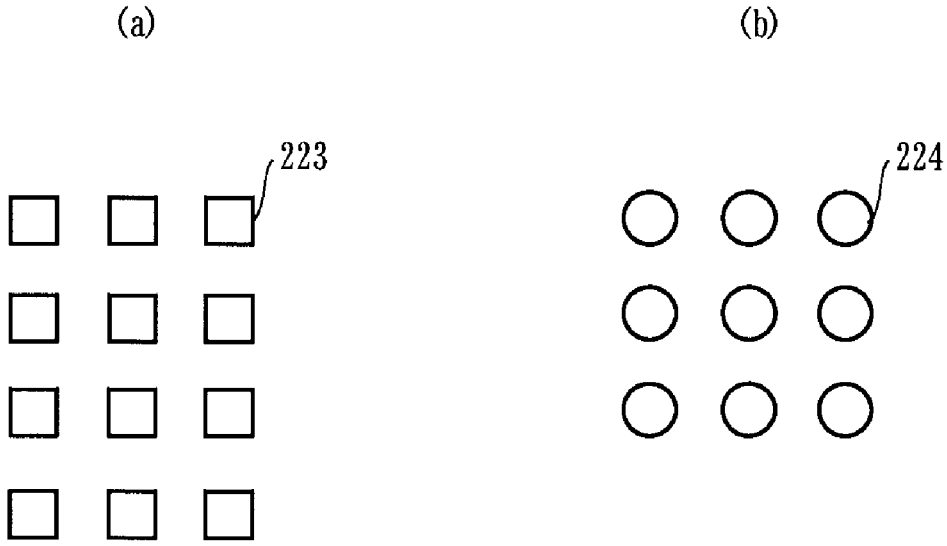
[FIG. 59] It shows diagrams showing a shape of holes in a circumferential surface of the chamfering wheel respectively.

The conductive substance 232 is, for example, conductive paint. The conductive substance 232 may be not only the conductive paint, but also metal powder, a liquid containing metal powder, metal paste, or ceramic paste mainly containing silver or the like. Moreover, the through holes 222 may be not only the slit-like holes, but also holes having an appropriate shape such as square holes 223 or circular holes 224 as shown in (a) and (b) of FIG. 59 respectively.

Since the chamfering wheel 2 has such a configuration, the metal particles 212 are discharged from the through holes 222 in a portion abrasively contacted with the plate glass 1, and easily deposited onto a surface to be processed of the plate glass 1.

Figure 60:
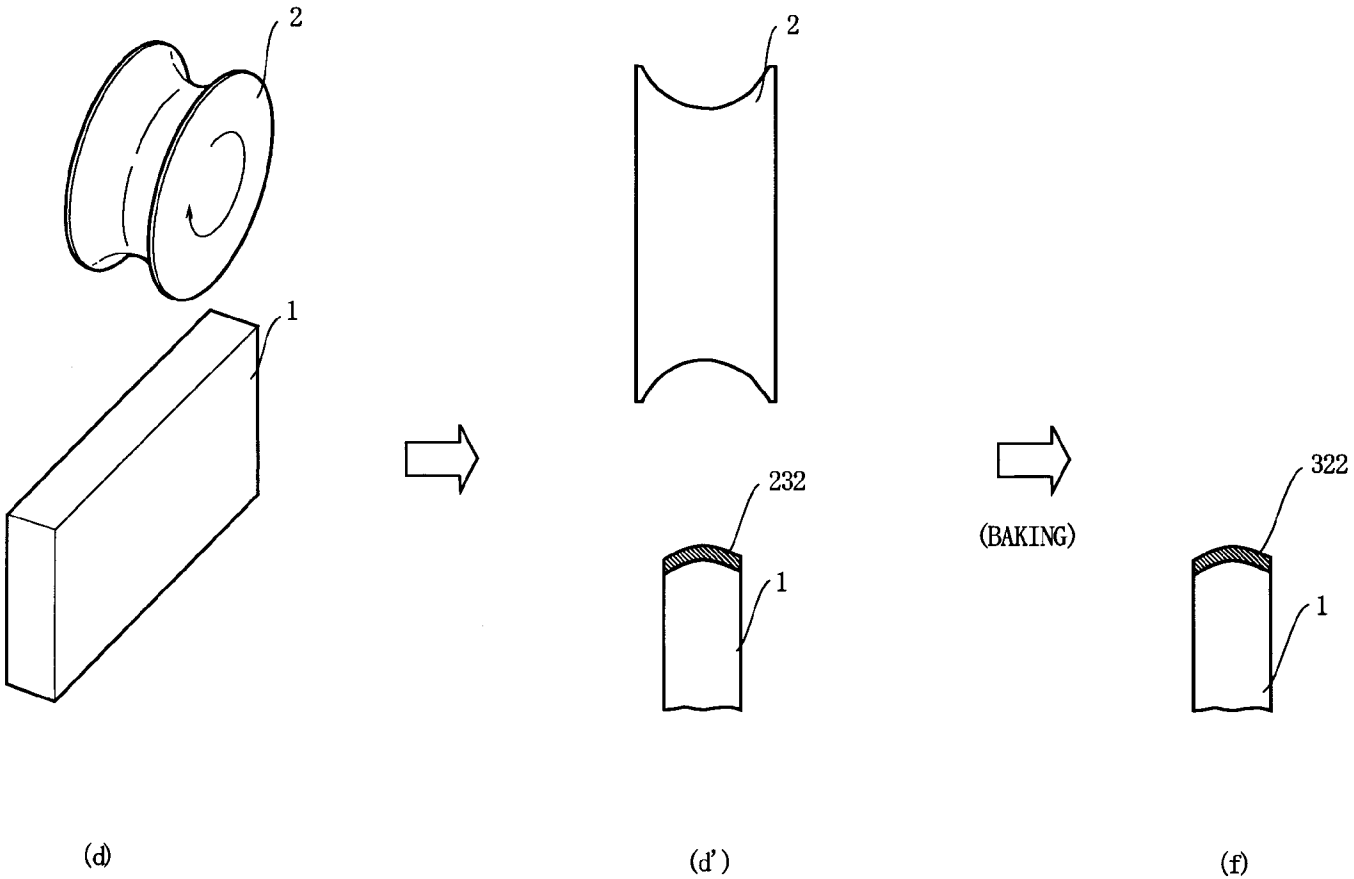
[FIG. 60] It shows diagrams showing part of a plate-glass processing process respectively.

Such a condition is schematically shown in FIG. 60. That is, the conductive substance 232 discharged from the through holes 222 of the chamfering wheel 2 is deposited onto the edge portion of the plate glass 1 during abrasion of the step (d), as shown in (d'). Such plate glass 1 is baked at an appropriate temperature, thereby a conductive layer 322, which adheres to the edge portion of the plate glass 1, can be formed. The conductive layer 322 can be used as an electrode.

In this way, since the conductive substance for the electrode is naturally deposited onto the edge portion of the plate glass 1 along with abrasion, a conductive substance need not be further deposited onto the edge portion of the plate glass 1. Consequently, an apparatus or a step for such deposition is also unnecessary.

The invention claimed is:

1. An opening/closing control method, which is a method of performing opening/closing control with a pinching prevention function while determining a detection signal from a sensor based on a threshold value, the method comprising:

setting the threshold value as a value offset from a reference value for control, and updating the reference value in correspondence to a value of the detection signal from the sensor in an initial stage of control, and each time when the value of the detection signal from the sensor continuously changes in a certain time within a range where the value of the detection signal from the sensor does not exceed the threshold value, the reference value is modified by a value corresponding to such a changed value.

2. The opening/closing control method according to claim 1, wherein:

the offset is constant.

3. The opening/closing control method according to claim 1, wherein:

the offset is variable.

4. The opening/closing control method according to claim 1, wherein:

a second threshold value larger than the threshold value and a third threshold value smaller than the threshold value are used as threshold values for abnormality determination in a detection signal system of the sensor.

5. The opening/closing control method according to claim 4, wherein:

one of the second and third threshold values is a threshold value for disconnection determination in the detection signal system of the sensor, and the other is a threshold value for the short-circuit determination.

6. The opening/closing control method according to claim 1, wherein:

when a window regulator, which reciprocates a window glass between a closing position of a window frame and an opening position thereof, is allowed to detect contact of a human body by using capacitance between the window glass and the window frame for avoiding pinching, pinching avoidance is made to be valid or invalid depending on whether a rate of change in capacitance detection signal during movement of the window glass is within a range being specified beforehand.

7. The opening/closing control method according to claim 1, wherein:

when a window regulator, which reciprocates a window glass between a closing position of a window frame and an opening position thereof, is allowed to detect contact of a human body by using capacitance between the window glass and the window frame for avoiding pinching, pinching avoidance is made to be valid or invalid depending on whether a rate of change in capacitance detection signal during movement of the window glass, which is in a region near a fully closing position of the window frame, is within a range being specified beforehand.

8. An opening/closing control method according to claim 1, wherein:

when a plurality of window regulators, which reciprocate window glasses in a plurality of windows between a closing position of a window frame and an opening position thereof respectively while avoiding pinching of a human body based on a detection signal using capacitance, are individually controlled, in a condition that the window glasses are stopped, and the detection signal exceeds a threshold value, when switch operation for moving a window glass is performed for at least one window, the window glass in the relevant window is made immovable or lowered.

9. The opening/closing control method according to claim 8, wherein:

the plurality of windows are windows in a vehicle, and the switch operation is performed at a driver seat.

* * * * *